US006317094B1

(12) United States Patent
Wu et al.

(10) Patent No.: US 6,317,094 B1
(45) Date of Patent: Nov. 13, 2001

(54) FEED STRUCTURES FOR TAPERED SLOT ANTENNAS

(75) Inventors: Chen Wu, Hamilton; John Litva, Creston, both of (CA)

(73) Assignee: Litva Antenna Enterprises Inc., Hamilton (CA)

( * ) Notice: Subject to any disclaimer, the term of this patent is extended or adjusted under 35 U.S.C. 154(b) by 0 days.

(21) Appl. No.: 09/316,942

(22) Filed: May 24, 1999

(51) Int. Cl.[7] ..... H01Q 1/38; H01Q 13/10; H01Q 21/06

(52) U.S. Cl. ..... 343/767; 343/770

(58) Field of Search ..... 343/767, 770; H01Q 13/10, 1/38, 21/06

(56) References Cited

U.S. PATENT DOCUMENTS

| | | | | |
|---|---|---|---|---|
| 4,197,545 | * | 4/1980 | Favaloro et al. | 343/700 |
| 4,853,704 | * | 8/1989 | Diaz et al. | 343/767 |
| 5,036,335 | * | 7/1991 | Jairam | 343/767 |
| 5,175,560 | * | 12/1992 | Lucas et al. | 343/767 |
| 5,572,222 | * | 11/1996 | Mailandt et al. | 343/700 |
| 5,619,216 | * | 4/1997 | Park | 342/771 |

OTHER PUBLICATIONS

Adalbert Beyer: Millimeter–Wave Antenna In Finline Technique, ICAP '83, pp. 44–46.*

K.S. Yngvesson et al: Endfire Tapered Slot Antennas on Dielectric Substrates. IEEE Trans. on AP, vol. 33, No. 12, Dec. 1985, pp. 1392–1400.*

R. Janaswamy et al: Analysis of the Transverse Electromagnetic Mode Linearly Tapered Slot Antenna, Radio Science, vol. 21, No. 5, Sep. 1986, pp. 797–804.*

T. Thungren et al: Vivaldi Antennas for Single Beam Integrated Receivers, Advanced Antenna Technology, vol. 2, 1987, pp. 475–480.*

R. Janaswamy et al: Analysis of the Tapered Slot Antenna. IEEE Trans. on AP, vol. 35, No. 9, Sep. 1987, pp. 1058–1059.*

D.H. Schaubert: A Class Of E–plane Scan Blindnesses in Single–polarized Arrays of Tapered Antennas with a Ground Plane. IEEE Trans. on AP, vol. 44, No. 7, Jul. 1996, pp. 954–959.*

Adalbert Beyer: Theoretical Considerations of Finline Antennas, ICAP'87, pp. 181–184.*

M. Helier et al: Analysis of Planar Non–Uniform Slot–Line Antennas, ICAP'87, pp. 194–197.*

E.Gazit: Improved Design of the Vivaldi Antenna, IEEE, vol. 135, pt H, No. 2, Apr. 1998, pp. 89–92.*

(List continued on next page.)

*Primary Examiner*—Michael C. Wimer
(74) *Attorney, Agent, or Firm*—Bereskin & Parr

(57) ABSTRACT

A suspended microstrip line structure for feeding a tapered slot antenna has a ground layer separated by means of an air gap from a dielectric slab with a strip line conductor feed running on the surface of the dielectric. The strip line may run along the surface of the dielectric which faces away from the ground layer, or the structure may be inverted such that the strip line runs along the surface of the dielectric which faces the ground layer. These suspended microstrip line structures exhibit lower transmission loss. In another embodiment, a printed transmission line having a slot in its ground layer feeds a tapered slot antenna element which lies in a plane which intersects, and so is not parallel to, the printed transmission line structure. The ground layer slots cut the current on the ground of the transmission line and couple energy from the line to the tapered slot antenna element. Altering the configuration of the ground layer slots allows the antenna to efficiently operate within different frequency bands without changing the dimensions or parameters of the tapered slot antenna or the printed transmission line. The printed transmission line is preferably a suspended microstrip line. One and two dimensional arrays of these antenna elements fed by a parallel beam forming network (BFN) may also be assembled.

30 Claims, 50 Drawing Sheets

OTHER PUBLICATIONS

Huang Jingxi: Analysis of Vivaldi Antennas, ICAP'89, pp. 206–208.*

D.H. Schaubert: Endfire Tapered Slot Antenna Characteristics, ISAP'89, pp. 432–436.*

K.S. Yngvesson et al: The Tapered Slot Antenna—A New Integrated Element for Millimeter–Wave Applications, IEEE Trans. on. MTT, vol. 37, No. 2, Feb. 1989, pp. 365–374.*

Young–Sik Kim and K. Sigfrid Yngvesson: Characterization of Tapered Slot Antenna Feeds and Feed Arrays, IEEE Trans. on AP, vol. 38, No. 10, Oct. 1990, pp. 1559–1564.*

P.S. Kool et al: Parametric Studies of the Linearly Tapered Slot Antenna (LTSA), Microwave and Optical Technology Letters, vol. 4, No. 5, Apr. 1991, pp. 200–207.*

Michael E. Cooley et al: Radiation and Scattering Analysis of Infinite Arrays of Endfire Slot Antennas with a Ground Plate, IEEE Trans. on AP, vol. 39, No. 12, Nov. 1991, pp.1615–1624.

Jean–Pierre R. Bayard et al: Analysis of Infinite Arrays of Printed Dipoles on Dielectric Sheets Perpendicular to a Ground Plane, IEEE Trans. on AP. vol. 39, No. 12, Dec. 1991, pp. 1722–1731.

R.N. Simons et al: Linearly Tapered Slot Antenna with Dielectric Superstrate, 1993, APS, pp. 1482–1485.

N. Fourikis et al: Parametric Study of Co and Cross Polarization Characteristics of Tapered Planar and Antipodal Slotline Antennas, IEEE, vol. 140, pt H, No. 1, Feb. 1993, pp. 17–22.

D.H. Schaubert et al: Scanning Characteristics of Stripline–fed Tapered Slot Antenna on Dielectric Substrates, Antenna Application Symposium, 1994.

Richard Q. Lee et al: Linearly Tapered Slot Antenna and Feed Networks, Antenna Application Symposium, 1994.

J.D.S. Langley et al: Novel Ultrawide–bandwidth Vivaldi Antenna with low Crosspolarization, Electronics letters, 11th, Nov. 1993, vol. 29, No. 23, pp. 2004–2005.

D.H. Schaubert: Moment Method Analysis of Infinite Stripline–fed Tapered Slot Antenna Arrays with a Ground Plane, IEEE Trans. on AP, vol. 42, No. 8, Aug. 1994, pp. 1161–1166.

Rainee N. Simons et al: Integrated Uniplanar Transition for Linearly Tapered Slot Antenna, IEEE Trans. on AP, vol. 43, No. 9, Sep. 1995, pp. 998–1002.

J.D.S. Langley et al: Balanced Antipodal Vivaldi Antenna for Wide Bandwidth Phased Arrays, IEEE, vol. 143, pt H, No. 2, Apr. 1996, pp. 97–102.

Linardou et al: Twin Vivaldi Antenna Fed by Coplanar Waveguide, IEEE 1997 Electronics Letter, Sep. 1997.

R.Q. Lee et al: Measured Mutual Coupling Between Linearly Tapered Slot Antennas,IEEE Trans. on AP, vol. 45, No. 8, Aug. 1997, pp. 1320–1322.

J.B. Muldavin et al: Tapered Slot Antennas on Thick Dielectric Substrates using Micromachining Techniques, 1997 APS–5, pp. 1110–1113.

R.Q. Lee et al: Magnetic Field Distributions at Close Proximity of a Tapered Slot Antenna, 1997 APS–5, pp. 1114–1117.

Frederic Croq and David M. Pozar: Millimeter–Wave Design of Wide–Band Aperture–Coupled Stacked Microstrip Antenna, IEEE Trans. AP, vol. 39, No. 12, pp. 1770–1776, Dec. 1991.

* cited by examiner

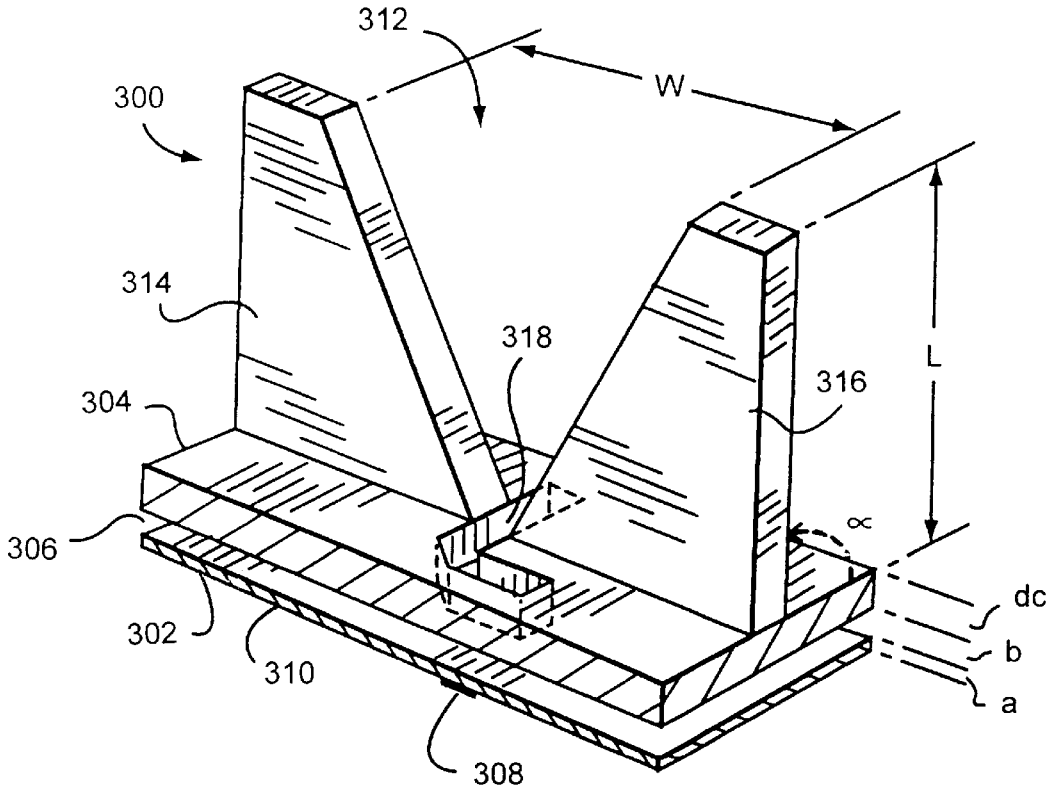
FIGURE 23
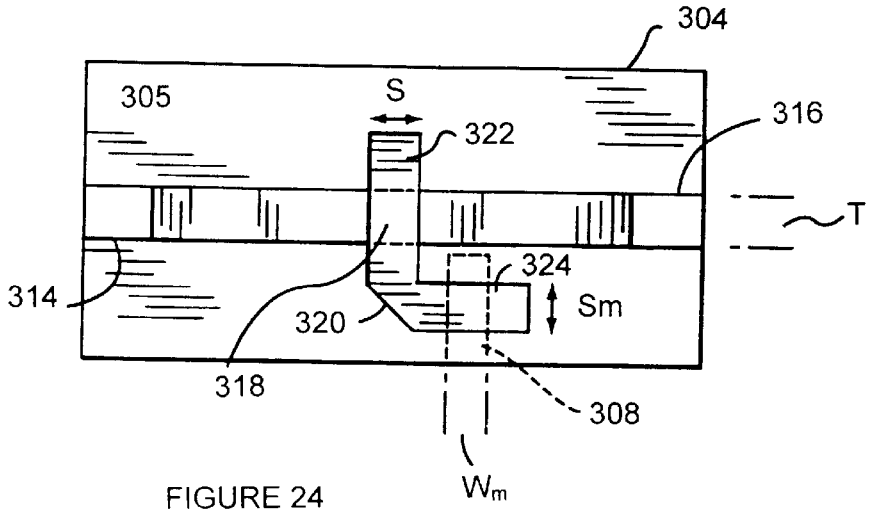
FIGURE 24
FIGURE 25
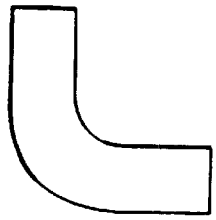

FIGURE 34A
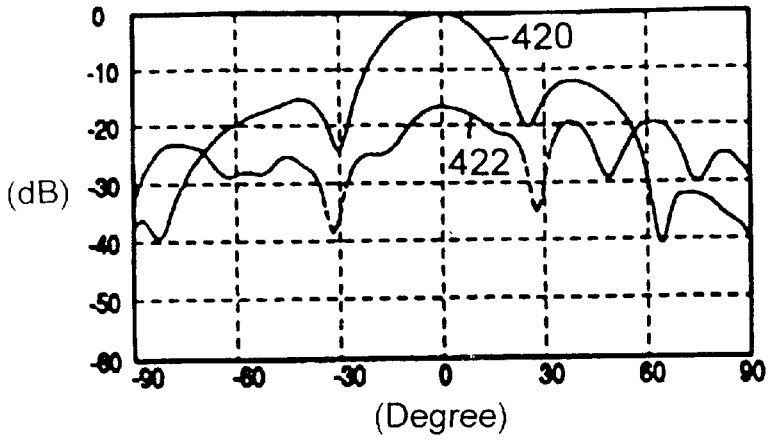
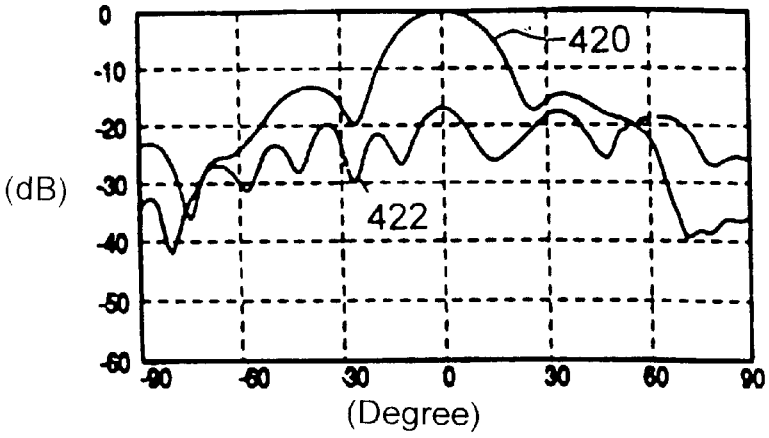
FIGURE 34B

FIGURE 34C
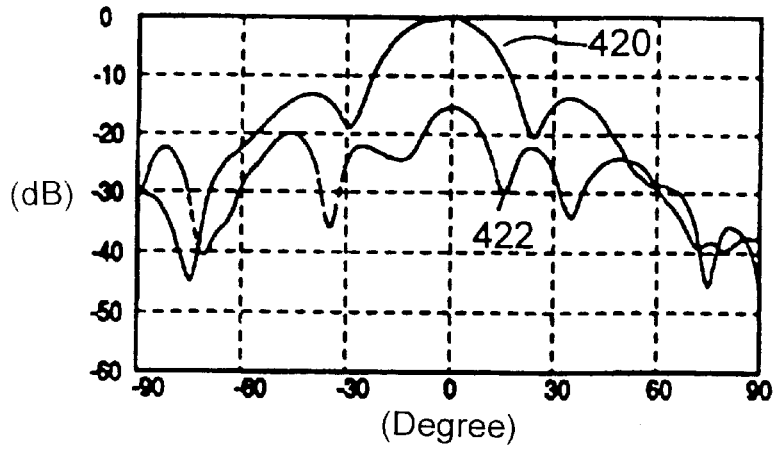
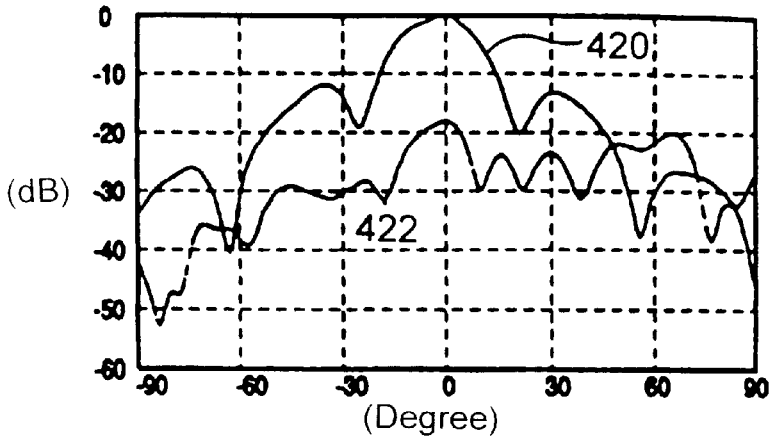
FIGURE 34D

FIGURE 34E
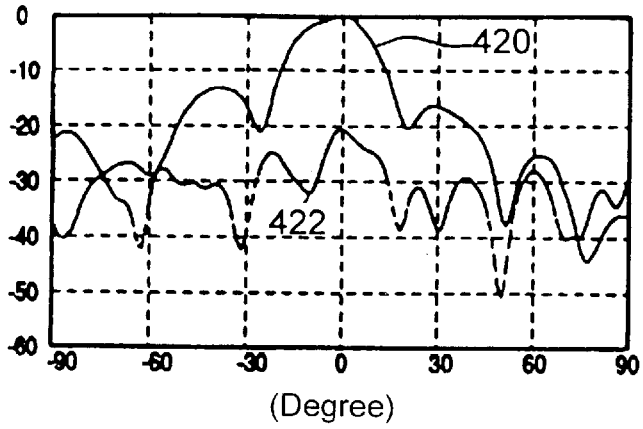
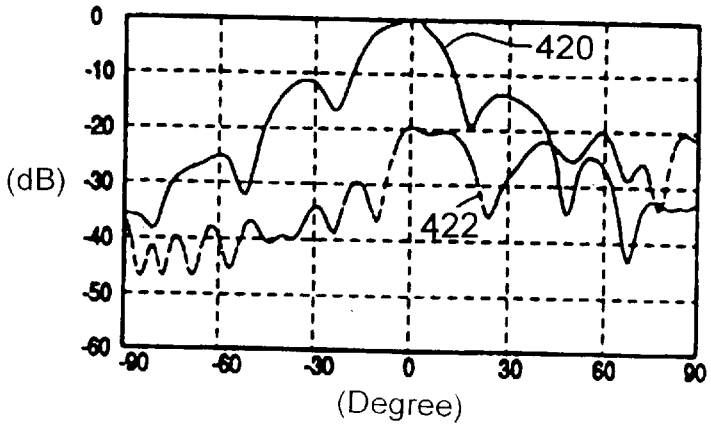
FIGURE 34F

FIGURE 35A
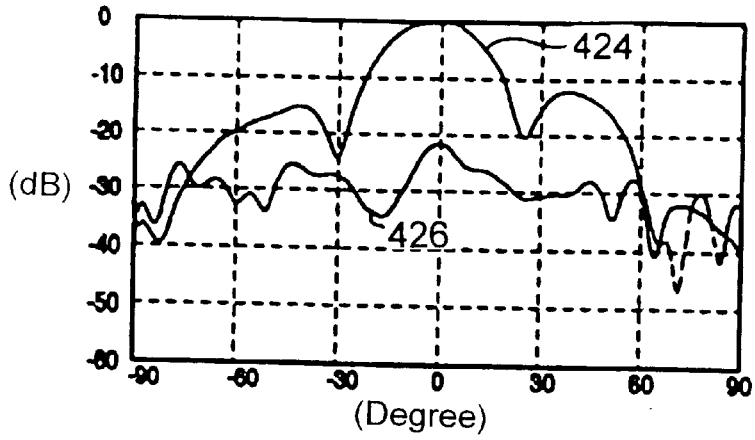
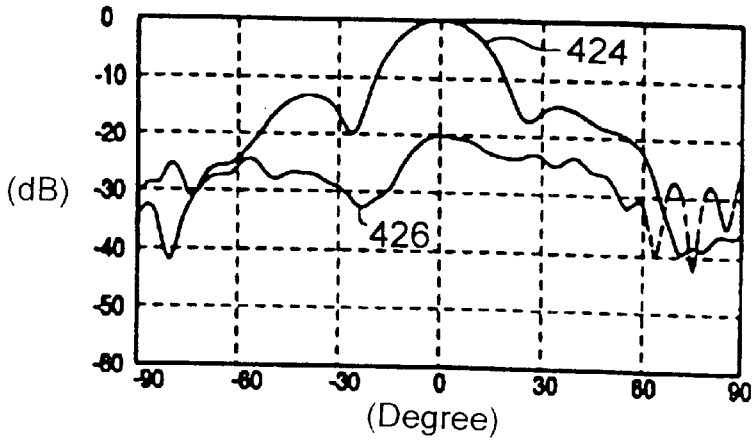
FIGURE 35B

FIGURE 35C
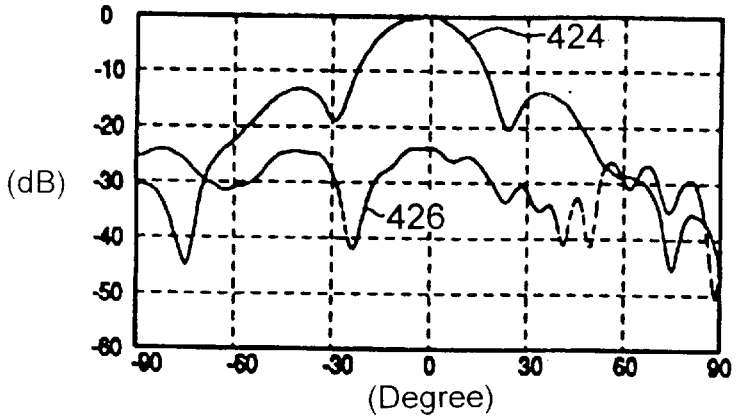
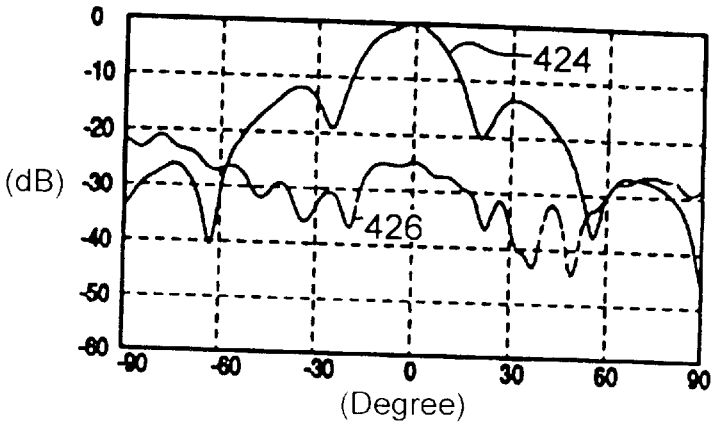
FIGURE 35D

FIGURE 35E
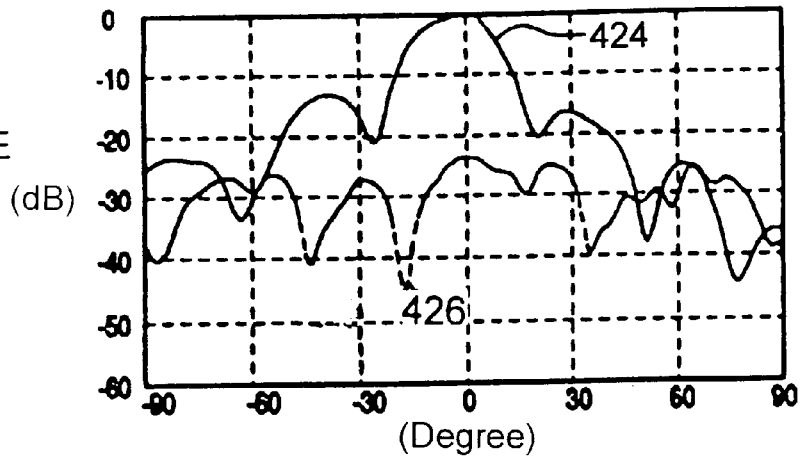
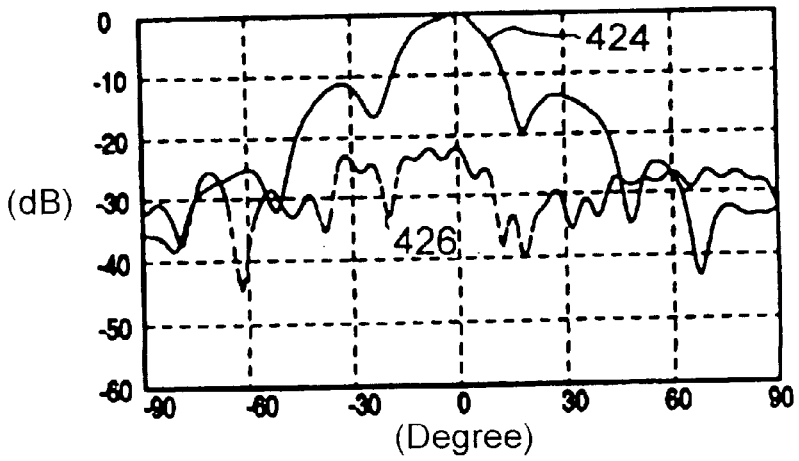
FIGURE 35F

FIGURE 38A
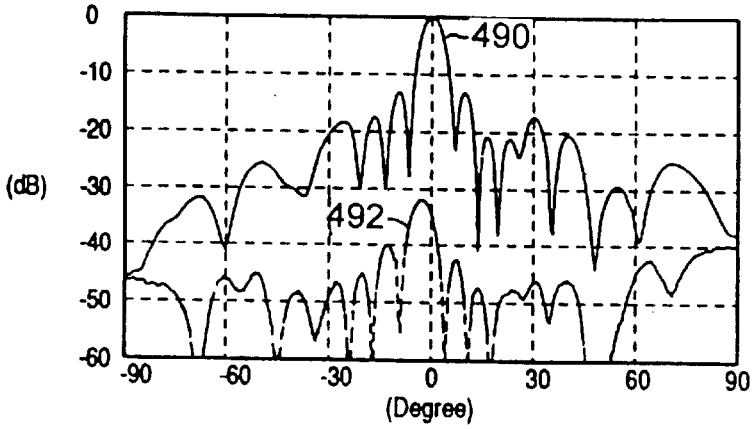
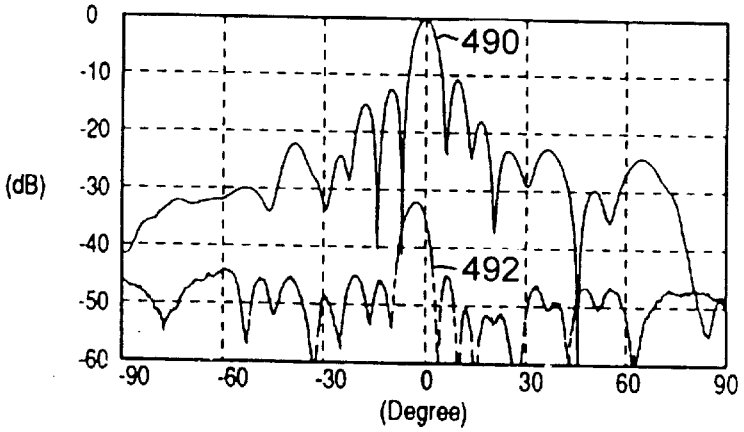
FIGURE 38B

FIGURE 38C
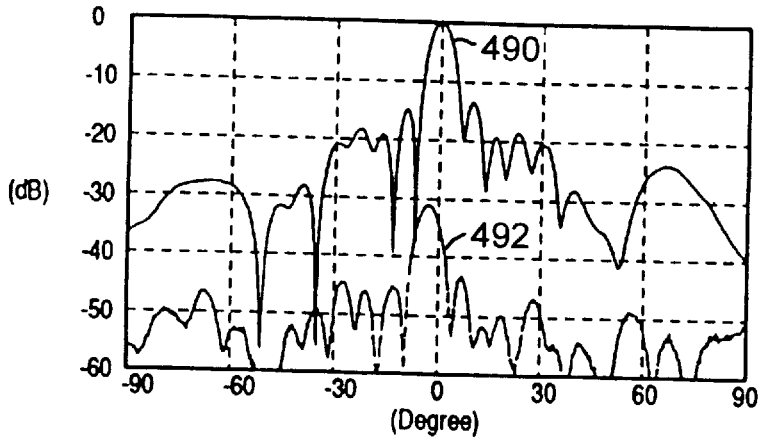
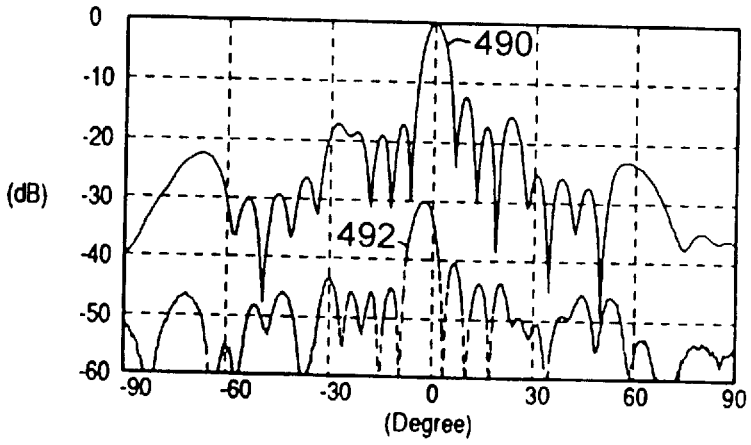
FIGURE 38D

FIGURE 38E
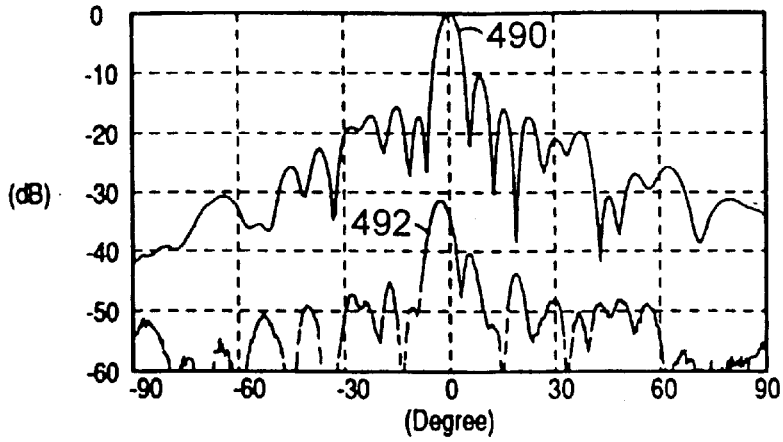
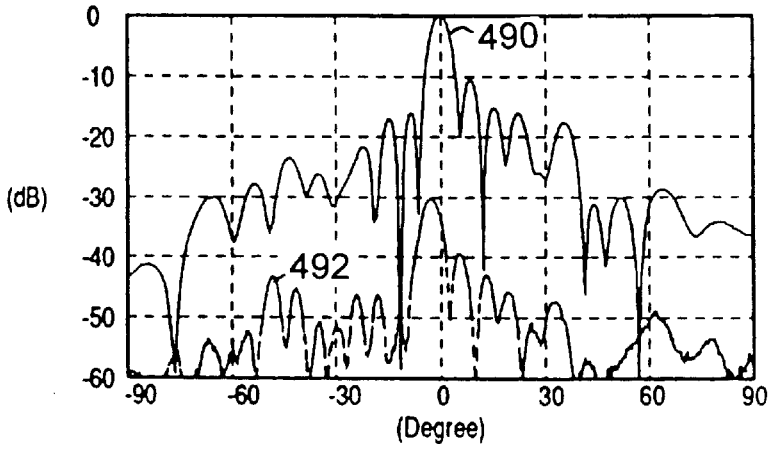
FIGURE 38F

FIGURE 38G
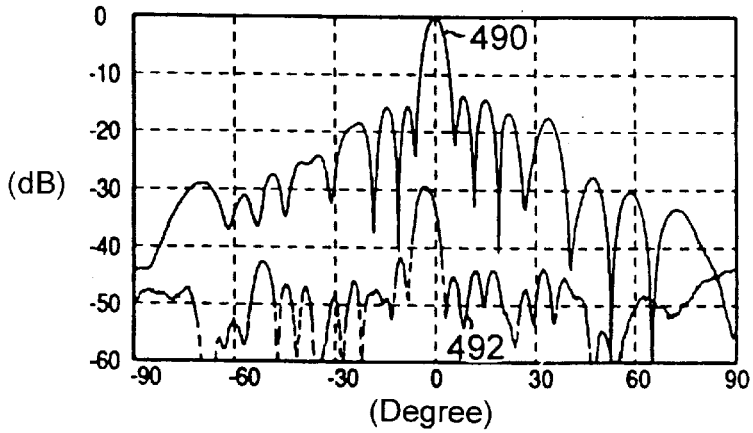
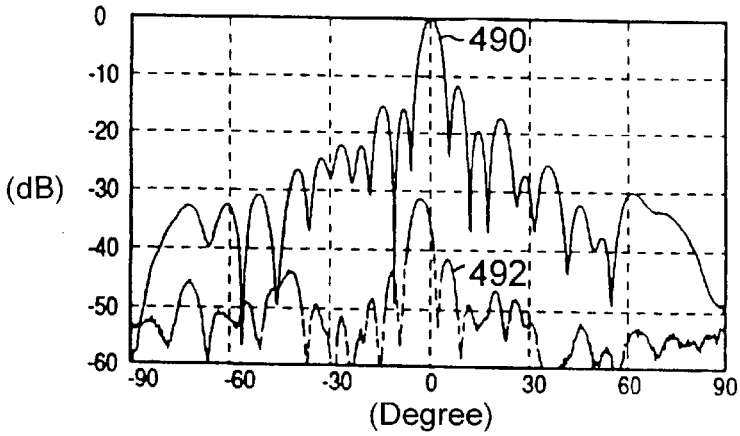
FIGURE 38H

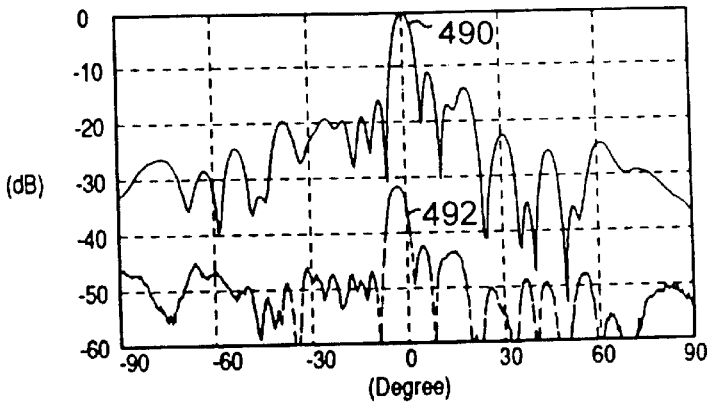
FIGURE 38J
FIGURE 38I
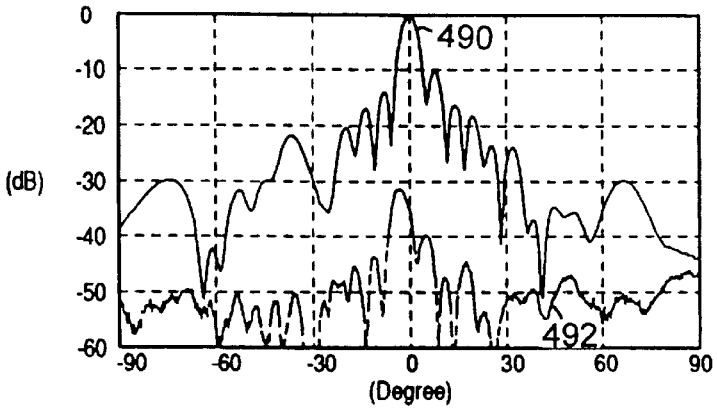

FIGURE 38K
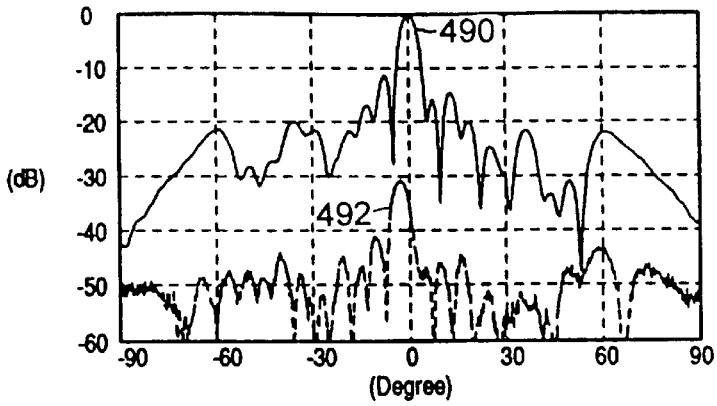
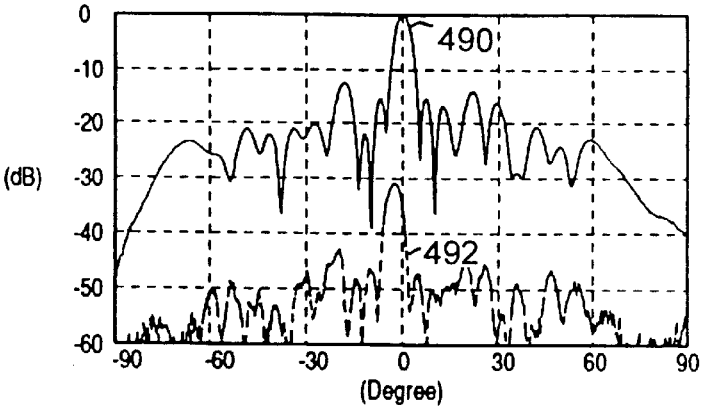
FIGURE 38L

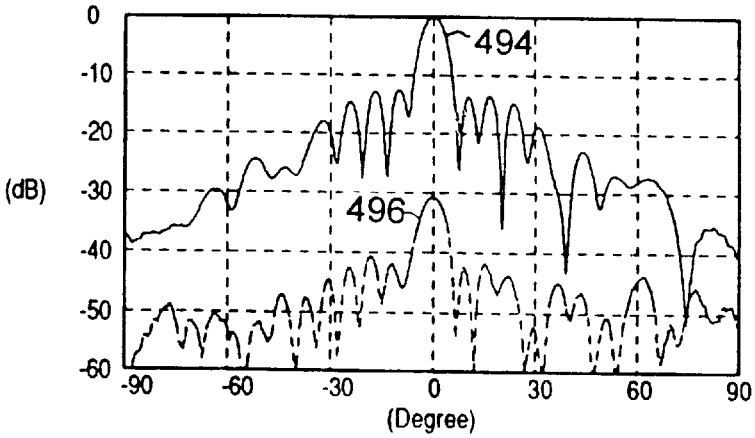
FIGURE 39B
FIGURE 39A
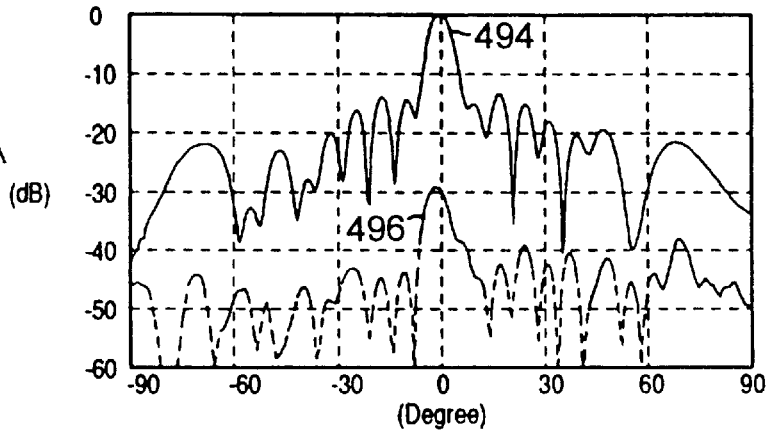

FIGURE 39C
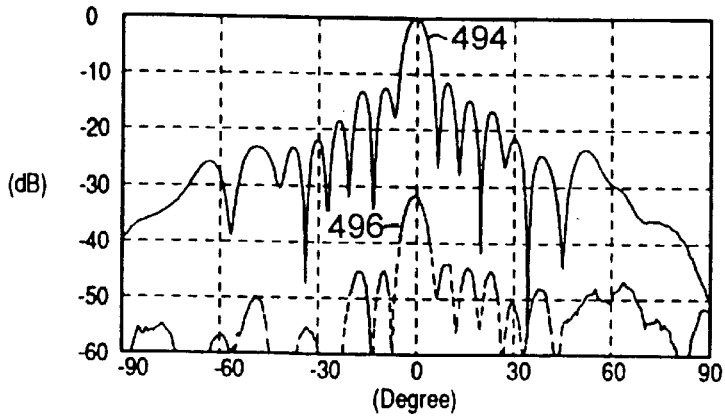
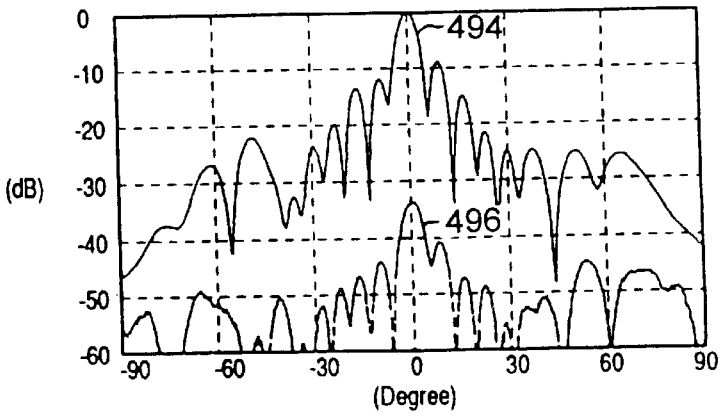
FIGURE 39D

FIGURE 39E
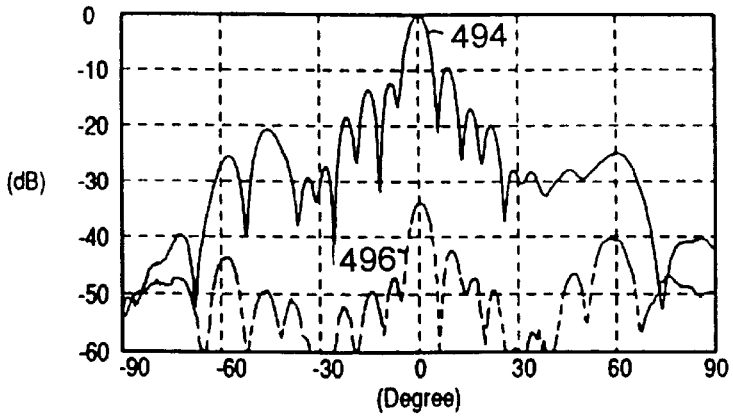
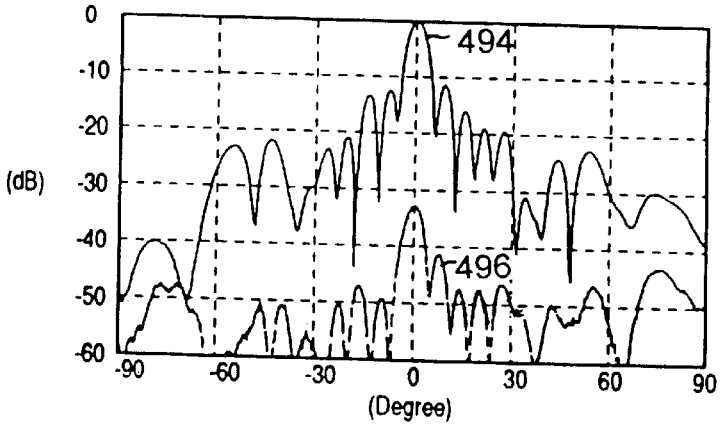
FIGURE 39F

FIGURE 39G
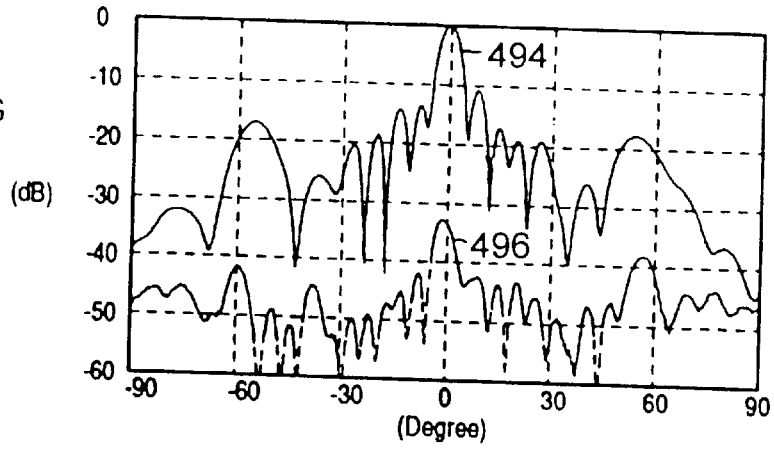
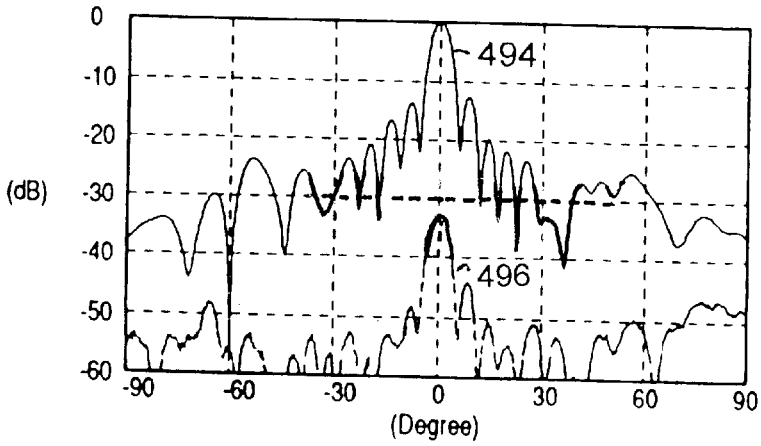
FIGURE 39H

FIGURE 39I
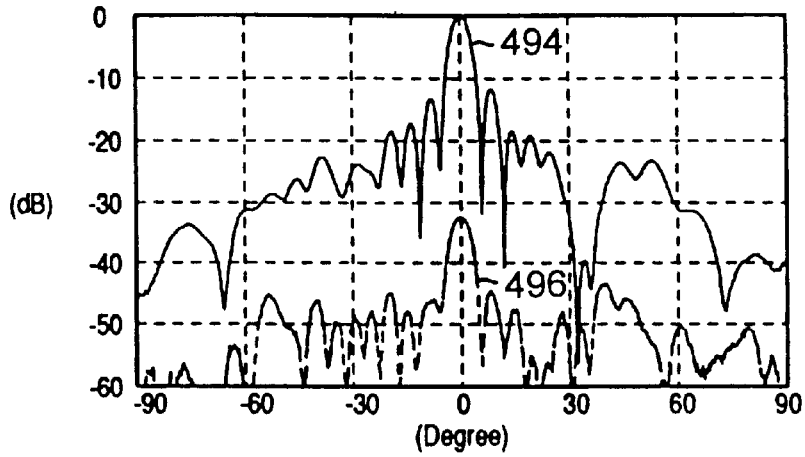
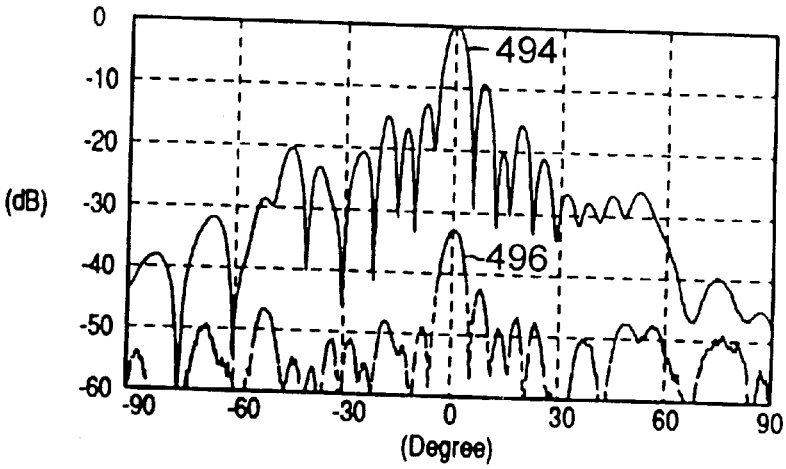
FIGURE 39J

FIGURE 39K
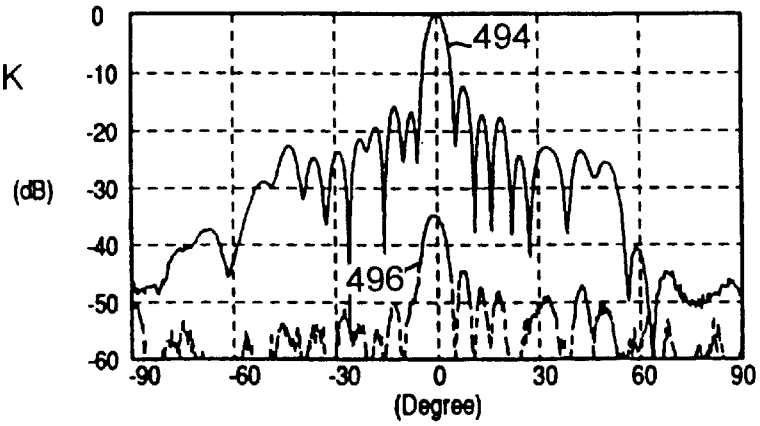
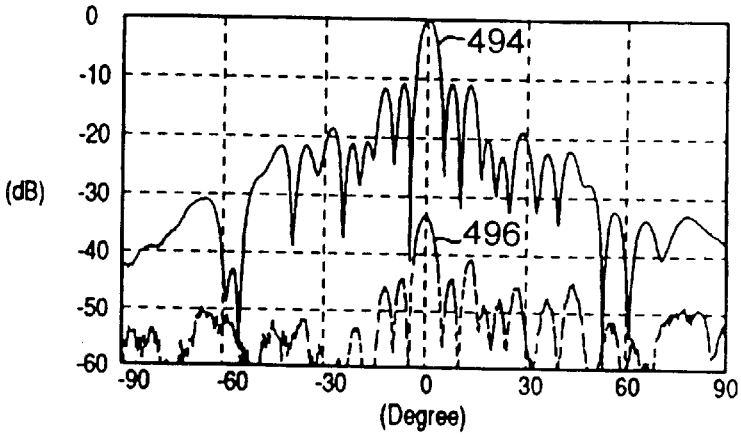
FIGURE 39L

FEED STRUCTURES FOR TAPERED SLOT ANTENNAS

FIELD OF THE INVENTION

The present invention relates to antennas for use in wireless point-to-point and/or point-to-multipoint communication. In particular, the present invention relates to tapered slot antenna elements which radiate and receive microwave and millimeter wave energy and to structures for feeding these elements.

BACKGROUND OF THE INVENTION

Most antennas are passive devices which either radiate or receive electromagnetic radiation. A passive antenna structure can either transmit or receive, and an antenna's transmitting properties can be derived from its receiving characteristic or vice versa. The antenna is connected to a transmission line which carries an electrical signal that is transformed into electromagnetic radiation (in a transmitting antenna) or transformed from electromagnetic radiation (in a receiving antenna). An antenna design should be able to meet the desired criteria for gain, beamwidth, sidelobe level, polarization performance, and bandwidth requirements, while maintaining size/profile (including weight), cost of fabrication, and ease of fabrication at a minimum.

Tapered slot antennas are printed, travelling wave antenna structures which can provide a very wide bandwidth and are also relatively inexpensive to fabricate and integrate with a microwave transmission line. These antennas have a slot which is etched between metallization layers either on the surface of a dielectric substrate or in air. The slot tapers into a narrow slot line which is commonly fed by a microstrip line or other printed transmission line. The microstrip line is a strip conductor which is separated from a ground conductor by a dielectric substrate. However, a problem with the microstrip line is that it has a high transmission loss at high frequencies.

Phased arrays of tapered slot elements provide improved beam reconfiguration capability and improved beam pattern characteristics, particularly in terms of antenna gain. However, prior art feed techniques have limited the number of elements that can be combined into a tapered slot antenna array, because the increasing complexity of prior art feed structure results in increasing transmission losses. At the same time, if feed structures other than printed transmission lines are used, this results in an increase in the antenna array size, particularly thickness, and also in a band-limiting effect.

For instance, U.S. Pat. No. 5,036,335 to Jairam relates to a 45° twist balun configuration for a microstrip line fed tapered slot antenna which improves the return loss of the antenna over a desired bandwidth. However, the feed structure disclosed by Jairam remains unsuitable for feeding a large array of antenna elements, for the reasons given above. Furthermore the structure disclosed by Jairam provides only a limited ability to optimize the return loss for different frequency bands.

As a result, there is a need for structures capable of feeding a tapered slot antenna, and particularly arrays of these antenna elements, which minimize transmission losses, provide a wide band transition that does not significantly curtail the wide band properties of the tapered slot element, is of small size, allow for easy and inexpensive fabrication and integration, and still enable desired performance requirements (including return loss, gain, beamwidth, sidelobe levels, and cross-polarization criteria) to be met.

SUMMARY OF THE INVENTION

It is an object of the present invention to provide improved feed structures for tapered slot antennas.

In a first aspect, the present invention provides a tapered slot antenna structure comprising: (a) a transmission line having a dielectric substrate, a strip conductor feed, and a ground layer, the dielectric substrate having first and second opposing surfaces and the ground layer having front and back opposing surfaces, the strip conductor feed running along one of said first and said second surfaces of the dielectric substrate, the back surface of the ground layer facing and being disposed in parallel to the second surface of the dielectric layer, the dielectric substrate and the ground layer thereby having a parallel disposition relative to one another, and the ground layer further having a feed slot formed within it; (b) a metallization layer lying in a plane which intersects the ground layer at an intersection angle, said metallization layer having a base end connected to the front face of the ground layer and an aperture end, and said metallization layer having a tapered slot formed within it, said tapered slot having an aperture width at the aperture end of said metallization layer and said tapered slot forming a slot line having a slot line width narrower than the aperture width at the base end of said metallization layer; and (c) said feed slot having a first portion and a second portion, the first portion of said feed slot intersecting the slot line in the ground layer and the second portion of said feed slot crossing over the strip conductor feed in a parallel plane manner, whereby the slot line and the strip conductor feed are electromagnetically coupled.

Preferably, the intersection angle is in the range of 45°–90°, and in one embodiment the intersection angle is equal to 90°, so that the metallization layer lies in a plane which is perpendicular to the ground layer and the dielectric substrate.

The structure may be fed by a suspended microstrip line wherein the strip conductor feed runs along the first surface of the dielectric substrate, and the ground layer faces, is disposed in parallel to the second surface of said dielectric substrate, and is spaced from the dielectric substrate such that an air gap is formed between the second surface and said ground layer. Alternatively, the structure may be fed by an inverted suspended microstrip line wherein the strip conductor feed runs along the second surface of the dielectric substrate, and the ground layer faces, is disposed in parallel to the second surface of said dielectric substrate, and is spaced from the dielectric substrate such that an air gap is formed between the second surface and said ground layer. The structure can also be fed by a standard microstrip line wherein the strip conductor feed runs along the first surface of the dielectric substrate, and the ground layer faces and is disposed in parallel to and directly against the second surface of said dielectric substrate.

In a preferred embodiment of the feed slot, the width of the first portion of said feed slot equals the slot line width. Also preferably, the first portion of said feed slot has first and second ends and the second portion of said feed slot has first and second ends, and the first end of the first portion is connected to the first end of the second portion by way of a transition portion in said feed slot such that the first portion and the second portion run perpendicularly to one another. In another embodiment, the feed slot further includes a termination segment connected to the second end of the second portion of said feed slot.

In another aspect, the present invention provides an M×N array of tapered slot antenna elements, where M and N are positive integers greater than or equal to one, comprising: (a) a transmission line having a dielectric substrate, a beam forming network feed, and a ground layer, the dielectric substrate having first and second opposing surfaces and the ground layer having front and back opposing surfaces, the beam forming network running along one of said first and said second surfaces of the dielectric substrate, the back surface of the ground layer facing and being disposed in parallel to the second surface of the dielectric layer, the dielectric substrate and the ground layer thereby having a parallel disposition relative to one another, the ground layer further having a feed slot for each of said tapered slot antenna elements formed within it, and the beam forming network having a strip conductor feed for each of said tapered slot antenna elements; (b) M metallization layers each lying in a plane which intersects the ground layer at an intersection angle, each of said metallization layers having a base end connected to the front surface of the ground layer and an aperture end, and each of said metallization layers having N tapered slots formed within it, the tapered slots having an aperture width at the aperture end of the metallization layer and each of the tapered slots forming a slot line having a slot line width narrower than the aperture width at the base end of the metallization layer; (c) the feed slot for each of said tapered slot antenna elements having a first portion and a second portion, the first portion of each feed slot intersecting the slot line of said tapered slot antenna element in the ground layer and the second portion of said feed slot crossing over the strip conductor feed for said tapered slot antenna element in a parallel plane manner, whereby the slot line and the strip conductor for said tapered slot antenna element feed are electromagnetically coupled.

Preferably, the M metallization layers are parallel to one another and each of the N tapered slots formed thereon being arranged so that the intersections in the ground layer of the first portion of each feed slot and the slot line for said tapered slot antenna element are uniformly aligned and spaced apart. Also preferably, the beam forming network feeds each of said tapered slot antenna elements in parallel. The array of tapered slot antenna elements may be fed by a suspended microstrip line or an inverted microstrip line.

In a further aspect, the present invention provides a tapered slot antenna feed structure comprising: (a) a dielectric substrate having first and second opposing surfaces; (b) a strip conductor feed running along one of the first and second surfaces; (c) a ground layer having front and back opposing surfaces, said back surface facing and being disposed in parallel to the second surface of said dielectric substrate; and (d) first and second metallization layers running along said one of said first and second surfaces, each of said metallization layers having a base end and an aperture end, said metallization layers forming a tapered slot therebetween, said tapered slot having an aperture width at the aperture ends of said metallization layers and said tapered slot forming a slot line having a slot line width narrower than the aperture width between the base ends of said metallization layers, the base end of said first metallization layer being connected to a metallization patch on said one of said first and second surfaces of said dielectric substrate, said patch being electrically connected to said ground layer, and the base end of said second metallization layer being electrically connected to the strip conductor feed.

The antenna structure may include a suspended microstrip line or an inverted suspended microstrip line wherein the back surface of said ground layer is spaced from the dielectric substrate such that a gap is formed between the second surface of said dielectric substrate and said ground layer, said gap containing a low dielectric constant. Preferably, the low dielectric material comprises air. For the suspended microstrip line, said strip conductor feed and said first and second metallization layers run along the first surface of said dielectric substrate, and said patch is electrically connected through said dielectric substrate to said ground layer. For the inverted suspended microstrip line, said strip conductor feed and said first and second metallization layers run along the second surface of said dielectric substrate.

The antenna structure may also include a basic microstrip line in which the back surface of said ground layer is disposed directly against the second surface of said dielectric substrate, said strip conductor feed and said first and second metallization layers run along the first surface of said dielectric substrate, and said patch is electrically connected through said dielectric substrate to said ground layer.

Further objects and advantages of the invention will appear from the following description, taken together with the accompanying drawings.

BRIEF DESCRIPTION OF THE DRAWINGS

In the drawings which illustrate, by way of example, preferred embodiments of the invention:

FIGS. 23 and 24 illustrate another embodiment of the present invention in which a tapered slot antenna structure has radiating elements which are orthogonal to a printed transmission line having a feed slot in its ground layer;

FIG. 25 shows a general, alternate shape for the ground layer slot of FIGS. 23 and 24;

FIGS. 34A–34F show co- and cross-polarization patterns in the E-plane at various frequencies for the 4×4 array of FIGS. 27A–27C;

FIGS. 35A–35F show co- and cross-polarization patterns in the H-plane at various frequencies for the 4×4 array of FIGS. 27A–27C;

FIGS. 38A–38L show co- and cross-polarization patterns in the E-plane at various frequencies for the 16×16 array of FIGS. 37A–37D;

FIGS. 39A–39L show co- and cross-polarization patterns in the H-plane at various frequencies for the 16×16 array of FIGS. 37A–37D;

DETAILED DESCRIPTION OF THE INVENTION

Figure 1B:
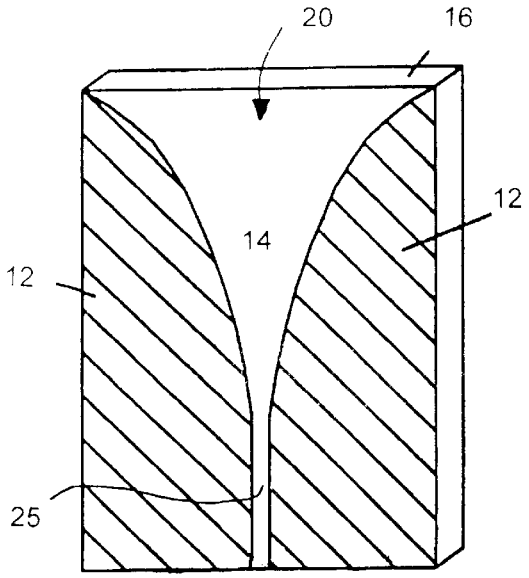
FIGURE 1B PRIOR ART
FIG. 1B illustrates a Vivaldi or exponentially tapered slot antenna element.

Fixed point-to-point wireless communication has rapidly grown over recent years. Several point-to-point and point-to-multipoint communication systems have been developed in the millimeter and sub-millimeter wave bands. For instance, data transmission between a PCS (Personal Communication Services) base station requires a 38 GHz point-to-point communication system. The LMDS (Local Multipoint Distribution Service) which provides interactive video and high speed data access along with broadcast and telephony information requires a 28 GHz point-to-multipoint communication system. Similarly a WLN (Wireless Local Network), such as for cellular telephones, also requires either a point-to-point or a point-to-multipoint communication system. In particular, the commercial frequency bands from 17.7 GHz to 19.7 GHz and from 21.4 GHz to 23.6 GHz are commonly used for point-to-point communication systems.

The use of planar or flat panel integrated antennas has steadily increased over the past few years in the microwave frequency band, and the popularity of flat panel antennas is similarly expected to rise in millimeter wave communication. Antenna structures can generally be divided into two main categories: travelling wave and resonant. Resonant antenna structures, such as dipole or microstrip patch antennas, are planar devices which are printed on a dielectric substrate. Resonant antennas are generally cost effective, of small size and profile, conformable with existing structures, and able to be fabricated and integrated with active devices. However, resonant antennas inherently provide for a relatively narrow operational bandwidth. Despite attempts to broaden the operational frequency bands of such devices, for example by stacking several resonant antenna structures together, the resulting bandwidth of these structures is still quite limited. Resonant antennas are therefore unsuitable for applications requiring wide band capability, such as the communication systems mentioned above. Resonant antennas also exhibit a large beam width (i.e. the angular distance between radiated points of half power intensity) or, equivalently, a low antenna directive gain. This is problematic when high directionality is required in a communication system, i.e. the antenna must radiate or receive electromagnetic signals more effectively in some directions than in others, such as in point-to-point communication.

In travelling wave antennas, where the waves propagate in one direction, it is possible to provide both for improved directionality (i.e. higher antenna gain or smaller beamwidth) and for operation over a much wider band of frequencies. A parabolic reflector antenna is a highly directional (high gain) antenna which includes a parabolic reflector to provide directional characteristics. For these reasons, most point-to-point communication systems currently use parabolic reflector antennas. however, while parabolic antennas typically provide for very wide band communication, they are much larger and thicker than flat panel or planar antenna structures. Since antennas which radiate or receive electromagnetic signals are usually connected to an integrated circuit for that particular application, large antenna structures are undesirable as their size makes it very difficult and cumbersome to integrate both the antenna element and the application circuit on the same substrate, or even to fabricate both parts as integrated components which can be easily connected.

Travelling wave antennas may be either leaky wave or surface wave. The former uses a travelling wave which propagates along an antenna structure with a phase velocity which is greater than c, the speed of light in air (or, to be precise, a vacuum) which is approximately $3\times10^8$ meters per second. These antennas produce a main beam in a direction other than the "end-fire" direction and are not suitable for point-to-point communication. Surface wave antennas, on the other hand, use a travelling wave structure (such as a dielectric on a ground plane or a periodic structure) for which the phase velocity of the travelling wave is less than or equal to c. Surface wave antennas therefore produce (or receive) endfire radiation, and so can be used in point-to-point communication systems.

Tapered Slot Antennas

Flat panel or printed travelling wave antennas typically consist of one or more narrow end-firing tapered slots formed or etched within a thin, electrically conductive metallization layer. Although the description which follows below is generally given in connection with radiating antenna elements, the description equally applies to receiving antennas with similar characteristics.

Figure 1D:
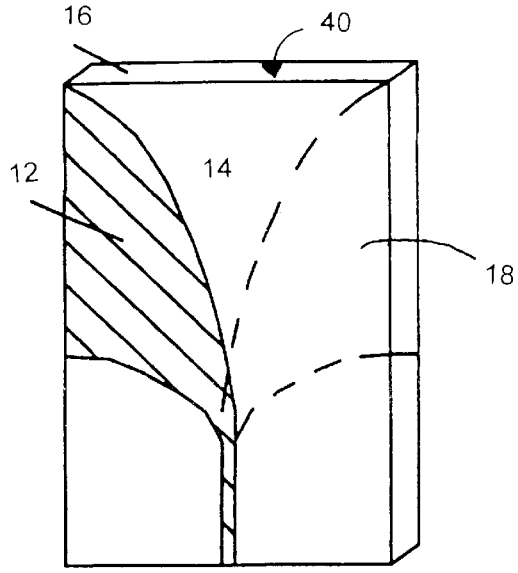
FIGURE 1D PRIOR ART
FIG. 1D illustrates an antipodal Vivaldi tapered slot antenna element.
Figure 1A:
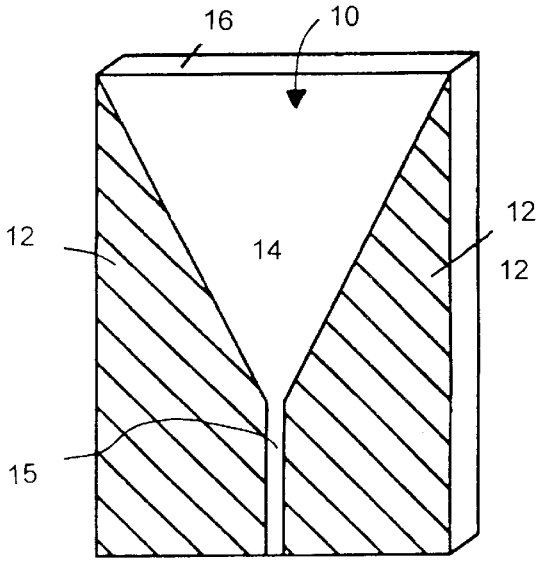
FIGURE 1A PRIOR ART
FIG. 1A illustrates a linear tapered slot antenna element.
Figure 1C:
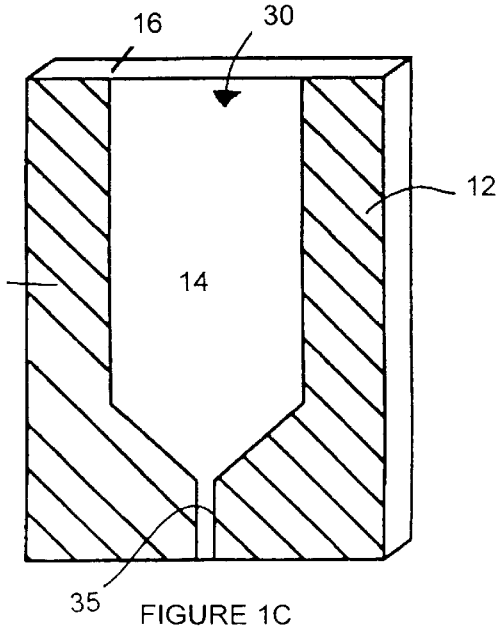
FIGURE 1C PRIOR ART
FIG. 1C illustrates a constant width tapered slot antenna element.

Metallization layers may be bonded to one or both sides of a dielectric substrate. (Note that while the term metallization is used throughout the description, this term is intended to embrace any suitable electrically conductive material, for example carbon or carbon-impregnated plastic.) In most cases, the desired slot is etched within the metal surface on a single side of the dielectric, as illustrated in FIGS. 1A, 1B, and 1C which show slots 10, 20, and 30 formed between metallization 12 on a single side 14 of a dielectric substrate 16. In the alternative, a planar slot may simply consist of an air gap between thin metallic plates (not shown), similar to FIGS. 1A–1C except that the dielectric in this case would simply be air. As shown in FIG. 1D, a non-planar or antipodal slot 40 may also be formed by a metallization layer 12 on a first side 14 of a dielectric 16 and a metallization layer 18, indicated by the dashed lines in FIG. 1D, on an opposite side of the dielectric 16. Non-planar slot elements are, however, much less suitable for integration with other microwave components, and they also result in significant cross-polarization effects between antenna elements when assembled in array configurations. The present invention is therefore restricted to planar slot antenna elements.

The three most common slot configurations for planar or flat panel end-fire travelling wave antennas are illustrated in: FIG. 1A which shows a linearly tapering (V-shaped) slot 10; FIG. 1B which shows a Vivaldi (exponentially tapering) slot 20; and FIG. 1C which shows a constant width slot 30 in which the primary radiating portion of the slot has a constant width. The tapered slot antenna elements are proportionally wider at their outer or end-fire ends (typically this width is at least one-half wavelength at the minimum operating frequency), and they taper inwardly such that the slot eventually becomes very narrow, forming slotlines 15, 25, and 35 in FIGS. 1A, 1B, and 1C respectively. These slot lines at the base of the tapered slots permit coupling to a coaxial transmission line, microstrip line, or waveguide. In this manner, the travelling wave propagating along the slot of a radiating antenna (at a phase velocity which is less than the speed of light) gradually radiates in the end-fire or outward direction.

One of the principal advantages of tapered slot antennas is that they can be easily fabricated using standard integrated circuit lithography techniques and conveniently integrated in hybrid or microwave integrated circuits with receiver or transmitter electrical components. A general constraint applicable to all tapered slot antennas is that the width of the slots should reach at least one-half of the wavelength at the lowest frequency of desired operation. The antennas also exhibit high directivity or gain for a given cross section by virtue of their travelling wave nature. Another significant advantage of tapered slot antennas is that they are capable, despite their planar geometry, of producing a symmetric beam in the electric field plane (the E-plane) which is parallel to the substrate or slot plane and the magnetic field plane (the H-plane) which is perpendicular to the substrate, when appropriate dimensions and parameters for the slot shape, slot length, dielectric thickness, and dielectric constant are chosen: see Yngvesson et al., "Endfire Tapered Slot Antennas on Dielectric Substrates", *IEEE Transactions on Antennas and Propagation*, vol. AP-33, no. 12 (December, 1985) and Janaswamy et al., "Analysis of the transverse electromagnetic mode linearly tapered slot antenna", *Radio Science*, vol. 21, no. 5, pp. 797–804 (September–October 1986), and Yngvesson et al., "The Tapered Slot Antenna—A new Integrated Element for Millimeter-Wave Applications", *IEEE Transactions on Microwave Theory and Techniques*, vol. 37, no. 2 (February 1989); the contents of each being incorporated herein by reference. Other desired radiation characteristics including beamwidth variation can also be obtained by varying the above parameters and dimensions.

Tapered Slot Antenna Feeds

Tapered slot antenna elements are typically fed by or connected to a microwave frequency integrated circuit (i.e. a monolithic microwave IC or MMIC). This is generally accomplished by either a finline-waveguide transition or a printed transmission line. The finline technique is illustrated in FIG. 2A where a tapered slot antenna element 50 (shown as a linear tapered slot) narrows to a slot line 55 as it enters a waveguide mount or block 60 (shown to be rectangular). Inside the mount 60, a finline taper 62 emerges from the other end of the slot line 55 and matches to the waveguide which feeds the antenna. Although, FIG. 2A shows a linear or V-shaped finline 62, other finline shapes, such as exponential or constant width, can also be used. Finline feeding techniques are no longer very common because of the strong preference for having an antenna feed mechanism which is integrated with the antenna structure.

The most common form of printed transmission line for feeding a tapered slot antenna element is a microstrip line, the microwave equivalent to a two wire transmission line. A microstrip line is a controlled impedance transmission line which has one or more conductive metal traces or strips on one side of a dielectric (printed circuit board or PCB) substrate with a conductive ground plate bonded to the other side of the substrate. In the prior art, when feeding a tapered slot antenna element, the metallization layer within which the tapered slot is etched or formed typically becomes the ground of the microstrip line. For planar taper slot antennas, the microstrip line is an unbalanced line because the conducting strip and the ground plane are of different dimensions and shapes, i.e. non-symmetrical, Since the top conductor and the bottom conductor are not coupled to the antenna in the same way, the current flowing in the antenna is unbalanced. (Note that balanced microstrip lines can be realized for feeding antipodal or non-planar tapered slot antennas.)

Figure 2B:
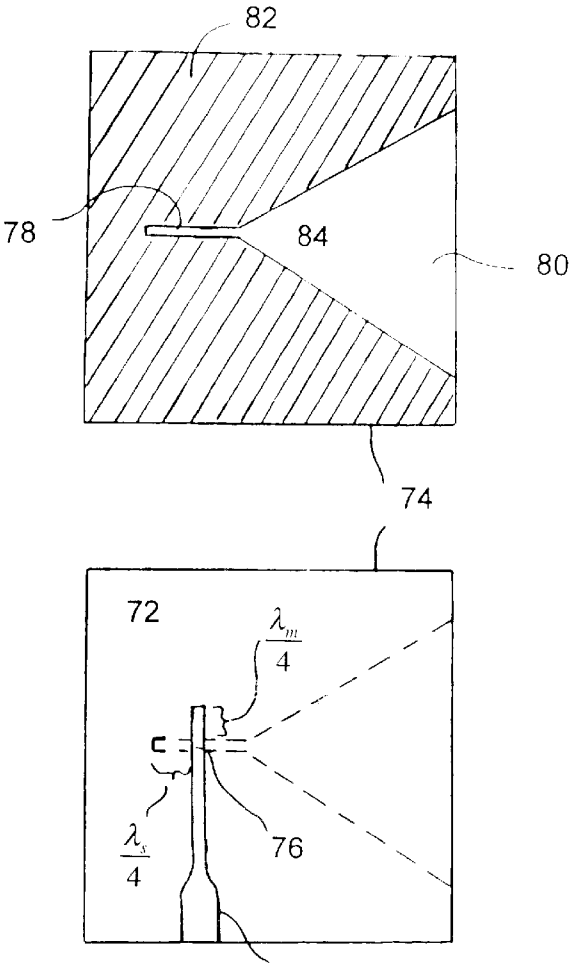
FIGURE 2B PRIOR ART
FIGS. 2A and 2B illustrate the prior art finline and microstrip line techniques for feeding tapered slot antenna elements.
Figure 2A:
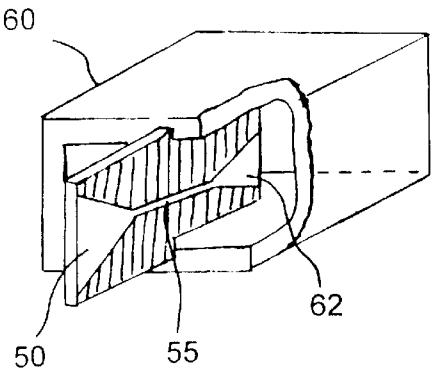
FIGURE 2A PRIOR ART

A conventional or basic microstrip line feeding arrangement is shown in FIG. 2B, wherein a microstrip line 70 on one main face 72 of a dielectric substrate 74 crosses over (at 76) the slot line 78 of the planar slot antenna 80 etched within the metallization layer 82 on the other face or side 84 of the substrate 74. The slot line 78 extends beyond the microstrip line 70 by a distance $\frac{1}{4}\lambda_s$, where $\lambda_s$ is the wavelength in the slot line at the centre operating frequency of the antenna. The microstrip line 70 extends beyond the slot line 78 by a distance $\frac{1}{4}\lambda_m$, where $\lambda_m$ is the wavelength in the microstrip line at the centre operating frequency of the antenna. The metallization layer 82 forms the ground the of the microstrip line. The microstrip line 70 is open circuited and the slot line 78 is shorted by simple terminations, as shown in FIG. 2B. It is also possible, for the slot line 78 to terminate in an open circuit, for example by adding a relatively large circular patch at the end of the slot line, and for the microstrip line 70 to be shorted by means of a via which runs through the substrate to the ground metallization layer 82. In either case, a balun is created at the crossover 76 which matches the unbalanced microstrip line 70 to the balanced slot line 78 of the antenna element and permits transmission from the microstrip transmission line 70 to the slot line 78 (for feeding the antenna). In this manner, the microstrip line 70 and slot line 78 are electromagnetically coupled, with one line radiating and one line receiving electromagnetic energy. In general, the stronger the electromagnetic coupling, the better the transition. Generally, the microstrip line 70 is also coupled, at the edge of the substrate, to a connector (not shown) for a further transmission line such as a coaxial cable or waveguide.

Other types of printed microwave transmission lines can also be used to connect an antenna element to a MMIC. For instance, a coplanar waveguide (not shown), instead of a microstrip line, can be etched on to the opposite side of the dielectric as the tapered slot antenna. The finite ground plane of the coplanar waveguide can be connected to the antenna ground plane metallization through via holes to provide impedance match and odd mode operation. A via is a plated through-hole interconnect from the metallized ground layer on the lower surface to a metallized layer on the top of the substrate. Vias usually must be drilled or etched through the substrate chemically and then subsequently plated with a conductive metal to form the conductive path. Power is coupled to the antenna through a center conductor of the coplanar waveguide which extends to form a crossover with the antenna slot line. This and other coplanar waveguide feeding techniques are discussed in detail in Lee et al., "Linearly Tapered Slot Antenna and Feed Networks", Antenna Application Symposium, Cleveland, Ohio (1994), the contents of which are incorporated herein by reference.

A major problem with these prior art techniques for feeding a tapered slot antenna element, in particular the microstrip line, is that the bandwidth of the antennas is limited by the transition between the feed—i.e. the microstrip line, coplanar waveguide, or finline—and the antenna slot. The return loss is the ratio, in dB, of the power reflected from a discontinuity in a transmission system to the power incident upon that discontinuity. Maintaining the return loss associated with the feed to slot line transition of an antenna element below about −10 dB for the entire bandwidth of the antenna is generally a requirement for achieving good wide band antenna operation.

Typical linearly tapering slot antennas have an input impedance which is substantially independent of frequency over the bandwidth of the antenna, as discussed in Yngvesson et al., "The Tapered Slot Antenna—A new Integrated Element for Millimeter-Wave Applications", supra. With prior art feeding techniques for planar slot antennas it is often difficult to design a slot line feed of a shape and dimension capable of maintaining a match to a specific input impedance (for example the 50 Ω line impedance of a microstrip line) over the entire bandwidth of the antenna. As a result, an impedance mismatch may occur for at least some frequencies within the antenna bandwidth. This results in wave reflections at the slotline transition which, in turn, increase the return loss and degrade the performance of the antenna. This degradation is heightened when the dielectric constant of the antenna substrate is low.

The feed bandwidth can be increased by changing the geometry of the microstrip and slot lines, for example by having them bend and/or curve (as was done in U.S. Pat. No. 5,036,335 to Jairam) and by carefully choosing the shape of the opening in the microstrip ground at the end of the antenna slot line. This provides a broader impedance match between the slot line and the strip line, but still typically provides only a limited ability to optimize the return loss of the antenna over a wide bandwidth, and hence to provide proper wide band operation in different frequency bands.

In addition, the microstrip to slot line feed transition also usually exhibits a very high loss in the millimeter wave band. For example, even a well designed 50 Ω microstrip line on a 5 mil (1 mil =0.001 inches or about 0.0254 mm) substrate has been found to have the attenuation coefficients shown in Table I:

TABLE I

| Dielectric Substrate | Attenuation Coefficient (AC) |
|---|---|
| Duriod | 0.12 dB/λ |
| Quartz | 0.14 dB/λ |
| Alumina | 0.28 dB/λ |

The attenuation coefficient is the fraction of the electromagnetic energy, expressed in dB, that is absorbed or scattered (i.e. lost) when the wave travels a distance equal to a wavelength k along the transmission line. As a result, a large feed network consisting of microstrip lines is not suitable for large phased array antenna applications in the millimeter wave band. Also, while coplanar waveguide to slot line transitions generally offer a wider bandwidth of impedance matching, the requirement of via holes or air bridges further make these feed techniques inappropriate for large antenna array applications because they are very difficult and complex to fabricate.

Antenna Arrays

Increasingly, wireless communications antenna devices consist of arrays of printed antenna elements. In some limited cases, the array elements consist of phased tapered slot antennas (by varying the phase relationships of the signals feeding each array element, a phase array antenna has the capacity to provide for very rapid reconfiguration of and considerable versatility in its radiation characteristics). As the slots of a single tapered slot antenna element are made longer, the gain of the antenna increases, the directionality of the antenna improves, and any interference or cross-talk between slot elements is reduced. However, this occurs at the very significant expense of an increase in the size (thickness) or profile of the antenna element, which in most applications is preferably kept to a minimum. Antenna array configurations can provide good transmission characteristics while still maintaining a low overall structure profile.

A linear array can be formed by placing a number of suitably oriented slot antennas periodically along a waveguide transmission line. The slots radiate power from the incident waveguide mode which may then be reflected by a terminal short circuit to create a narrow-band resonant array. Alternatively, if the residue of the incident wave is absorbed by an impedance matched load, then the array generates a broadband travelling wave. If the power radiated by the slot elements has a shaped distribution across the array, then the sidelobes can be reduced. (Low sidelobes help ensure that different sets of communicating antennas do not interfere with one another, and sidelobes levels are usually governed by a communication protocol, such as the United States Federal Communications Commission (FCC) category "A" specifications. See generally FCC 96-80, Notice of Proposed Rule Making, and FCC 97-1, Report and Order.) Waveguide slot arrays provide much better antenna efficiency than printed antenna arrays because waveguides (such as the WR42 or the WR28 waveguides) exhibit much lower transmission loss than printed transmission lines. However, waveguide slot arrays are costly, and despite the fact that the waveguides are quite small, the final array thickness and profile is typically quite large when the array and waveguide is shaped to achieve low sidelobe levels.

Periodic dielectric antenna arrays consist of a uniform dielectric waveguide with a periodic surface perturbation. The uniform waveguide supports a travelling wave, and the surface perturbation acts as a grating that radiates the guided energy. In this manner, tapered slot antenna elements can be combined into one or two dimensional linear antenna arrays (or beam antennas). These arrays may be used to provide a sharp focus and high gain without requiring an increase in the size and profile of the antenna array (i.e. the lengths of the slots in the array). In some applications, a tapered slot antenna array may be used as a focal plane array in conjunction with a reflector or a lens focusing element. The slot antenna elements may also be independently energizable to provide variable radiation patterns.

Figure 3:
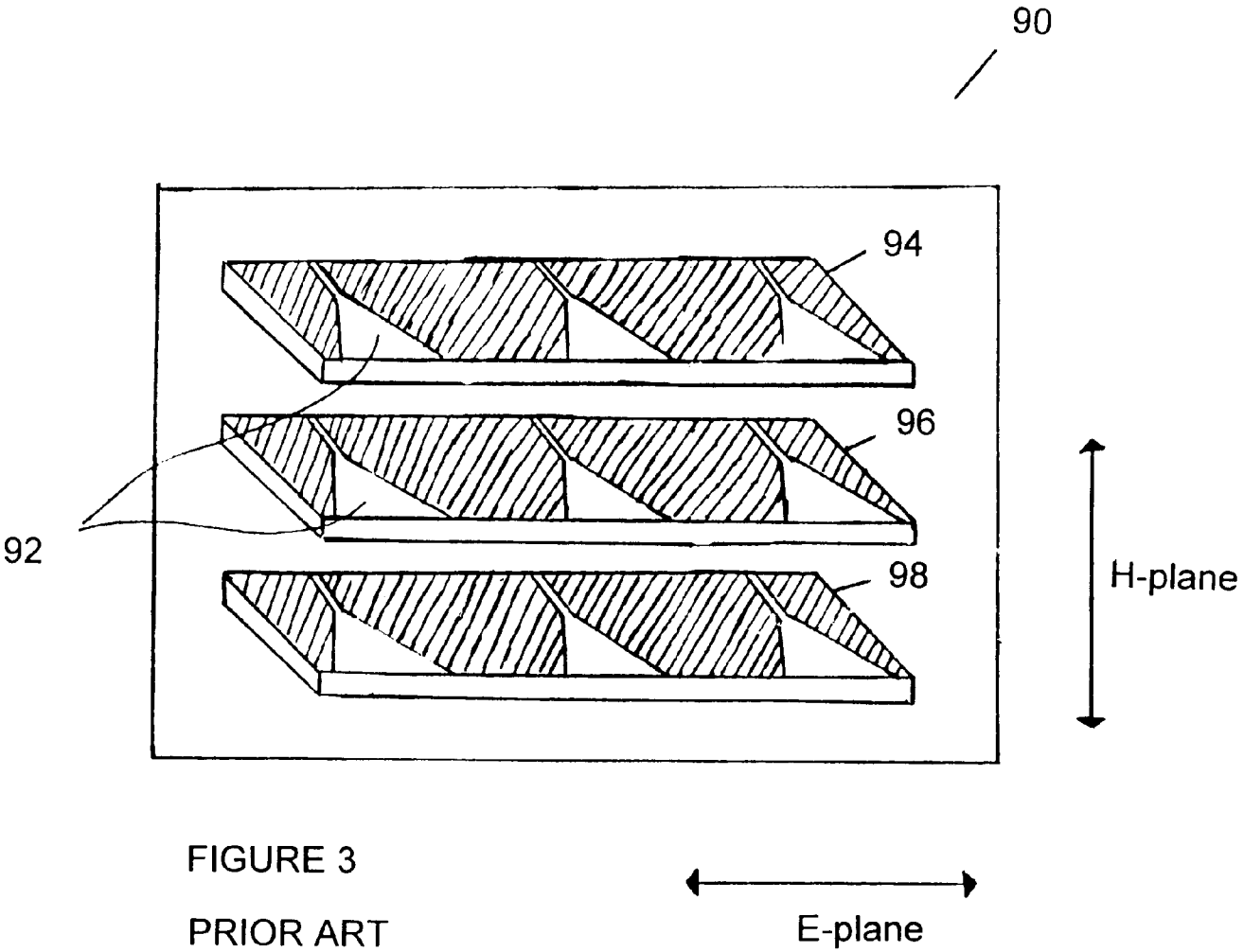
FIGURE 3 PRIOR ART
FIG. 3 shows a general two dimensional array of tapered slot antenna elements.

An exemplary two dimensional 3×3 array 90 of linearly tapered slot antenna elements 92 is shown in FIG. 3. As shown in FIG. 3, each of three one dimensional arrays 94, 96, and 98 of antenna elements share a common sheet of dielectric substrate. The linear E-plane and H-plane polarizations (i.e. the desired or co-polarizations) for an endfiring antenna array which radiates a transverse electromagnetic (TEM) mode wave are also shown in FIG. 3. In practice, mutual coupling or cross-talk between antenna elements will result in undesirable cross-polarization effects. The rows 94, 96, and 98 of antenna elements may be referred to as E-plane arrays or sub-arrays; while the columns of antenna elements (e.g. the first element in each of the rows 94, 96, and 98) may be referred to as H-plane arrays or sub-arrays. Although the taper slot antenna arrays provide for better gain and directionality than single antenna elements on their own, as the array size increases it becomes more and more difficult to feed the antennas in the array, as discussed below.

Figure 4:
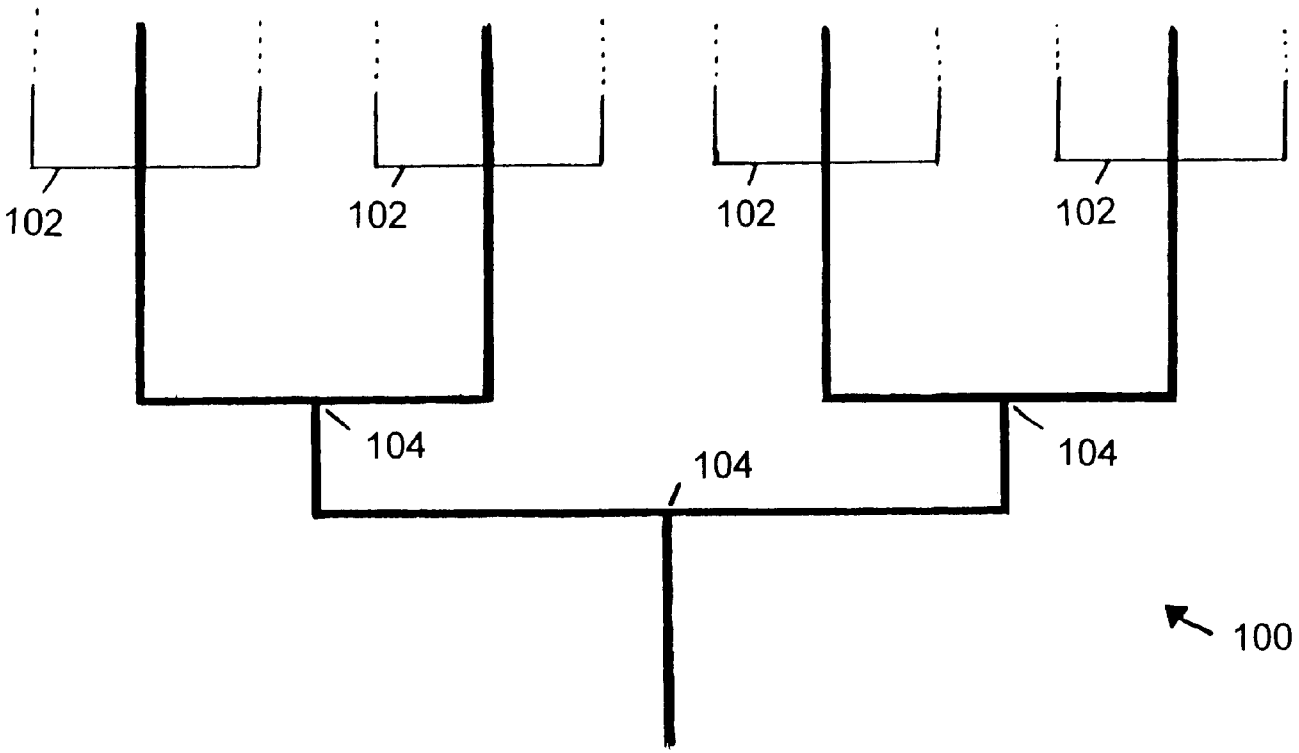
FIGURE 4 PRIOR ART
FIG. 4 shows the general layout of a parallel beam forming network (BFN) for feeding an array of antenna elements.

A simple technique for feeding a linear antenna array is to use a parallel beam forming network (BFN) which supplies excitation to each array element individually. Referring to FIG. 4, a parallel BFN consisting of a binary printed transmission line network 100 uses equal line lengths and power dividers 104 to feed each element 102 in a 1×4 array. The BFN is commonly made up of strip conductor lines, for example in a microstrip line. Because of the symmetry, a parallel fed array exhibits a good beam pattern and gain bandwidth. The impedance bandwidth of the overall array is approximately limited to that of a single radiating element. Also, the transmission loss in a parallel feed network is generally higher than for a series network feeding the same elements, since the parallel network requires longer transmission lines.

To reduce transmission line loss, a combined multi-stage feed network may be used. As already mentioned, a waveguide has a significantly lower transmission loss than a printed transmission line conductor. However, while a waveguide BFN can be designed to provide wideband operation, such waveguides are usually very difficult and expensive to fabricate, since special manufacturing techniques are required. Furthermore, waveguide BFNs typically have a larger size or profile than printed transmission lines, and it is very difficult to use a waveguide BFN in an array in which the antenna elements are tightly spaced. Thus, one possible multi-stage feed network could use a waveguide to feed sub-arrays in an array (for example each E-plane sub-array in the array), and within each sub-array a printed transmission line could then be used to feed each antenna element. In this combined feed structure, a good waveguide to printed line transition is required and the transitions in each of the sub-arrays should be consistent. Another example of a combined feed technique could use a series and a parallel feed network to reduce the overall length of transmission line, and hence of transmission line loss. Furthermore, a two dimensional antenna array with both E-plane and H-plane sub-arrays may have both an E-plane BFN for each E-plane sub-array and an H-plane BFN which lies orthogonal to and feeds, via an appropriate transition, each of the E-plane BFNs. The H-plane BFN generally lies in a plane which is perpendicular to both the E-plane and the H-plane of the array.

The Suspended and The Inverted Suspended Microstrip Lines

The present invention may use two modified microstrip line structures for feeding a tapered slot antenna element. These modified structures provide a good impedance match and a low reflection loss over a wide operating frequency range, and thus permit exploitation of the wide band potential of the slot antenna.

Figure 5:
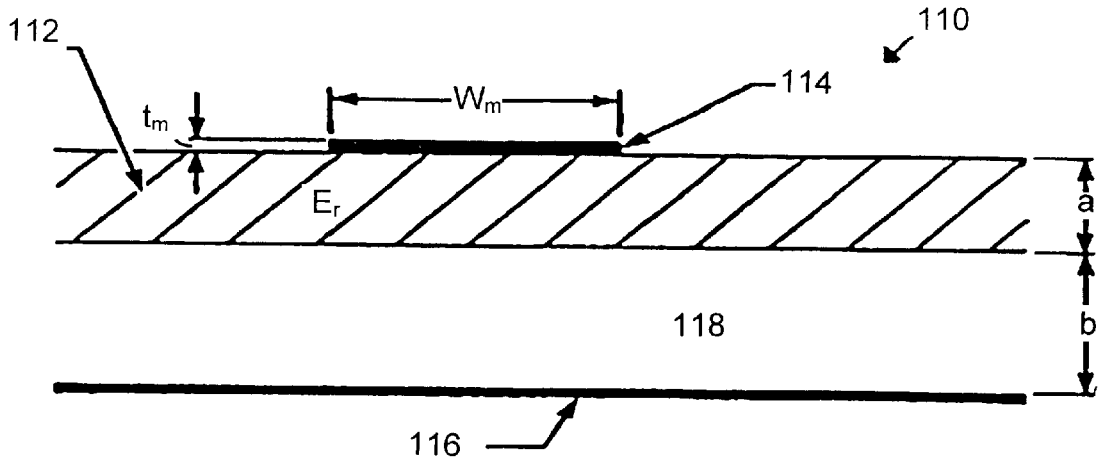
FIG. 5 shows a suspended microstrip line (SML) structure for feeding a tapered slot antenna element according to the present invention.
Figure 6:
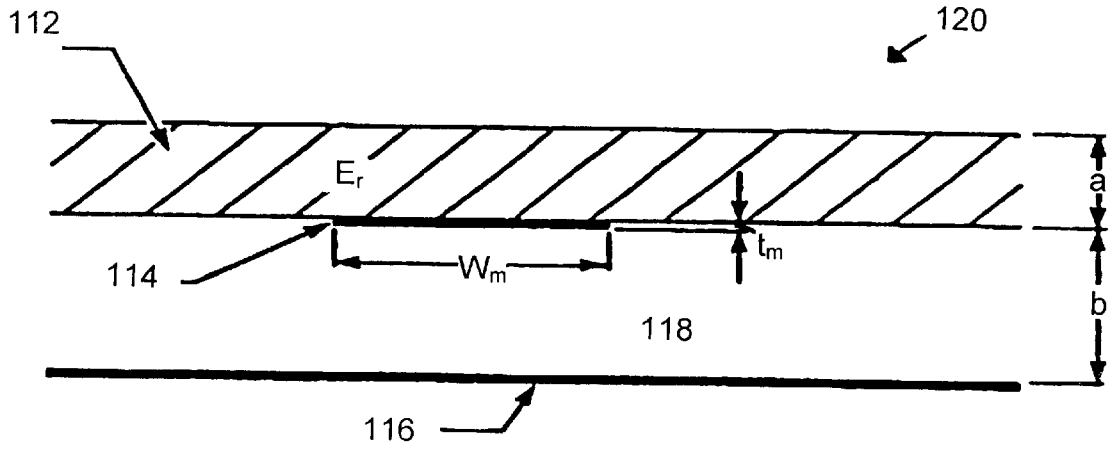
FIG. 6 shows an inverted suspended microstrip line (ISML) structure for feeding a tapered slot antenna element according to the present invention.

FIG. 5 shows the suspended microstrip line (SML) 110 and FIG. 6 shows the inverted suspended microstrip line (ISML) 120 according to the present invention. Similar to the standard microstrip line, the SML 110 includes a dielectric substrate or slab 112, a microstrip or strip conductor 114 running along a surface of the substrate 112, and a ground conductor plane 116. However, unlike the standard microstrip line (see FIG. 2B), the SML 110 includes an air gap 118 between the opposite face of the substrate 112 to which the microstrip is on and the ground conductor plane 116. The ISML 120 also includes an air gap 118 between the substrate 112 and the ground conductor plane 116, but in the ISML 120 the microstrip 114 is on the opposite side of the substrate 112 (i.e the side which faces the ground plane 116), as shown in FIG. 6. As indicated in FIGS. 5 and 6, the dimensions and parameters of the SML and ISML are referenced as follows: a is the thickness of the dielectric substrate 112, b is the thickness of the air gap 118, $t_m$ is the thickness of the microstrip 114, $W_m$ is the width of the microstrip 114, and $\epsilon_r$ is the dielectric constant or permittivity of the substrate 112.

Unlike the standard microstrip line, the electromagnetic fields in these modified microstrip structures are no longer primarily confined to within the dielectric substrate or slab. Because a greater portion of the field exists in the air for the SML and ISML, wave dispersion or scatter (attenuation) is less pronounced, and so these structures have a lower transmission loss and a higher Q-factor than the microstrip line. In addition, a broader transmission line width can be used with the SML and ISML structures for a given characteristic impedance. This is advantageous since the photo etching process becomes more difficult, and at a certain point will not work, when strip lines are too thin. Moreover, the quasi-TEM mode propagation along the lines is more pronounced than for the standard or basic microstrip line. Like the prior art microstrip line, the dimension tolerances and the quality of the metallic surface finish are much less critical for the SML and ISML than for waveguide structures. While the SML and ISML are under increased electrostatic stress and therefore somewhat more susceptible to substrate breakdown than the standard microstrip line, in any printed antenna, steps are normally taken to ensure that the antenna is grounded to counteract large DC static voltages. As a result, the potential for breakdown in the SML or ISML is not a serious concern.

Note that it is possible to use another dielectric material of low permittivity (i.e. low dielectric constant) in place of the air gap 118 in the SML 110 of FIG. 5 and the ISML 120 of FIG. 6. For example, a foam layer could be used in place of the air gap 118. However, an air-filled gap is preferable because of the simplicity of structure, low cost, and minimal loss.

Figure 7B:
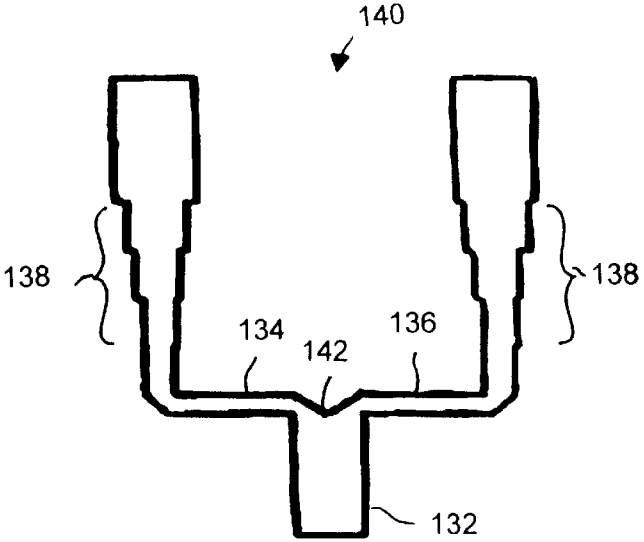
FIGS. 7A and 7B show T-junction phase splitters which may be used in a parallel BFN for feeding an antenna array.
Figure 7A:
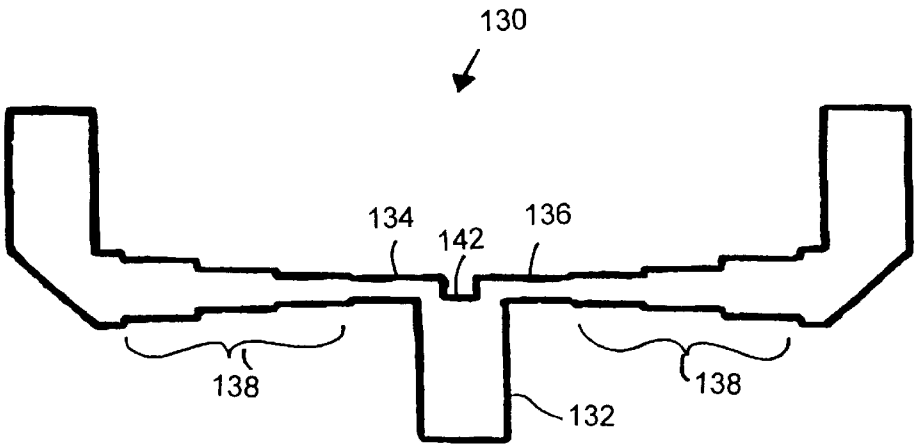

As mentioned above, because the transmission loss in a parallel feed network in a standard microstrip line is quite high, large parallel feed networks based on those structures are not suitable for feeding an antenna array in the millimeter wave bands. However, with the SML or the ISML the transmission line loss is reduced. The ability to use only or predominantly a parallel feed network with the SML or ISML is highly advantageous because of its simplicity and also because a parallel feed network has a very wide band characteristic. Indeed, when an array is fed by a parallel feed network, the bandwidth of the overall structure is generally limited by the antenna elements (and not by the feed network). Nonetheless, a parallel BFN must be appropriately designed to ensure proper power distribution to each antenna element FIGS. 7A and 7B show two examples 130 and 140 of wide band non-isolating power splitters formed from a T-junction for use in a parallel BFN network. Each of the junctions has an input branch 132 with line impedance $Z_{in}$, a first output branch 134 with line impedance $Z_{out1}$, and a second output branch 136 with line impedance $Z_{out2}$. The design of the power splitter requires that:

$$\frac{1}{Z_{in}} = \frac{1}{Z_{out1}} + \frac{1}{Z_{out2}}$$

For equal or uniform power splitting:

$$Z_{out1}=Z_{out2}=2Z_{in}$$

and in general the ratio between the power $P_{out1}$ delivered to the first output branch 134 and the power $P_{out2}$ delivered to the second output branch 136 is given as:

$$\frac{P_{out1}}{P_{out2}} = \frac{Z_{out2}}{Z_{out1}}$$

Thus, once the input branch line impedance $Z_{in}$ is known, one can determine $Z_{out1}$, and $Z_{out2}$ for a given power distribution. By varying the power distribution in the power splitters of a parallel BFN, various beam patterns can be obtained. If the line impedance values ($Z_{in}$, $Z_{out1}$ and $Z_{out2}$) are known, the width, $W_m$, of the line conductor can be determined once the parameters a, b, and $\epsilon_r$ of the SML or ISML have been chosen. Usually, for 0.5 oz and 1.0 oz copper deposited on a dielectric printed circuit board, the copper thickness, t in FIGS. 5 and 6, is 0.7 mil and 1.4 mil respectively (recall that 1 mil=0.001 inches or about 0.0254 mm). Typical impedance values for the T-junctions in FIGS. 7A and 7B are $Z_{in}$=50 Ω and $Z_{out1}=Z_{out2}$=100Ω. For an equal power splitter in an ISML with a=8 mil, b=20 mil, and $\epsilon_r$=3.38, the width of the input branch 132 would be 104 mil and the width of the output branches 134 and 136 would be about 32mil.

Since several power splitting steps will be necessary for feeding any sizable array with a parallel BFN, it is usually necessary to use impedance transformers after at least some of the power splitters to avoid having the line impedance of branches becoming too large (and hence avoid the width of these lines becoming too thin). In FIGS. 7A and 7B, three stage Chebyshev transformers 138 are used to transform the line impedance of the output branches 134 and 136 to the line impedance of the input branch 132. Each stage in the Chebyshev transformer 138 is of length ¼$\lambda_0$, where $\lambda_0$ is the wavelength at the centre frequency of the operating bandwidth. With $Z_{in}$=50 Ω and $Z_{out1}=Z_{out2}$=100 Ω (with the ISML parameters given above), the first stage in the Chebyshev transformer 138 has a line impedance of 87 Ω and a width of about 40 mil, the second stage has a line impedance of 70 Ω and a width of about 56 mil, and the third stage has a line impedance of 57 Ω and a width of about 80 mil. Chebyshev transformer design is discussed in Pozar, *Microwave Engineering*, 1*st* Ed., Addison-Wesley, Reading, Mass. (1990) the contents of which are incorporated herein by reference. Transformers having a different number of stages (e.g., 2 or 4) can also be designed, although the complexity of the BFN layout will increase with the number of transformer stages.

Furthermore, to obtain an optimum bandwidth and an equal phase in each output branch of the power splitters in FIGS. 7A and 7B, the shape of a notch 142 at the centre of the splitter should also be optimized. These optimizations can be performed with a full wave numerical modelling tool, such as the IE3D software tool available from Zeland, Software, Inc. As discussed below, these and other simulations can also be performed, or further optimized, by a Finite Difference Time Domain (FDTD) simulator tool. For the ISML characteristics given above (i.e. a=8 mil, b=20 mil, and $\epsilon_r$=3.38), the shape of the notch 142 shown in FIG. 7B was determined to provide wide band and equal phase power splitting performance.

Tapered Slot Antenna With Basic Sml Feed

Figure 8A:
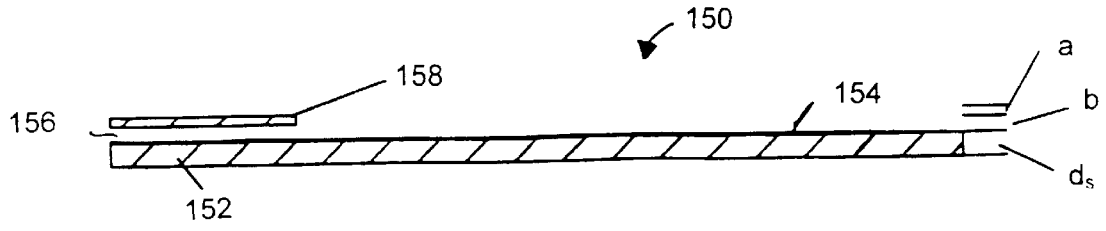
FIGS. 8A–8C show a basic SML fed tapered slot antenna structure according to the present invention.
Figure 8B:
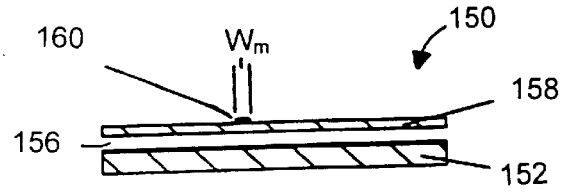

FIG. 8A shows a tapered slot antenna structure 150 which is fed by a suspended microstrip line (SML). The antenna structure 150 includes an antenna dielectric layer 152 of permittivity $\epsilon_{rs}$ and having a metallization layer 154, such as copper, on one of its faces. The slab or substrate 152 and metallization layer 154 together have a thickness $d_s$ (although the metallization layer 154 is very thin in comparison to the dielectric layer 152). Above the metallized face of the dielectric slab 152 is an air gap 156, of thickness b, which separates the slab 152 from a SML dielectric substrate layer 158 of permittivity $\epsilon_{rm}$. The conductor microstrip line 160 runs along the face of the substrate 158 which is on the side opposite the air gap 156, as shown in FIG. 8A. The SML dielectric substrate layer 158 is of thickness a, and the width of the microstrip line 60 which feeds the antenna element is $W_m$ (which for a 100 Ω line would be about 32 mil). FIG. 8B shows a view of the antenna structure 150 rotated by 90°.

Both dielectric material layers 152 and 158 may be glass fiber epoxy laminate FR4 (Fire Retardant 4). However, the SML substrate dielectric layer 158 preferably consists of the RO4003™ or RO4350™ material available from Rogers Corporation. These dielectric materials are inexpensive and low loss PCB laminate materials well suitable for applications in the 2–20 GHz range.

Figure 8C:
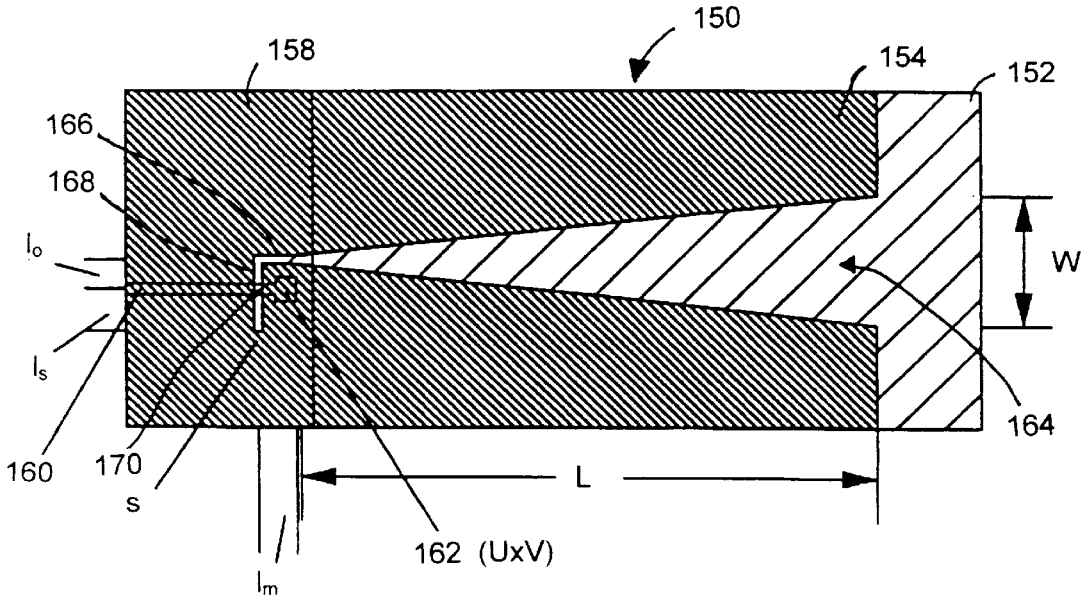

FIG. 8C shows a top overlay view of the antenna structure 150 of the substrate 152 and metallization layer 154. Referring to FIG. 8C, the dimensions of the tapered slot 164 (shown as a linearly tapered slot) are essentially determined by the length of the slot, L, and the aperture or end-firing end width, W. As the wavelength of radiated energy reaches approximately twice the aperture width, i.e. 2W, the antenna begins to cease acting as a broad band travelling wave antenna. Thus, a cut-off wavelength $\lambda_c$ for the antenna can be defined by:

$$\lambda_c = 2W$$

For a wide band travelling wave antenna, the minimum operating frequency should have a wavelength $\leqq \lambda_c$. Typically, a high gain antenna may have a centre operating frequency wavelength, $\lambda_0$, which is at least three times less than $$\lambda_c \left(\text{i.e. } \lambda_0 \leq \frac{1}{3}\lambda_c\right),$$

and so $$W \geqq 1.5\lambda_0$$

As the tapered slot 164 is a linearly tapering slot, it narrows throughout its length L and thereafter forms a slot line which consists of a portion 166 colinear to the center line of slot 164 and a portion 168 perpendicular to the center line of slot 164. The width of both slot line portions is referenced as s. The strip conductor 160 of the SML extends along the distant surface of the substrate 158 in a direction which is parallel to but offset from the center line of the slot 164, such that it intersects at 170 with the slot line portion 168, as shown in FIG. 8C. The strip line 160 extends beyond the intersection 170 and terminates in a patch 162 which, as shown, may be rectangular and of size u×v. As will be clear to those skilled in the art, other shaped patches, such as circular patches, may also be used. The strip line and slot line are electromagnetically coupled via the intersection 170 as they are mutually affected by the same EM fields. The location of the intersection can be physically defined by the three parameters shown in FIG. 8C: (i) $l_0$ which is the planar distance between the centre of the slot line portion 166 and the centre of the strip line 160; (ii) $l_s$ which is the planar distance between the centre of the strip line 160 and the end of the strip line portion 168; and (iii) $l_m$ the planar distance between the centre of the slot line portion 168 and the end of the strip line 160, including the strip line patch termination 162.

It should be noted that the tapered slot 164 and ground layer 154 could alternatively be etched on the opposite side of substrate 152 than in FIG. 8A. However, in this embodiment, the feed may exhibit greater losses at high frequency (i.e. millimeter waves) because two dielectric substrates (152 as well as 158) separate the conducting layers.

The antenna structure 150 of FIGS. 8A–8C thus has a number of parameters and/or dimensions which can be varied, providing a vast number of possible designs. In addition, it is possible for the dielectric substrate 152 to be omitted and for the slot 164 to simply be formed within a metal sheet or between metal fins, either of which can be of thickness $d_s$. It is also possible for the shape of the tapered slot 164 to be varied, for example to a Vivaldi or a constant width slot, although a linear tapered slot may be preferred because of its simplicity. Furthermore, the shape of the stripline patch termination 162 could be non-rectangular (for example circular) and/or a patch termination could also or alternatively be added at the end of the slot line portion 168.

A research based FDTD three dimensional structural simulator (FDTD 3D SS) was used to design, test, and optimize the dimensions of the antenna structure 150 of FIGS. 8A–8C. The FDTD method is formulated using a central difference discretization of Maxwell's curl equations in four dimensional space-time, including non-uniform orthogonal algorithms. Simulations of this nature will be understood by those skilled in the art and require the setting of appropriate boundary conditions. The FDTD 3D SS is a PC-based user interface produced at McMaster University in Hamilton, Canada under funding by the Telecommunications Research Institute of Ontario (TRIO). Other similar simulation tools may also be used.

Generally, several parameters can be determined or chosen prior to simulation/optimization of the antenna structure 150. For instance,

| | |
|---|---|
| L = | 1700 mil |
| W = | 386 mil |
| $W_m$ = | 32 mil (100 Ω strip line) |
| s = | 24 mil |
| a = | 8 mil |
| b = | 20 mil |
| $d_s$ = | 20 mil |
| $\epsilon_{rm}$ = | 3.38 (RO4003 ™ material) |
| $\epsilon_{rs}$ = | 3.38 (RO4003 ™ material) |

The commercial frequency bands from 17.7 GHz to 19.7 GHz and from 21.4 GHz to 23.6 GHz are used for point-to-point communication systems and are of particular interest to antenna designers. Thus, the antenna structure 150 was optimized to operate within the band from about 17 GHz to 24 GHz. The FDTD simulator was then used to determine optimum dimensions for the remaining parameters, as follows:

| | |
|---|---|
| $l_0$ = | 70 mil |
| $l_s$ = | 120 mil |
| $l_m$ = | 230 mil |
| u × v = | 60 × 45 mil |

Figure 9:
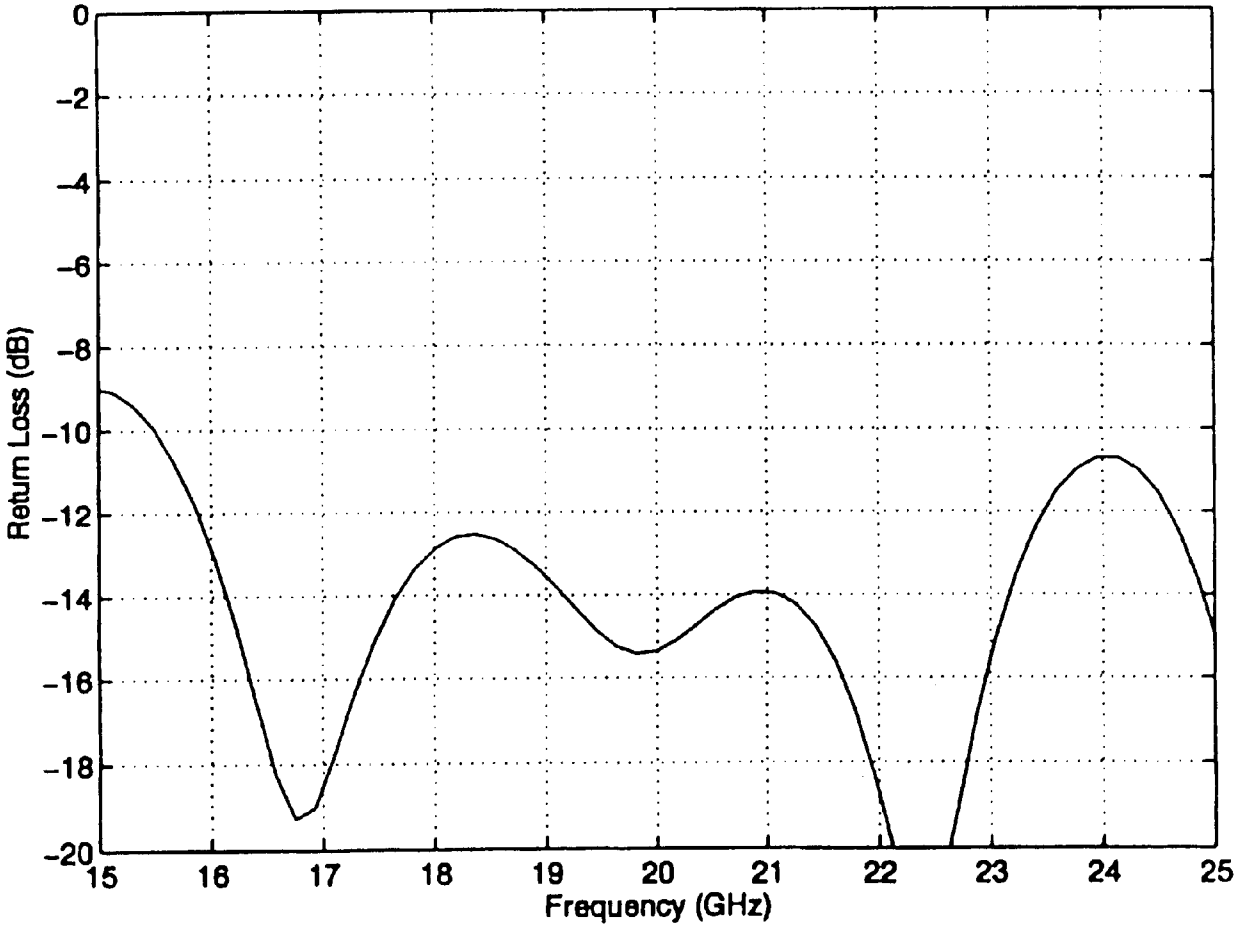
FIG. 9 shows the return loss performance for the SML fed antenna structure of FIGS. 8A–8C.

The return loss of the SML feed to slot 164 transition of the antenna 150 having the above parameters is shown in FIG. 9. FIG. 9 illustrates that energy is very smoothly coupled from the SML to the slot 164 for the required bandwidth given above (17–24 GHz). By altering the parameters $l_0$, $l_s$, $l_m$, and/or u×v, the operating bandwidth of the antenna structure 150 can be modified as required.

A one or two dimensional antenna array can conveniently be built with the antenna structure 150 as its elements.

Figure 10:
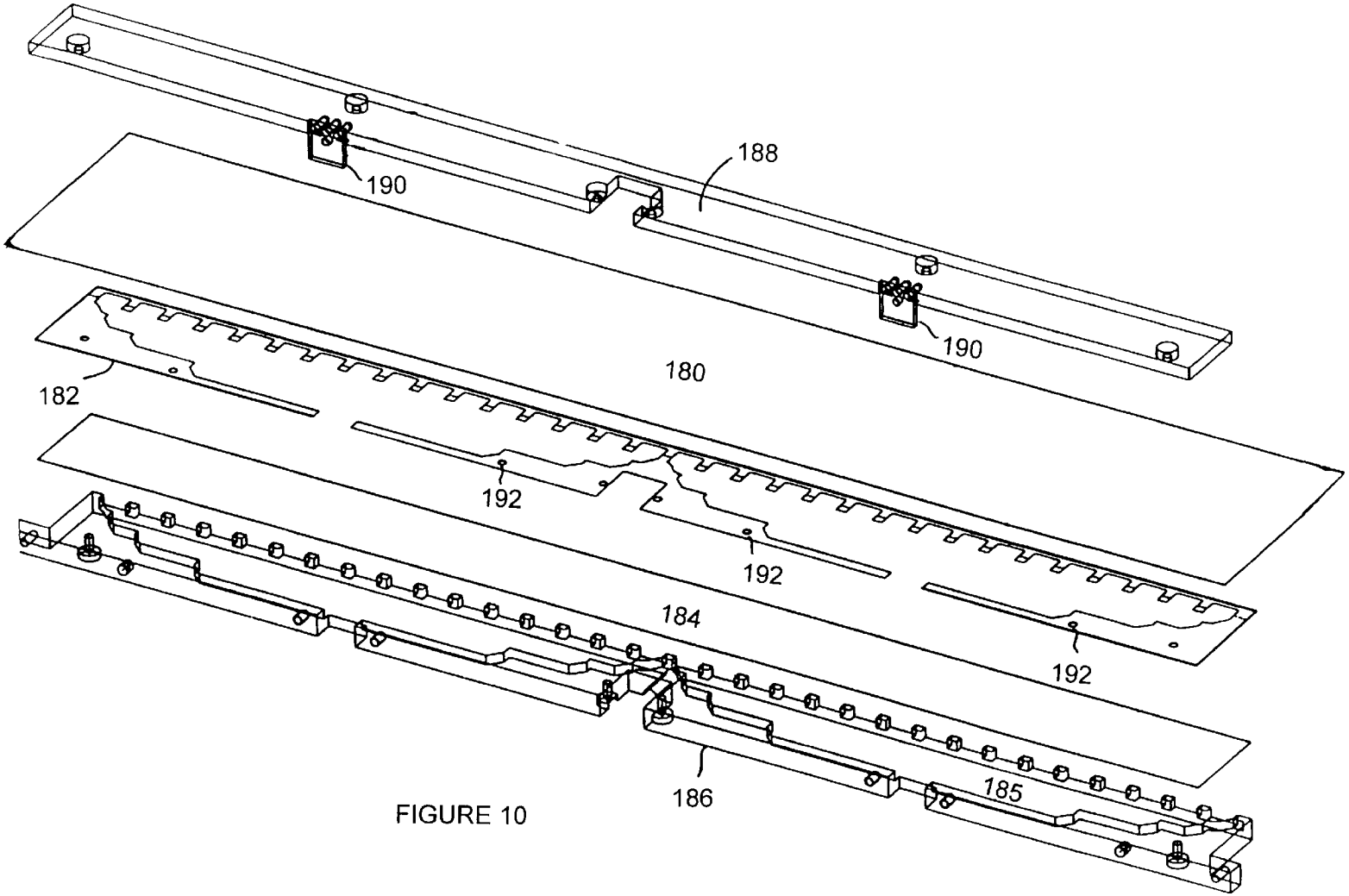
FIGS. 10 and 11 show a five piece 1×32 antenna array assembly having the antenna structure of FIGS. 8A–8C as elements.

Unlike prior art microstrip line fed tapered slot arrays in which the strip conductor lines and the tapered slot arrays are simply etched on to opposite sides of a PCB dielectric substrate, the SML fed array requires an air-filled dielectric layer. FIG. 10 shows a simple five piece assembly which can be used to form a 1×32 antenna array. As shown in FIG. 10, a printed antenna layer 180, a spacer layer 182, and a PCB BFN layer 184 are sandwiched and fixedly held together between a top plate 186 (shown at the lower portion of FIG. 10) and a bottom plate 188. Alignment tabs 190 and alignment holes 192 may be used to keep the layers aligned. The layers may be fixed together by means of any suitable securing device such as a screws.

Figure 11:
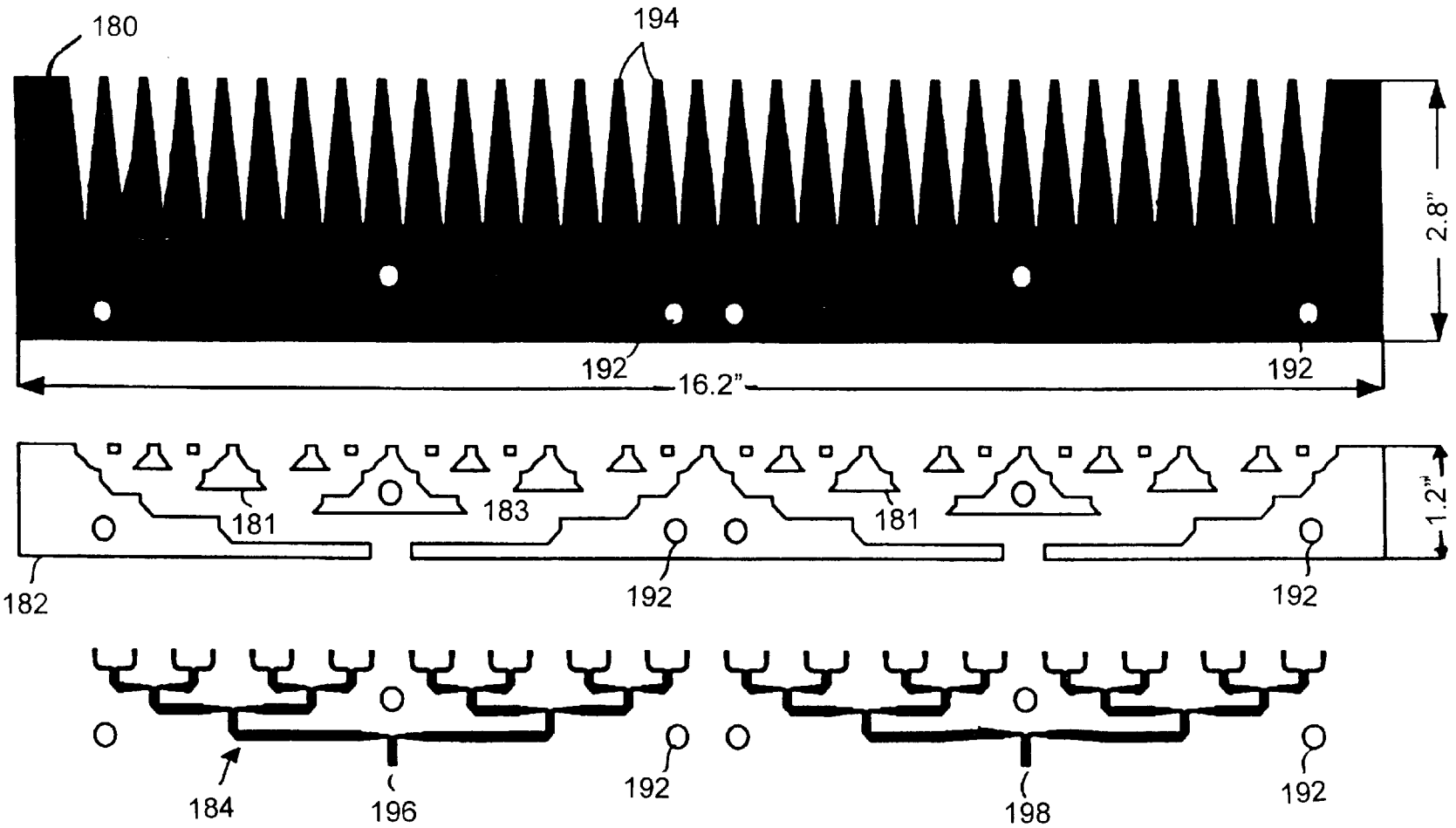

The details of the printed antenna layer 180, the islands on the spacer layer 182, and the PCB BFN on the layer 184 are shown in FIG. 11. The metal fins 194 on the printed antenna layer 180 may be etched within a metallization layer on the surface of a dielectric substrate or alternatively they may be formed within a metallization layer with no substrate. The metallization layer of the printed antenna 180 forms the ground of the SML feed and is made out of a suitable metal such as copper. The remaining materials of the antenna assembly of FIG. 10 may also be made out of a metal, such as aluminium—except for the dielectric substrate of the PCB layer 184 and the dielectric substrate of the antenna layer 180 (if any). The spacer layer 182 includes a number of islands 181 of height b which provide a uniform air-filled dielectric gap 183 between the BFN and the antenna layer. Note that the spacer layer 182 is preferably contiguous as shown in FIG. 10, even though (for clarity) it is not so shown in FIG. 11. Referring to FIG. 10, the top plate 186 also has islands 185 to provide a spacing (preferably about 150–200 mil) between the SML and the top cover of the assembly to help ensure that antenna beam pattern provides suitably low sidelobe levels in the H-plane.

Referring again to FIG. 11, the BFN on the PCB layer 184 is shown to include impedance transformers as explained above (the dielectric PCB substrate is not shown). Furthermore, the 1×32 antenna array is fed by a first port 196, (which feeds a first 1×16 portion of the array, and a second port 198, which feeds a second 1×16 portion of the array. The approximate dimensions of the antenna assembly are also shown in FIG. 11. As indicated, the 1×32 antenna array has a relatively low profile, including a total antenna thickness of 2.8 inches. The length of the assembly is about 16.2 inches with 486 mil (about 12 mm) spacing between slot elements.

The 1×32 array has a measured return loss which is better than −10 dB from 17 GHz to 24 GHz. The array also provides good gain and beamwidth characteristics. The beamwidth in E-plane becomes narrower as N increases, but the beamwdith in the H-plane is not affected by the number of elements in the 1×N E-plane array.

A two dimensional array can be formed by essentially juxtaposing several one dimensional E-plane arrays, and then feeding these E-plane arrays appropriately. Thus, for instance, a 32×32 antenna element array could be formed by placing thirty-two of the one dimensional E-plane arrays of FIGS. 10 and 11 adjacent to one another. A two dimensional array of this nature generally requires some type of base or support structure (not shown) having either a waveguide or, for large arrays, an H-plane BFN which feeds each of the E-plane sub-arrays. An H-plane BFN would lie on a PCB substrate which is orthogonal to the E-plane BFNs, and an additional transition feed would be required for transferring energy from the H-plane BFN to each E-plane BFN. (Two H-plane BFN to E-plane BFN transitions would be required for the 1×32 E-plane subarray of FIGS. 10 and 11, since each of these E-plane sub-arrays has two input ports 196 and 198.) An H-plane BFN is preferably based on a SML or ISML structure, but it may also be part of a standard microstrip line or other type of printed transmission line. An input connector to the H-plane BFN, such as a WR42 waveguide (not shown) must also be used.

In this manner, 32×32 array was built from thirty-two of the one dimensional E-plane arrays of FIGS. 10 and 11 and an H-plane SML BFN with two transitions per E-plane sub-array. The two dimensional array would also be enclosed in a housing, including a protective radome and sidewalls. The radiating aperture size or footprint of the array was about 15.5 inches by 15.5 inches and the thickness of the 32×32 array was about 3.5 inches (note that the H-plane SML feed adds significantly to the thickness of the array). The 32×32 array was able to provide good performance in terms of return loss from 17.7–23.6 GHz. The array was able to provide a beamwidth in both the E- and H-planes of less than 2.2° and a gain of better than 34 dBi for most of the desired bandwidth. The cross-polarization levels (or discrimination) was also better than −30 dB in both the E- and H-planes (as discussed below, cross polarization discrimination is a measure of an antenna's ability to differentiate between vertical and horizontal linear polarizations). The sidelobe levels were also within the MTP1409 high perfomance specifications and very nearly within FCC category A specifications. It should be noted that an important design criteria for the 32×32 array is to ensure that the E-plane and H-plane tapered slot antenna element spacing is uniform and aligned. It is also important to have uniformity between all H-plane BFN to E-plane BFN transitions.

Tapered Slot Antennd With Double Strip Isml Feed

FIGS. 8A–8C can be easily modified to change the basic SML feed stucture for the tapered slot antenna element 164 to a basic inverted suspended microstrip line (ISML). This simply requires etching the strip line conductor 160 on the opposite face of the dielectric substrate 158 (i.e. the face which faces the layer 154 and substrate 152) and then simulating and optimizing the parameters $l_0$, $l_s$, $l_m$, and u×v (or other suitable set of paremeters).

According to the present invention, the slot antenna and the microstrip line can be etched within a common surface on a dielectric substrate. For this purpose, a design which provides a wide band transition from a strip conductor to an antenna slot line on a common dielectric surface is required. This common surface aspect can be advantageously implemented in a tapered slot antenna with a SML or ISML feed structure, although it can also be implemented with a basic microstrip line feed structure as well.

Figure 12B:
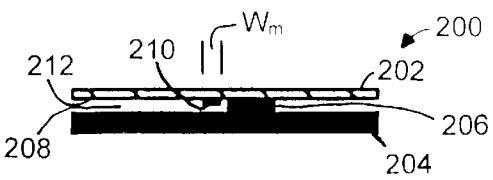
FIG. 12B shows a second cross-sectional view of the double conductor strip ISML feed structure of FIG. 12A rotated by 90 degrees.
Figure 12A:
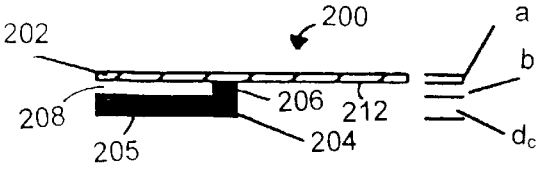
FIG. 12A shows a cross-sectional view of the double conductor strip ISML feed structure according to the present invention.
Figure 12C:
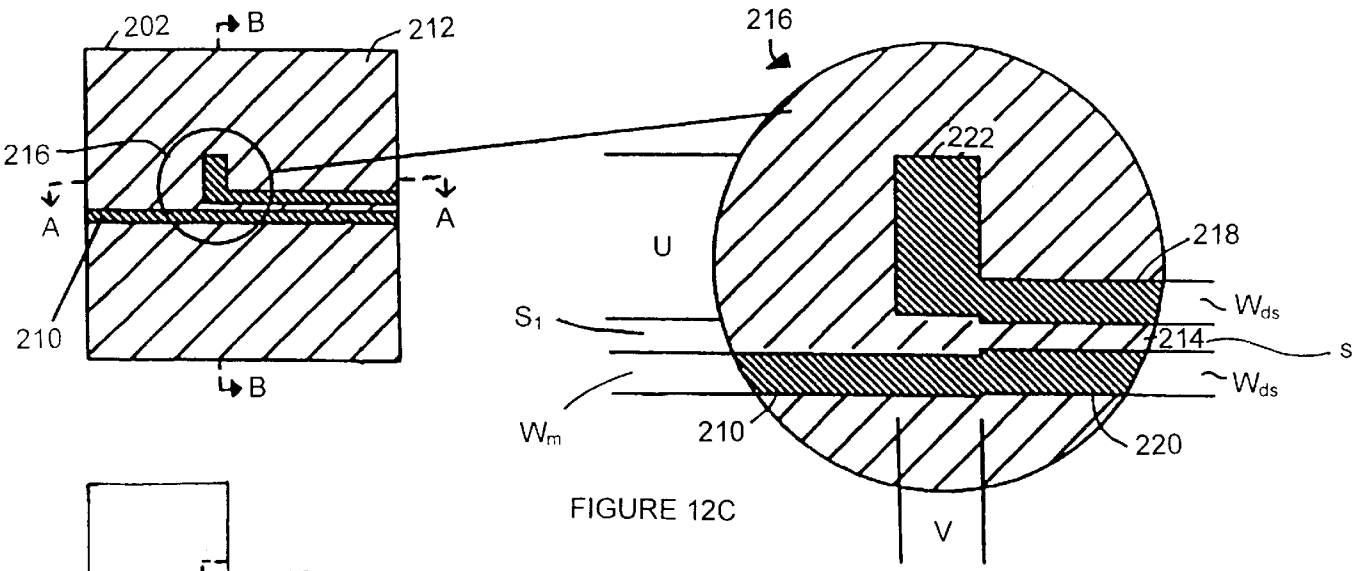
FIG. 12C shows a bottom view of the surface of the dielectric substrate in the structure of FIGS. 12A and 12B, and the lines A—A and B—B along which the cross-sectional views of FIGS. 12A and 12B are taken respectively.

FIGS. 12A–12D show an ISML feed structure 200 according to the present invention. FIG. 12A is a cross-sectional view of the structure 200 along the line A—A in FIG. 12C, and FIG. 12B is a cross-sectional view of the structure 200 along the line B—B in FIG. 12C.

Referring to FIG. 12A, the feed structure 200 includes a dielectric layer 202 of permittivity $\epsilon_{rm}$ and thickness a and a ground conductor plate 204 of thickness $d_c$. The ground plate 204 is separated from the dielectric slab 202 by an air gap 208 of thickness b and includes a spacer portion 206 which abuts against the surface 212 of the dielectric layer 202. A strip line conductor 210 of width $W_m$ also runs along the surface 212.

Figure 12D:
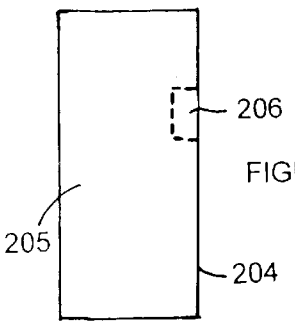
FIG. 12D shows a bottom view of the surface of of the ground plate 204 in the structure of FIGS. 12A and 12B.

FIGS. 12C and 12D show bottom views of the dielectric layer 202 and the conductor plate 204 respectively. The views in FIGS. 12C and 12D are therefore inverted in comparison to FIGS. 12A and 12B. Note that the details of the conductors running along the surface 212 (as shown in FIG. 12C) have been omitted for clarity in the sectional view of FIG. 12A, but the location of the strip line conductor 210 along the surface 212 is shown in FIG. 12B.

As shown in FIG. 12C, the surface 212 of the dielectric layer 202 (i.e. the lower surface in FIGS. 12A and 12B) contains a feed transition 216 between the ISML strip 210 and a double conductor strip formed slot line 214. A detailed, exploded view of the feed transition 216 is also shown in FIG. 12C. The feed transition 216 includes double conductor strips 218 and 220 which run parallel to one another and form the slot line 214 in between them. The double conductor strips 218 and 220, which form a balanced line, are each of width $W_{ds}$ and are separated by the slot width s. As indicated in FIG. 12C, the strip 220 links to the ISML strip line 210, and the strip 218 links to a patch termination 222 of dimension u×v. The termination patch 222 is electrically connected to the portion 206 of the ground conductor plate 204, i.e. the ground of the ISML. Unlike the electromagnetic coupling SML fed structure 150 described above, the direct electrical connection in this embodiment avoids the possible problem of static charge build-up, which can potentially damage the printed antenna structure. Although the termination patch 222 is shown to be rectangular in FIG. 12C, termination patches of other shapes (such as circular) could also be used. Preferably, the termination patch 222 and the face of slab portion 206 which abuts against the patch 222 are of the same shape and size. The ISML strip line 210 and the patch 222 are separated by a distance $s_1$.

FIG. 12D shows the bottom surface 205 of the ground plate 204. The spacer portion 206 shown in dotted outline extends from the opposite surface of the plate 204, so as to connect with the patch 222.

Once again, given certain parameters, the return loss for various dimensions of the feed transition 216 can be optimized over the frequency band of 17–24 GHz using an FDTD simulation tool. For instance with,

| | |
|---|---|
| $W_m$ = | 30 mil |
| a = | 8 mil |
| b = | 25 mil |
| $d_c$ = | 100 mil |
| $\epsilon_{rm}$ = | 3.38 (RO4003 ™ material) |

the following parameters were optimized for the above bandwidth:

| | |
|---|---|
| $W_{ds}$ = | 40 mil |
| s = | 20 mil |
| $S_1$ = | 40 mil |
| u × v = | 200 × 150 mil. |

Figure 13:
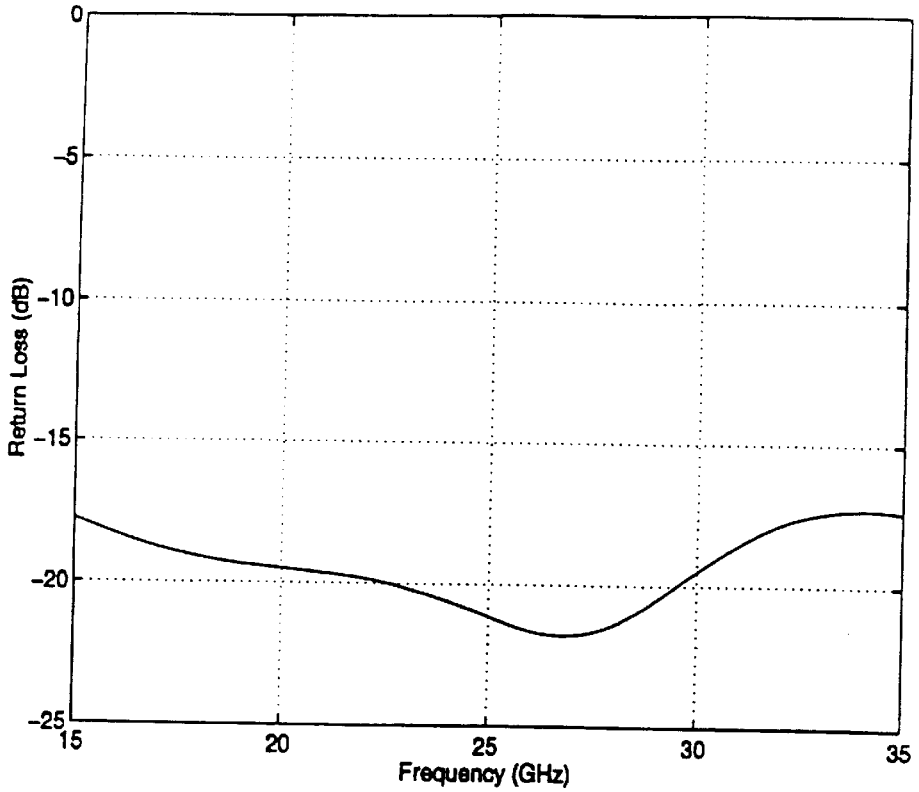
FIG. 13 shows the return loss performance for the ISML feed structure of FIGS. 12A–12D.

FIG. 13 shows the return loss (as seen from an ISML feed) for the feed structure 200 with the above set of parameters and dimensions. Once again the return loss performance is very good, and indeed is below −15 dB from 15 GHz to 35 GHz.

Figure 14:
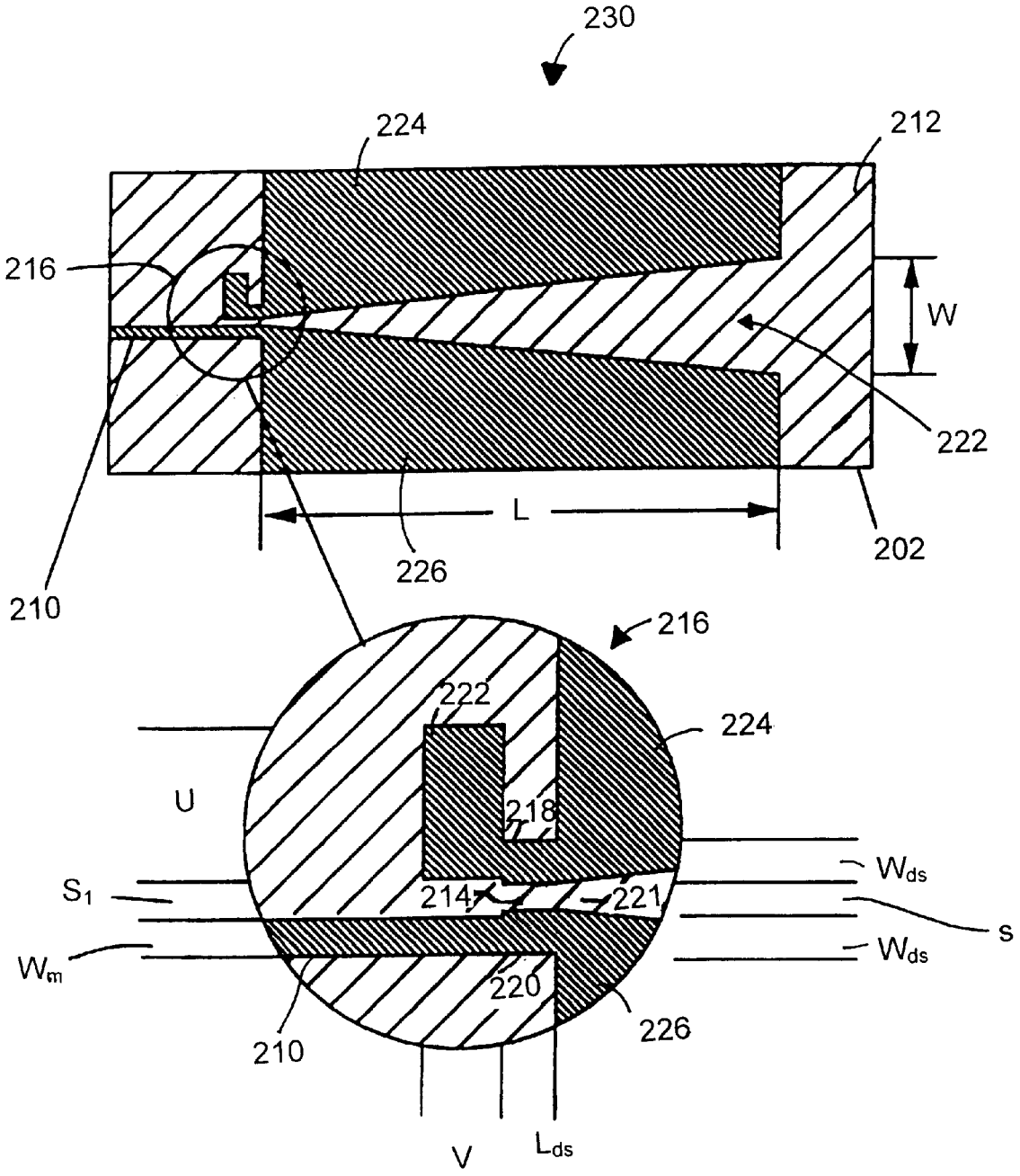
FIG. 14 shows a tapered slot antenna structure fed by the ISML feed structure of FIGS. 12A–12D.
Figure 15:
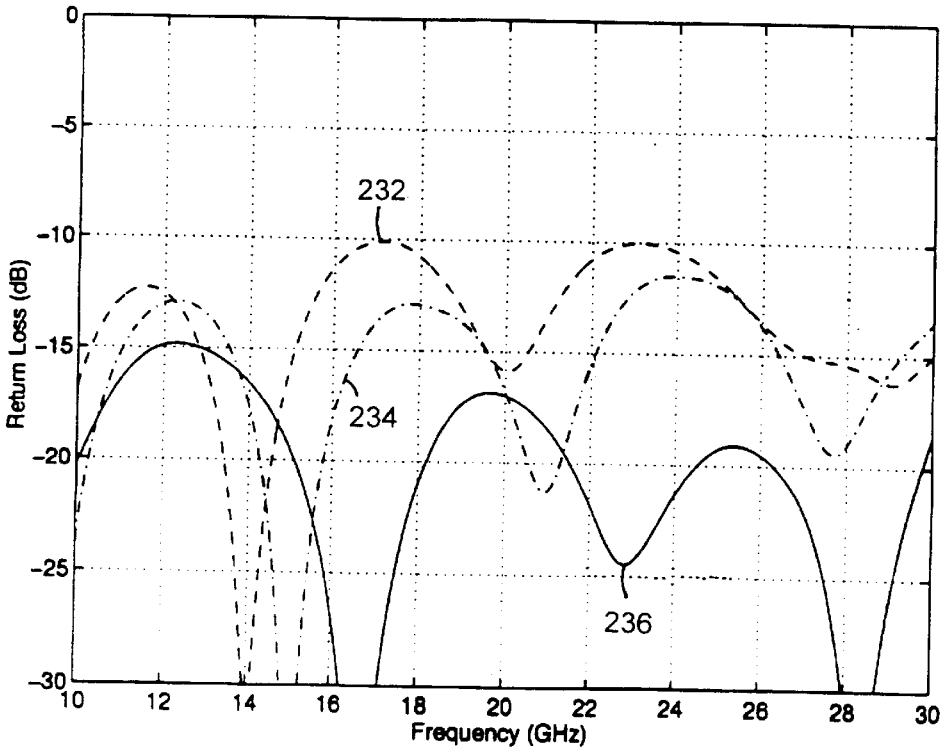
FIG. 15 shows three different return loss performance graphs for the ISML fed antenna structure of FIG. 14.

FIG. 14 shows an antenna element structure 230 fed by the ISML feed structure 200 of FIGS. 12A–12C. As shown in FIG. 14, metallized layers 224 and 226 are added to the surface 212 of the dielectric substrate 202. The layers 224 and 226 are linked to double strip conductors 218 and 220 respectively. A tapered slot 221 is formed between the metallization layers 224 and 226. Note that a linear tapered slot as shown in FIG. 14 is preferred, but once again other slot configurations may also be used. The addition of the tapered slot antenna in FIG. 14 results in an additional parameter $L_{ds}$, representing the length of the double strip conductors 218 and 220, which must be taken into account during performance simulation and optimization ($L_{ds}$ also represents the length of the slot line 214 of the antenna). Generally, the return loss of the antenna structure 230 is optimal for a relatively small value for $L_{ds}$. This is illustrated in FIG. 15 which shows the return loss of the antenna structure 230 having the parameters given above and with $L_{ds}$=100 mil (shown at 232), $L_{ds}$=50 mil (shown at 234), and $L_{ds}$=20 mil (shown at 236). The return loss with $L_{ds}$=20 mil is less than about −15 dB from 10 GHz to 30 GHz.

Figure 16:
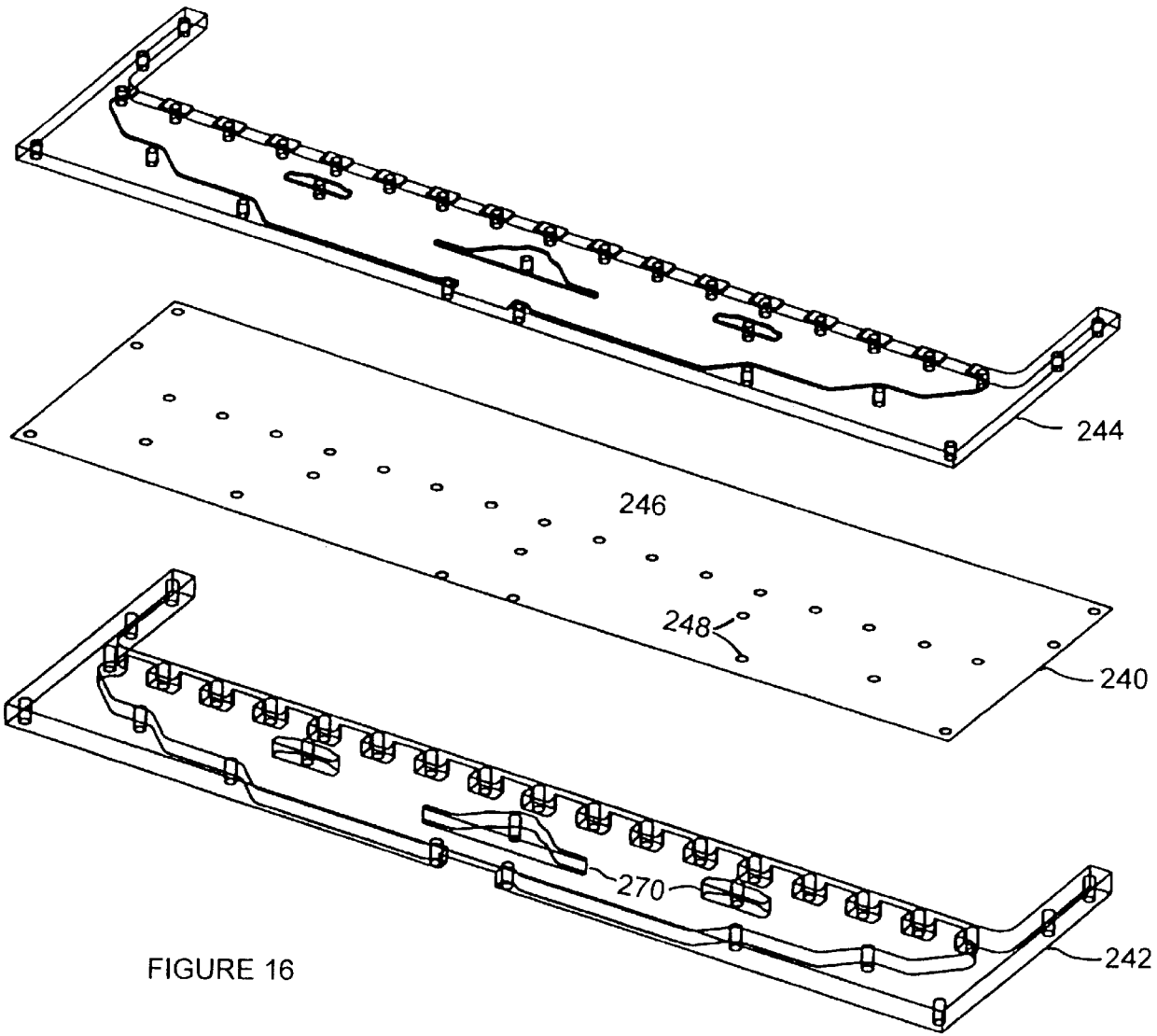
FIGS. 16 and 17 show a three piece 1×16 antenna array assembly having the antenna structure of FIG. 14 as elements.

A one or two dimensional antenna array can once again be built with the antenna structure 230 as its elements. FIG. 16 shows a simple three piece assembly which forms a 1×16 antenna array. As shown in FIG. 16, a PCB dielectric layer 240 is sandwiched and fixedly held between a top plate 242 (shown at the lower portion of FIG. 16) and a bottom plate 244. Alignment holes 248 may be used to keep the layers aligned, and the layers may be fixed together by means of any suitable securing device such as no. 2 screws fitted through the holes 248.

Figure 17:
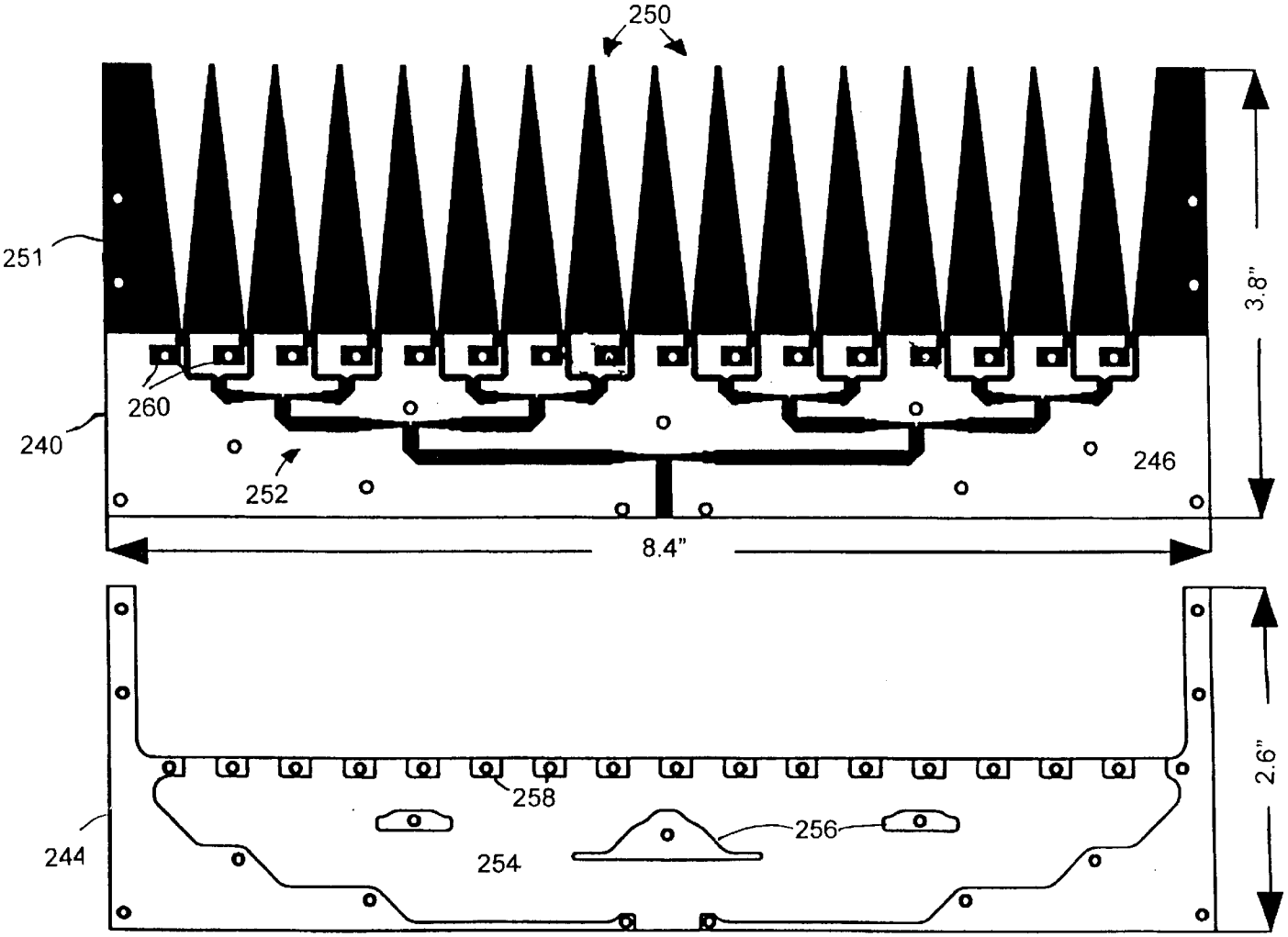

The details of the printed antenna layer 240 and the bottom layer 244 are shown in FIG. 17. The PCB layer 240 has the tapered slot antennas 250 and the ISML BFN 252 etched within a metallization layer 251 (preferably copper) on the surface 246 of PCB layer 240 which faces the bottom plate 244. The remaining materials of the antenna assembly of FIG. 16 may also be made out of a metal, such as aluminium—except for the dielectric substrate of the PCB layer 240 which is preferably RO4003™ or RO4350™ material. The bottom layer 244 includes a number of islands 256 of height b, providing a uniform air-filled dielectric gap 254 between the PCB layer 240 and the bottom layer 244 (which forms the ground of the ISML). The spacers 258 on the bottom layer 244 serve to connect the patches 260 on the PCB layer 240 to the ISML ground, as explained above. Screws may also be used to ensure that the spacers 258 and the patches 260 are in physical and electrical contact. As shown in FIG. 16, the top cover 242 may also have islands 270 of the same size and shape as the islands 256 on the bottom plate 244 to create a further air gap between the top plate 242 and the PCB layer 240. This air gap is preferably about 200 mil and helps ensure that the sidelobes in the H-plane of the antenna array beam pattern are acceptably low. The BFN 252 of the PCB layer 240 is shown to include impedance transformers as explained above. The approximate dimensions of the antenna assembly are also shown in FIG. 17. As indicated, the 1×16 antenna array has a relatively low profile, including a total antenna thickness of about 3.8 inches. Larger one dimensional arrays and/or two dimensional arrays can be formed as explained above for the SML fed array.

The three piece ISML fed tapered slot antenna array shown in FIGS. 16 and 17 provides advantages over the five piece basic SML fed tapered slot antenna array of FIGS. 10 and 11. Because it has fewer layers or components, it is less expensive to manufacture, particularly for large two dimensional arrays. The three piece ISML design also does not require precise alignment between layers so that the SML strip line and the antenna slot line are configured accordingly. This is because the slot line to strip line alignment for the ISML design can be easily achieved when printing the antenna layer on which both reside. As a result, the three layer ISML antenna array assembly is much faster and easier to assemble.

Figure 18:
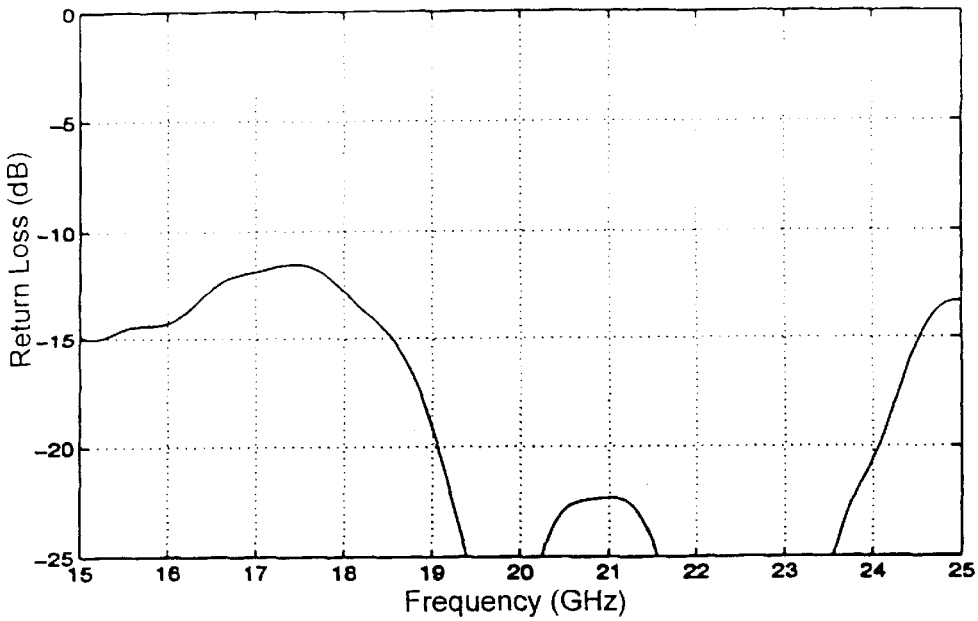
FIG. 18 shows the return loss performance for a 1×2 sub-array of FIG. 16.
Figure 19:
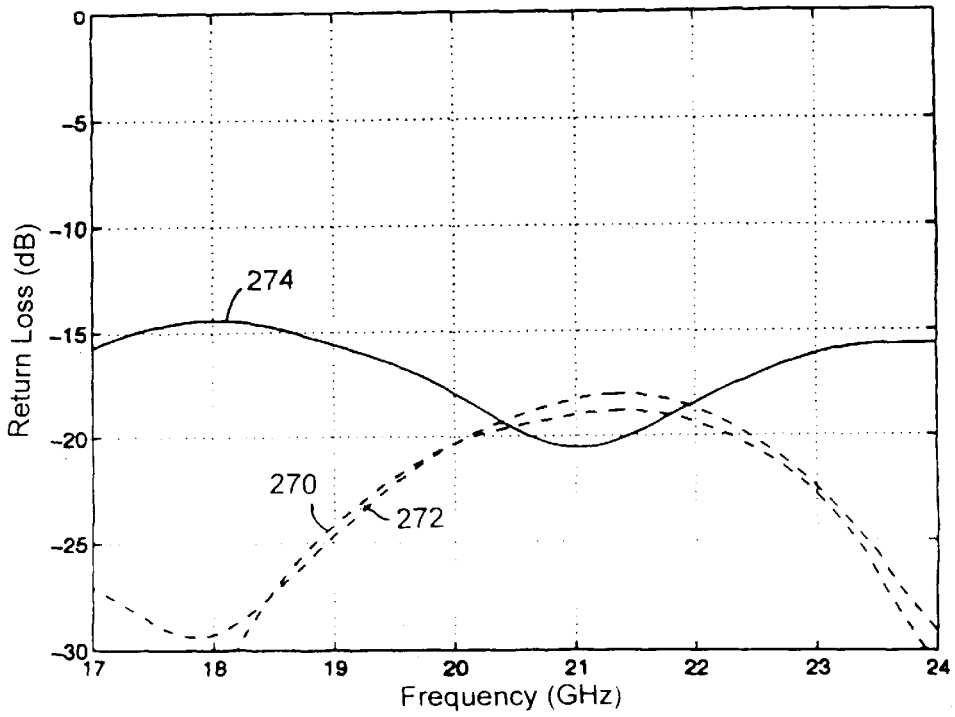
FIG. 19 illustrates the mutual coupling between elements in a 1×3 sub-array of FIG. 16.

To test the performance of the array assembly of FIGS. 16 and 17, a 1×2 sub-array of antenna elements from FIG. 14 with an element spacing of 468 mil and fed by a power splitter such as that shown in FIG. 7B was simulated using a FDTD simulator tool. The return loss results are shown in FIG. 18 indicating that the 1×2 array provided an overall return loss better than −12 dB from 15 GHz to 25 GHz, and better than −20 dB from about 19 GHz to 24 GHz. Similarly, a 1×3 sub-array of the same antenna elements was simulated to test the mutual coupling or cross talk in the E-plane between antenna elements. A FDTD simulation tool was also used for this purpose with an appropriate boundary condition placed on the strip line which feeds each of the three slot elements, to simulate an impedance matched load. A pulse input was launched on the ISML strip line of the center element of the 1×3 sub-array. FIG. 19 shows the mutual coupling between each of the adjacent elements and the centre element at lines 270 and 272. As indicated in FIG. 19, the mutual coupling or cross-talk between adjacent antenna elements is less than −15 dB for the band from 17 GHz to 24 GHz-which is more than acceptable for most applications. The line 274 in FIG. 19 also shows the (single element) return loss measured from the center element of the 1×3 sub-array.

Figure 20:
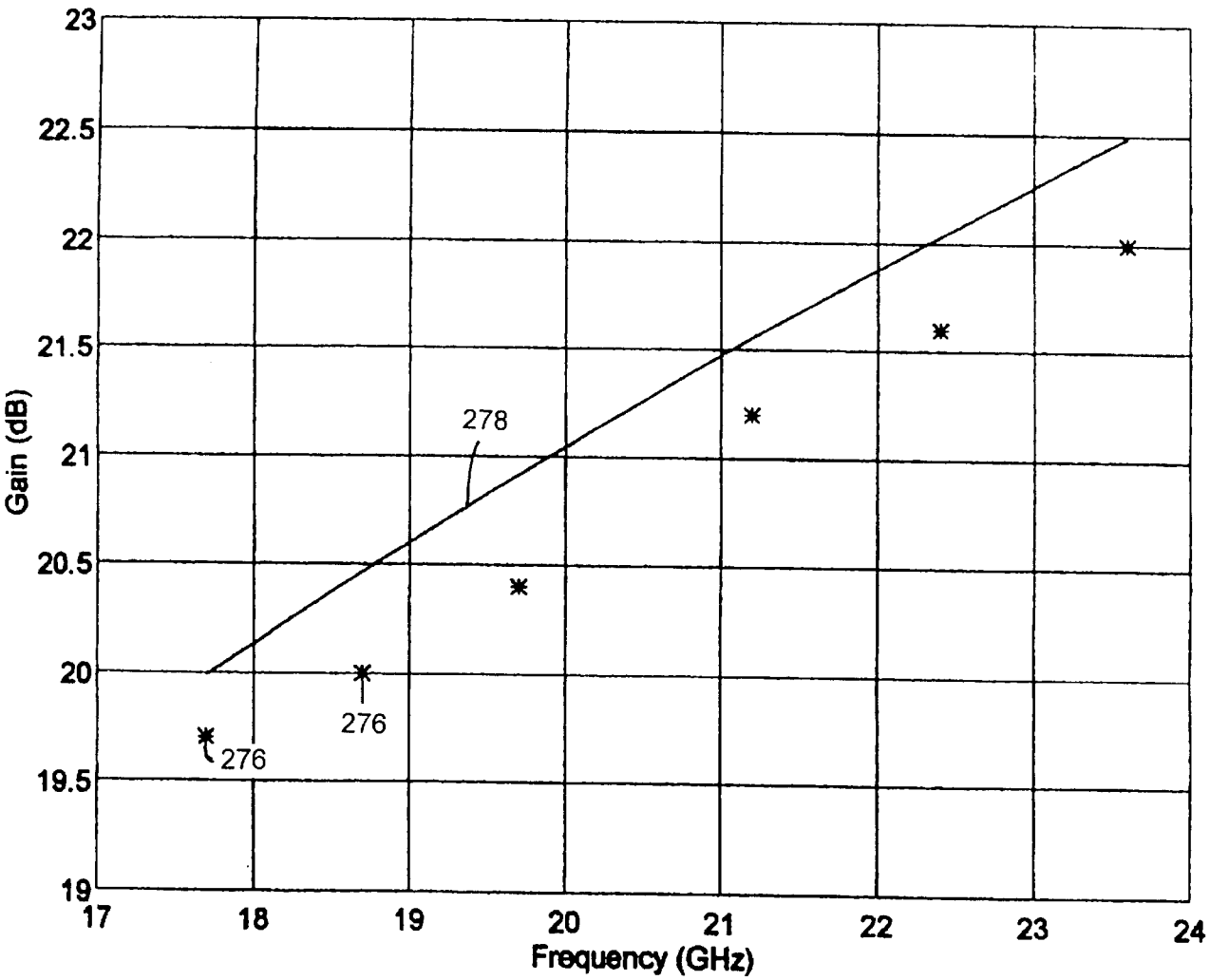
FIG. 20 shows the measured gain and directivity gain for the 1×16 array of FIG. 16.

Furthermore, an actual measurement of the return loss of the 1×16 ISML fed array and revealed that the array had a return loss of −10 dB or better within the frequency band for which it was designed (i.e. 17.7 GHz to 23.6 GHz). FIG. 20 additionally shows values, at 276, for the measured antenna gain of the 1×16 ISML fed antenna array of FIGS. 16 and 17 (again for the 17–24 GHz band). The measured antenna gain is expressed in dBi (i.e. relative to an isotropic antenna which radiates uniformly in all directions). The directivity gain rating of the array is also shown at 278. The directivity gain is proportional to the physical area of the antenna per square wavelength (i.e. $4\pi A/\lambda_0^2$ where A is the aperture area of the array and $\lambda_0$ is the wavelength at the center frequency of operation). In general, $$\text{Gain}=(\text{Efficiency of the Antenna})\times\text{Directivity}$$

As shown in FIG. 20, the measured gain agrees quite well with the directivity (in general, the smaller this difference, the more efficient the array). The difference between the measured and directivity gain is primarily due to line loss mismatch and mutual coupling between array elements. The beam patterns of the array, including sidelobe level and E-plane beamwidth peformance, were also well within reasonable design limits.

Tapered Slot Antenna With Double Strip Feed

Figure 21:
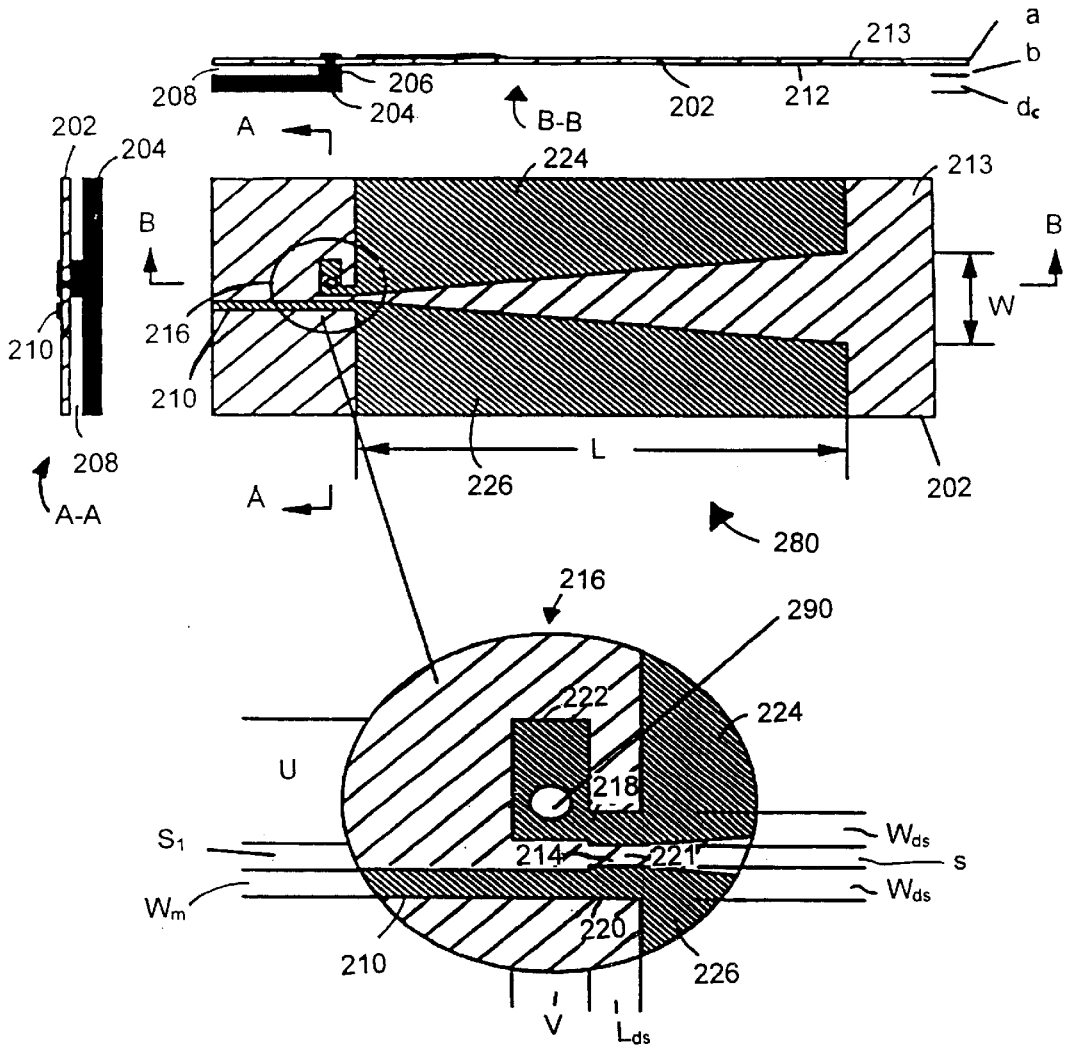
FIG. 21 shows a double conductor strip SML fed tapered slot antenna structure according to the present invention.

It is equally possible to use the double strip conductor feed transition structure of FIG. 12 in conjunction with a suspended microstrip line (SML). FIG. 21 shows a tapered slot antenna structure 280 fed by a SML in this manner. The structure 280 is the same as the ISML fed tapered slot antenna structure 230 of FIG. 14, except for two differences. First the slot and SML strip line are now etched on the surface 213 of the dielectric substrate 202 (i.e. the surface which does not face the SML ground plate 204). Second, the termination patch 222 does not directly touch or connect with the SML ground connecting spacer 206. Rather, a metal conducting pin 290 which passes through the substrate 202 is now used for this purpose. Alternatively, a conductive via could also be used.

For the initially determined parameters,

| | |
|---|---|
| a = | 8 mil |
| b = | 20 mil |
| $d_c$ = | 100 mil |
| $\epsilon_{rm}$ = | 3.38 |
| W = | 468 mil |
| L = | 1200 mil |

optimizing (by way of FDTD simulations) the feed transition for the antenna structure 280 provided the following optimal parameters for the frequency band 15–25 GHz:

| | |
|---|---|
| $W_m$ = | 25 mil |
| $W_{ds}$ = | 40 mil |
| $L_{ds}$ = | 50 mil |
| s = | 20 mil |
| $s_1$ = | 20 mil |
| u × v = | 200 × 150 mil |

Figure 22:
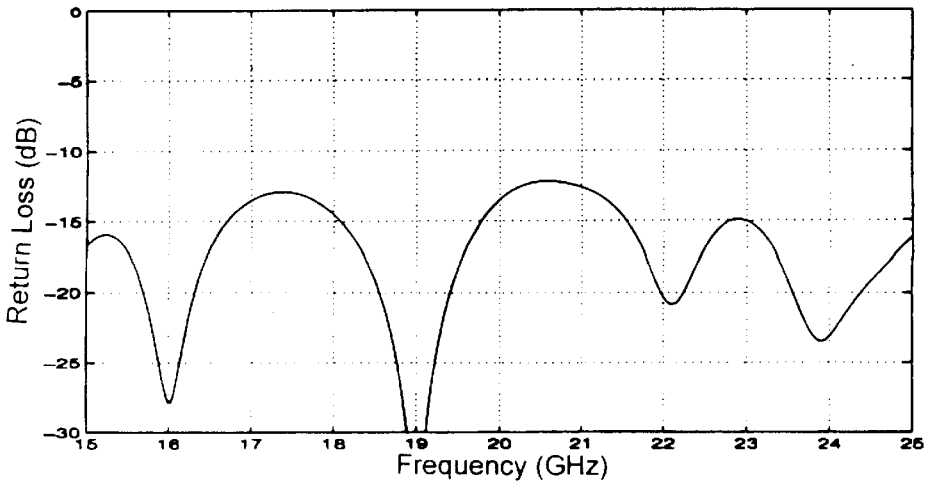
FIG. 22 shows the return loss performance of the antenna structure of FIG. 21.

The return loss for this band with the above parameters is shown in FIG. 22.

Arrays of the antenna elements 280 may also be built, similar to those described above in conjunction with FIGS. 16 and 17 above.

Furthermore, as mentioned previously, the double strip conductor feed transition of FIG. 12 can also be used in conjunction with a basic microstrip line. In this embodiment, the structure would be identical to FIG. 21 except that the spacer portion 206 would not be present, and the ground layer would instead lie on the surface 212 of the dielectric substrate 202.

Tapered Slot Antenna with Feed Slot in the Ground of the Printed Transmisson Line In all of the previous tapered slot antenna structures, the antenna slot and strip line feed either lay along the same surface (i.e. they were coplanar) or they lay in planes which are parallel to one another. FIG. 23 shows a further embodiment of the present invention in which a suspended microstrip line (SML) tapered slot antenna structure 300 has a tapered slot 312 which lies in a plane which intersects (and is not parallel to or coplanar with) the plane in which the ground conductor layer lies (and the plane on which the strip line that feeds the tapered slot lies). The tapered slot plane and the ground conductor layer plane thereby form a dihedral angle, i.e. the angle between the two planes.

Referring to FIG. 23, the SML feed structure includes a dielectric layer 302 of permittivity $\epsilon_{rm}$ and thickness a and a ground conductor plate 304 of thickness $d_c$. The ground plate 304 is separated from the dielectric slab 302 by an air gap 306 of thickness b. As the feed is a SML, a strip line conductor 308 of width $W_m$ also runs along the surface 310 of the substrate 302. The tapered slot 312, including a slot line 318, is formed between two metal fins 314 and 316 which stand or extend at an angle $\alpha$ (i.e. a dihedral angle) from the ground conductor plate 304. The angle $\alpha$ is shown to be 90° in FIG. 23 so that fins 314 are perpendicular to the ground conductor plate 304. The slot 312 has length L and aperture width W, while the slot line 318 has width s. The fins 314 and 316 and the ground plate 304 may be an integral metallized structure, or may be different metal pieces rigidly fixed together. As in other embodiments of the invention, it is also possible for the slot 312 to be etched within a metallization layer on the surface of a dielectric (not shown)

substrate which would also lie in a plane perpendicular to the ground plate 304. The fin-defined, air-filled slot structure of FIG. 23 is however preferred because of its simpler structure. With no dielectric substrate, the antenna structure 300 propagates a travelling wave with a phase velocity equal to the speed of light in air.

According to this aspect of the present invention, the tapered slots 312 may be formed in a plane which meets the the ground conductor plate 304 at various different angles $\alpha$. In a preferred embodiment, $\alpha$ equals 90° so that the slots 312 are perpendicular to the ground conductor plate 304, as shown in FIG. 23. This embodiment is advantageous as it is easily fabricated and provides good coupling between the slot 320 and the slot line 318. Also, with $\alpha$=90° any coupling between elements in an array of such antenna elements is generally at a minimum. However, by providing the tapered slots 312 at a non-orthogonal angle to the ground conductor layer 304, for example with $\alpha$ equal to 45° or 135°, the thickness of the antenna elelment (or an array of such elements) is also advantageously reduced, at the expense of a slightly larger footprint (i.e. area). In such cases, the slot will radiate primarily in a direction corresponding to that angle. In general, a may take on any value so long as the metallization (and dielectric, where applicable) layers that form the tapered slots 312 can be physically attached to the ground plate 304 at that angle. Preferably, $45° \leqq \alpha \leqq 135°$ so that the tapered slot lies in a plane which is raised by at least 45° from the ground conductor layer 304.

FIG. 24 shows a top view of the surface 305 of the conductor ground plate 304 from which the metal fins 314 and 316 (with $\alpha$ equal to 90° as in FIG. 23), of thickness T, protrude. As shown in FIG. 24, the ground plate 304 contains a slot 320 which is etched all the way through the ground plate layer 304. The slot 320 serves to cut current flowing through the ground and to electromagnetically couple energy from the strip line 308 to the slot line 318 of the tapered slot antenna element. This coupling of energy occurs relatively efficiently for $45° \leqq \alpha \leqq 135°$. The slot 320 has at least two portions: a first portion 322 of width s which intersects the slot line 318 (in the ground layer 304 plane) and a second portion of width $s_m$ which crosses over the strip line 308 (in a parallel plane). The slot portions 322 and 324 are preferably each of constant width and are also preferably perpendicular to one another so that they form a right angle, as shown in FIG. 24. This serves to reduce cross-polarization effects in the H-plane near the main beam direction, as explained below. However, the angle between the slot portions 320 and 324 may also be either larger or smaller than 90°. Furthermore, although the slot 320 in FIG. 24 is depicted as strictly rectilinear, other geometries, such as an arced or curvilinear shaped slot—see, for example, FIG. 25—may also be used as long as the slot effects a crossover with both the strip line 308 and the slot line 318.

In prior art antenna structures, slots have been used in the ground of a microstrip line to feed a microstrip or patch antenna (i.e a resonant antenna): see Croq et al., "Millimeter-Wave Design of Wide-Band Aperture Coupled Stacked Microstrip Antennas", *IEEE Trans. Antennas Propaga*, vol. 39, no. 12, pp. 1770–1776(December, 1991). However, the radiating and feed surfaces in these antenna structures remain coplanar or parallel to one another. Furthermore, the operation and feed requirements of a resonant antenna structure differ considerably from travelling wave antenna devices. Also, although a SML fed structure is shown in FIG. 23, the feed technique according to this embodiment of the invention could also be a standard microstrip line (the air gap 306 in FIG. 23 would be removed), an inverted suspended microstrip line (ISML) (the strip feed 308 would be on the opposite surface of the dielectric layer 302 than that shown in FIG. 23), a coplanar waveguide, a balanced microstrip line, or any other printed transmission line feed structure having a ground conductor. For all of these feeds, the slot 320 is formed within the ground conductor (which is typically a metal plate or layer) and couples the transmission line feed to the perpendicular-lying slot antenna element. Preferably, the printed transmission line feed structure according to this embodiment of the invention is either a SML or an ISML, although for lower frequency bands, the standard microstrip line also performs well and may replace a SML or ISML, without any significant degradation in performance.

Figure 26:
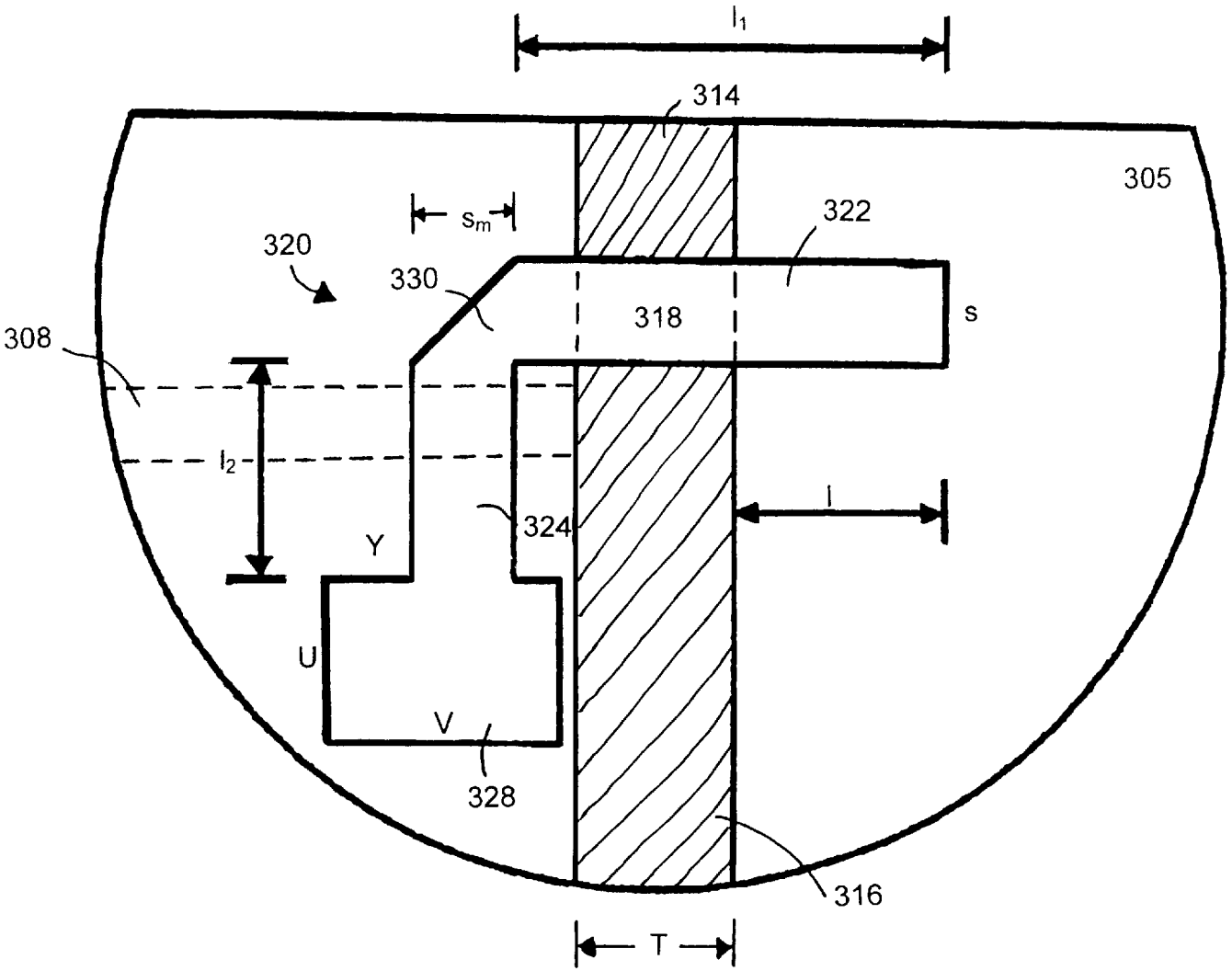
FIG. 26 shows a preferred configuration for the ground slot of FIGS. 23 and 24.

FIG. 26 shows an enlarged view of the general configuration of the feed slot 320 in the ground 304 of the SML of FIG. 23, according to a preferred embodiment of the invention. The slot 320 includes the first portion 322 and second portion 324 discussed above. In addition, the slot 320 includes a transition portion 330 which links the first and second slot portions 322 and 324 and a termination segment 328 at the end of the second portion 324. The first portion 322 has a length $l_1$ and a width s. The first portion also extends beyond the slot line 318, which is of width s and length T, by the distance 1 as indicated in FIG. 26. The second slot portion 324 has a length $l_2$ (not including the termination segment 328) and a width $s_m$. The strip line 308 crosses over the second slot portion 324, but it is not critical where along the second slot portion 324 this occurs. Generally the strip line 308 should extend past the slot portion 324 by about $\frac{1}{4}\lambda_0$, where $\lambda_0$ is the wavelength at the centre frequency of the operating bandwidth of the antenna.

The transition portion 330 may be triangular in shape, as shown in FIG. 26. Alternatively, the transition portion 330 could be curved (not shown) similar to the sector of a circle. The transition portion 330 could also include notches or the like. The termination segment 328 located at the end of the second slot portion 324 is a rectangle of dimension u×v. The location of the rectangular termination segment 328 relative to the slot portion 324 is determined by the parameter y, shown in FIG. 26. Termination segments of other shapes, such as a circle, may also be used, as long as they help provide the slot 320 with a wide band characteristic. The first slot portion 322 may also have a termination segment (which is rectangular, circular, or of some other suitable waveguide termination shape) either in addition to, or instead of, the termination segment 228 at the end of the second slot portion 324. (Termination segments can also be added at the end of the strip line feed 308, although this is generally not necessary).

Figure 27A:
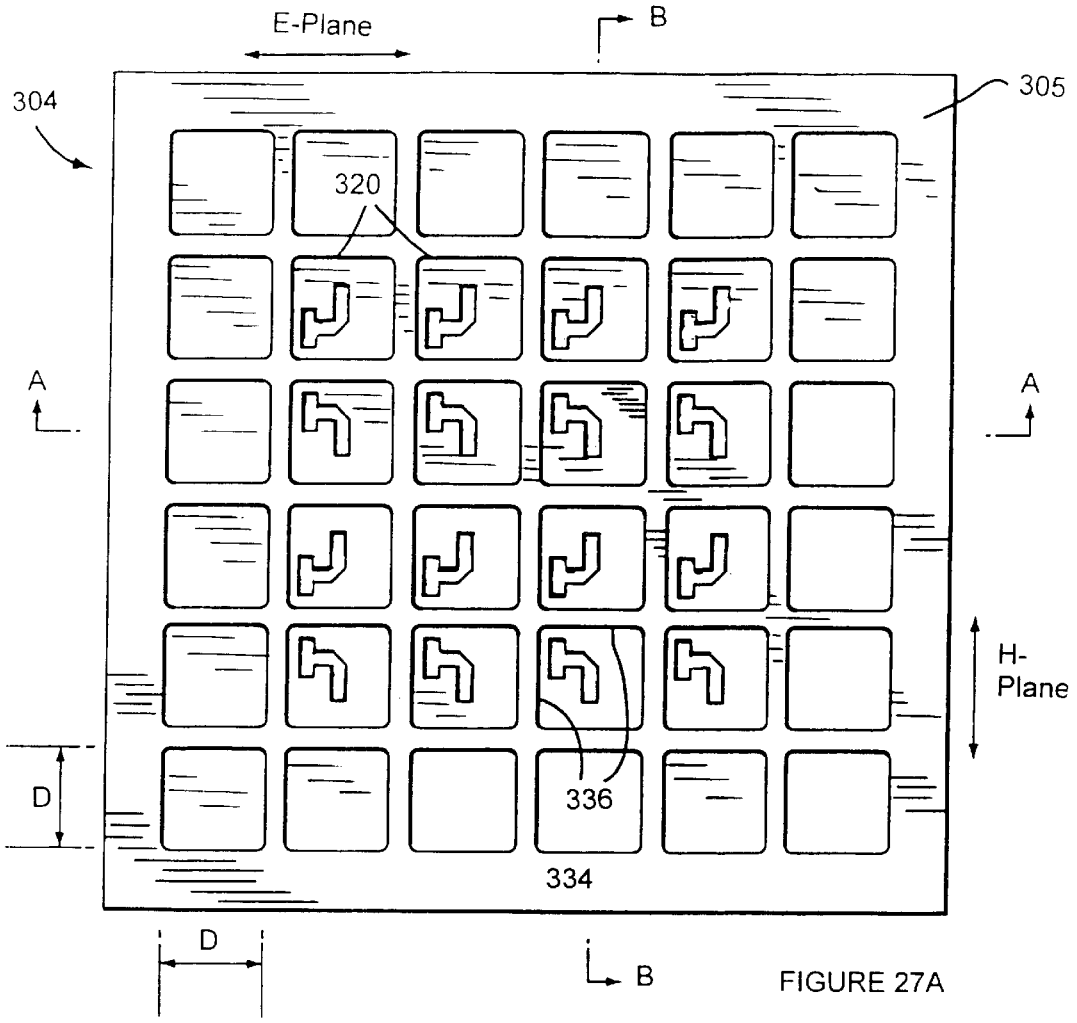
FIGS. 27A–27C illustrate a 4×4 array of the tapered slot antenna structures of FIGS. 23 and 24
Figure 27B:
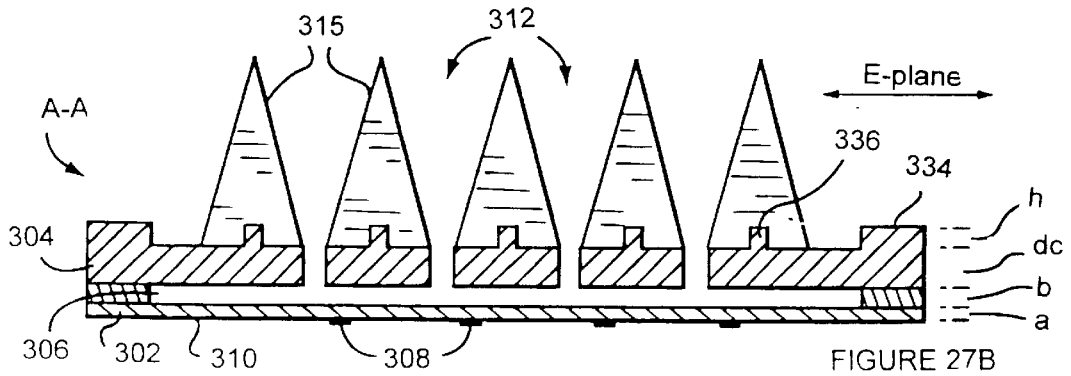
Figure 27C:
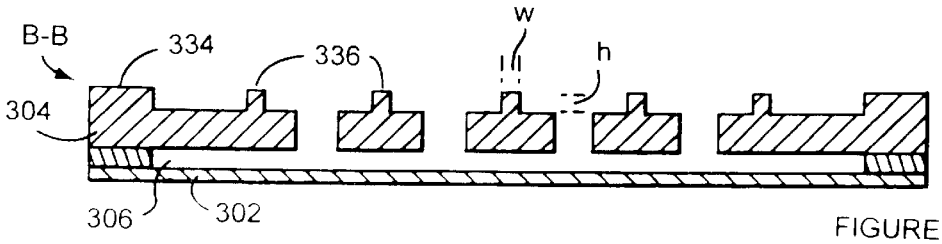

Like other tapered slot antenna structures, the antenna structure 300 can be conveniently assembled into an antenna array. FIGS. 27A–27C illustrate the structure of a 4×4 antenna array. FIG. 27A shows the ground conductor plate 304 for the array. Each tapered slot element has a corresponding ground feed slot 320 within the plate 304. The face 305 of the ground conductor plate 304 also has an external wall 334 around its perimeter and an internal wall structure 336. The internal walls 336 are of height h and width w and are arranged in a grid-like manner so that four walls surround each of the feed slots 320. Neighbouring sets of internal walls 336 are separated by a distance D.

FIG. 27B shows a cross-sectional view of the array structure along the line A—A in FIG. 27A.In addition, metal fins 315 which form the slot elements 312 are also shown in FIG. 27B. As in FIG. 23, the tapered slots in this illustrated embodiment are in a plane which perpendicularly intersects the ground layer 304. However each one dimensional E-plane array, for example that along the line A—A, may also lie in a plane which intersects the ground layer at a different angle, as discussed in detail above. All of the one dimensional E-plane arrays intersect the ground layer at the same angle, so that the E-plane arrays lie in parallel planes to one another. The array is fed by a SML, so the strip line feeds 308 run along the non-opposing face 310 of the dielectric substrate 302. The walls 336 support the metal fins 315 and also form a rib grid which acts to support the entire array structure (which is especially useful when the ground plate 304 is relatively thin). Furthermore, the walls 336 provide additional isolation between the feed slots 320, and so help to reduce mutual coupling or crosstalk between antenna elements. FIG. 27C similarly shows a cross-sectional view of the array structure along the line B—B in FIG. 27A.

Figure 28:
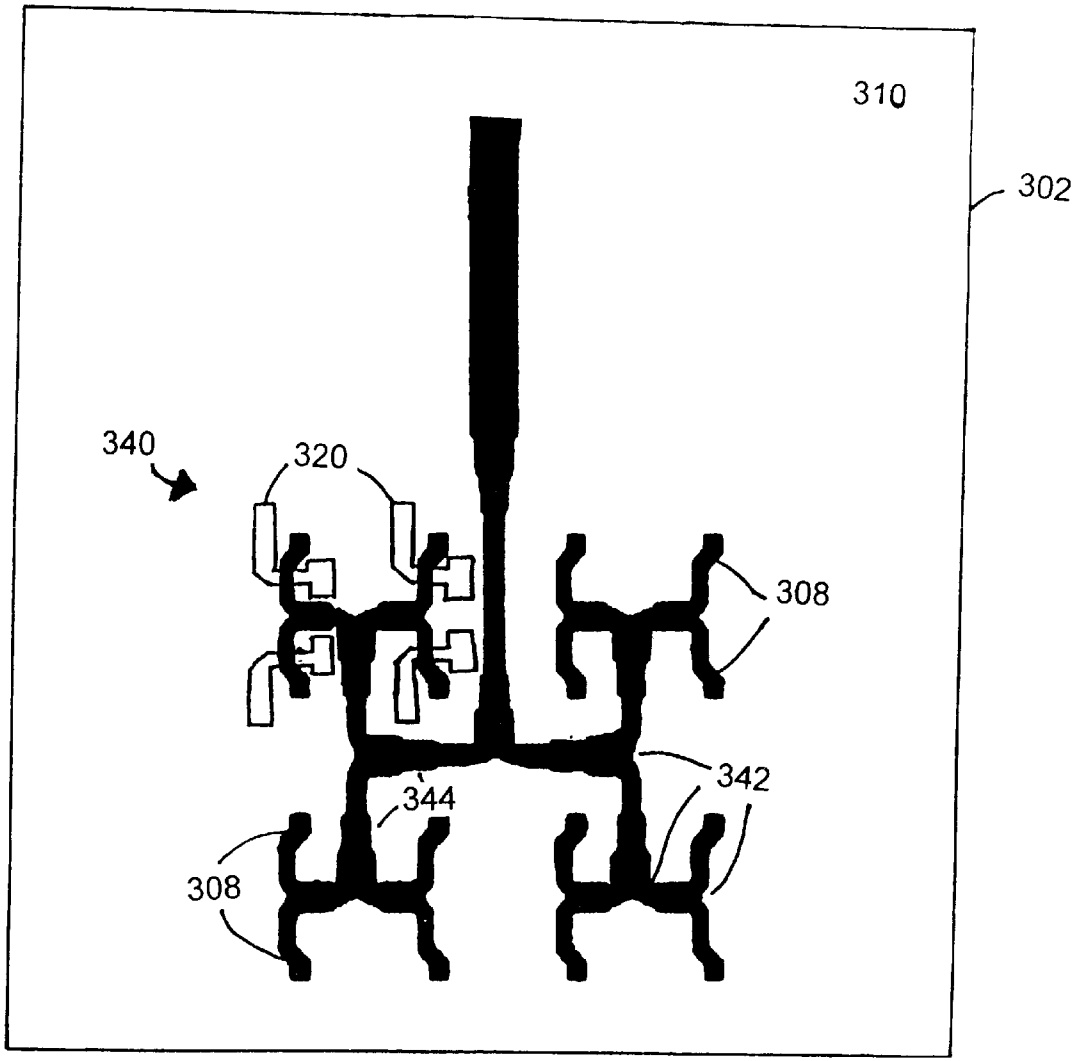
FIG. 28 shows a two dimensional BFN on a PCB layer for the array of FIGS. 27A–27C.

Because, in this embodiment of the invention, the feed slots all lie in the same plane (the ground of the printed transmission line) and are not simply parallel to one another, a two dimensional BFN which feeds both an E-plane sub-array of antenna elements and an H-plane sub-array of antenna elements can be used. FIG. 28 is a two dimensional parallel feed BFN 340 which feeds the antenna array of FIGS. 27A–27C, in a preferred embodiment of the invention. For an SML feed, the two dimensional BFN 340 lies on the surface 310 of the PCB dielectric substrate layer 302. For an ISML feed, the BFN would lie on the surface of the dielectric 302 which faces the ground conductor plate 304. The BFN 340 has phase splitters 342 and impedance transformers similar to those described in connection with FIGS. 7A and 7B above.

In prior art arrays of tapered slot antenna elements, the PCB layer or layers are parallel to the E-plane. The same is true (see FIGS. 11 and 17) of arrays made up of the basic slot SML/ISML fed or the double conductor strip SML/ISML fed tapered slot antenna structures (see FIGS. 8A–8C, 14 and 21). As a result, a PCB layer of these structures can be easily used to feed an E-plane array. However, it is more difficult to have these structures feed an H-plane sub-array. One technique is to feed a two dimensional array by: (1) having a PCB layer with at least one BFN feed for each E-plane sub-array, and (2) forming an H-plane BFN on a PCB layer which is orthogonal to the E-plane PCB layers. However, this requires an additional feed transition between the H-plane BFN and each of the E-plane BFNs. This may further limit the bandwidth and may induce additional transmission loss. This may also degrade array performance when the H-plane BFN to E-plane BFN transitions are not uniform throughout the array. Moreover, arrays with an H-plane BFN are difficult and costly to manufacture, and the H-plane BFN also adds about another 0.5 inches to the thickness of the overall array structure.

The two dimensional BFN overcomes these problems because both E-plane and H-plane sub-arrays can be fed simultaneously from the same BFN (or alternatively from different BFNs on the same PCB substrate), as illustrated in FIG. 28. As mentioned previously, a parallel feed network has a very wide band characteristic. Furthermore, because the array is preferably fed by a SML or ISML, transmission losses along the BFN are reduced, so a larger parallel feed may be used.

Figure 29:
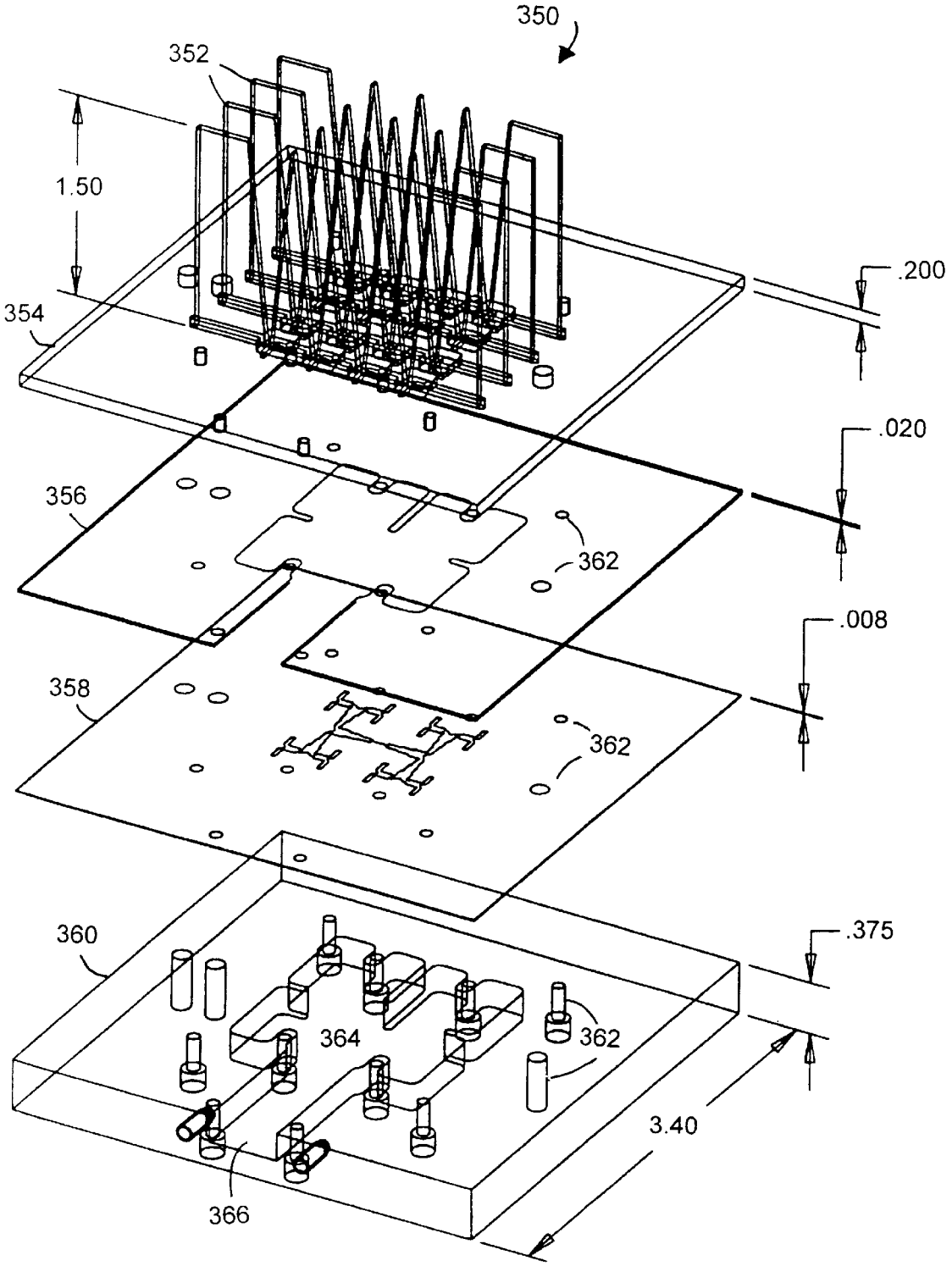
FIG. 29 shows an assembly for the array of FIGS. 27A–27C.

FIG. 29 shows a five piece assembly 350 for the 4×4 array of SML fed antenna elements in FIGS. 27A–27C (side walls and a radome for the assembly are not shown). The assembly 350 includes the metal fin radiating elements 352, the SML ground plate 354 (see FIG. 27A), a metal spacer layer 356, the PCB layer 358 with BFN (see FIG. 28), and a bottom plate 360. As mentioned, the metal fin radiating elements 352 and the SML ground plate 354 may be formed as a single part if desired. The spacer layer 356 may be omitted, and bumps or islands directly connected to the back of plate 354 may alternatively be used to create the desired air gap for the SML. The bottom plate 360 which is also made out of metal, preferably a light metal such as aluminium, serves to hold the entire array and to cover, shield, and ensure a good BFN for the SML. An air gap 364 provided by the back cover 360 also helps to reduce backlobe levels in the array beam pattern. Alignment holes 362 are also shown in FIG. 29 and serve to align and secure the array components when a screw or other suitable alignment device (not shown) is inserted there through. Since the array is SML fed, the BFN is formed on the surface of the PCB layer 358 which faces the bottom cover 360. The array input port 366 may be connected to another printed transmission line, such as a SML. Preferably however, the input port 366 is connected to a waveguide or a coaxial cable such as the UT86 low loss cable, since printed transmission lines have higher transmission loss over long distances. If so, a transition from the cable/waveguide to the BFN of the array SML is also required. This may be designed using the FDTD simulation tool.

Approximate dimensions for the array assembly components are given in FIG. 29. As indicated, the total array assembly is less than two inches thick—a very low profile.

Figure 30B:
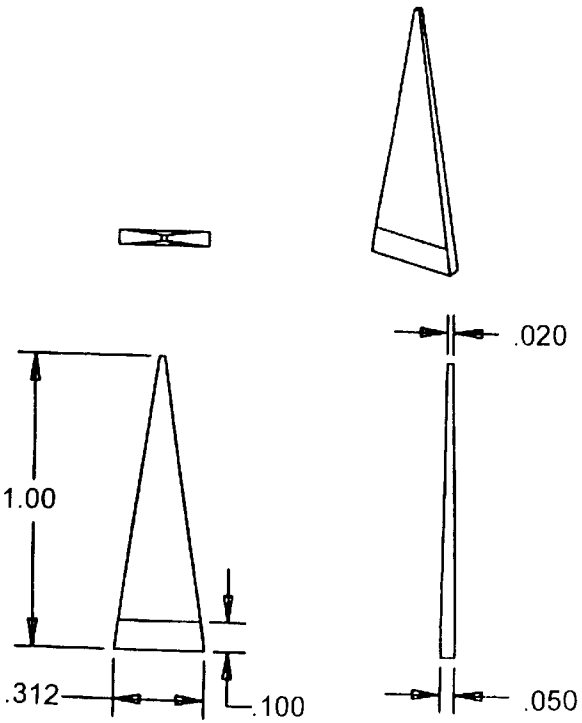
FIGS. 30A and 30B show possible dimensions for metal fin elements in FIGS. 23 and 24.
Figure 30A:
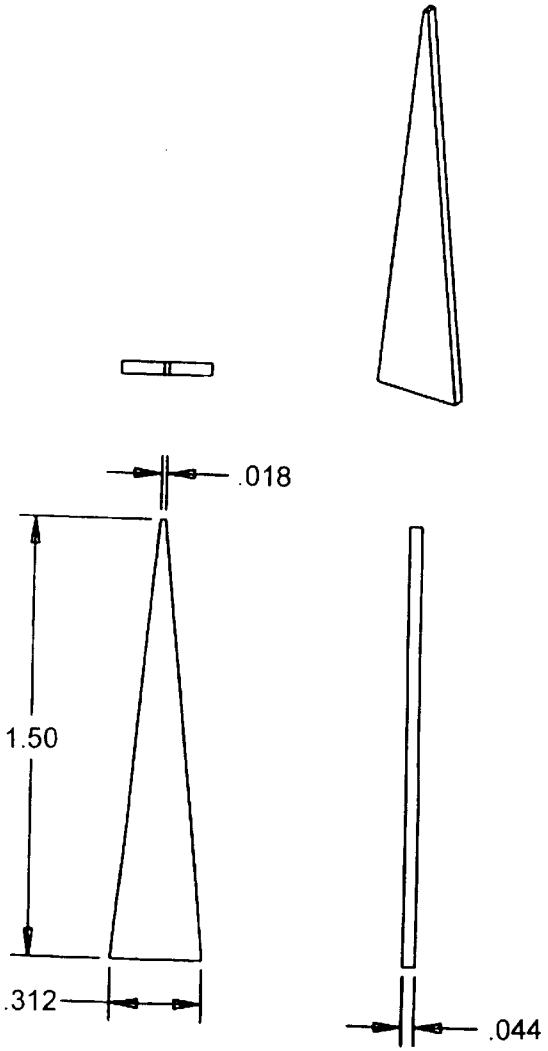

FIGS. 30A and 30B show two possible sets of dimensions (in inches) for the metal fin pieces of the array 350. In FIG. 30A, the metal fins are 1.50 inches long, whereas in FIG. 30B they are 1.00 inches long. The tradeoff between slot length and antenna thickness or profile was discussed previously. Also, as shown in FIG. 30B, the metal fins may decrease in thickness as the fins rise above their base. A decreasing thickness facilitates the use of a plastic injection mould or model for fabrication of the fin elements.

Referring back to FIG. 26, a preferred configuration of the feed slots in the printed transmission line ground is shown. Once again, an FDTD simulation tool was used to optimize and test the performance of the slot 320 as a transition feed between the strip line 308 and the tapered slot 312 via slot line 318. With,

| | |
|---|---|
| a = | 8 mil |
| b = | 20 mil |
| $\epsilon_{rm}$ = | 3.38 (RO4003 ™ material) |
| $d_c$ = | 32 mil |
| h = | 168 mil |
| w = | 56 mil |
| D = | 288 mil |
| $W_m$ = | 32 mil |
| W = | 344 mil |
| L = | 1484 mil |
| T = | 44 mil |

the following parameters were optimized for return loss performance within the 17–24 GHz band:

| | |
|---|---|
| s = | 32 mil |
| $s_m$ = | 32 mil |
| $l_1$ = | 144 mil |
| l = | 72 mil |
| $l_2$ = | 64 mil |

-continued

| | |
|---|---|
| u = | 48 mil |
| v = | 84 mil |
| y = | 32 mil |

Figure 31:
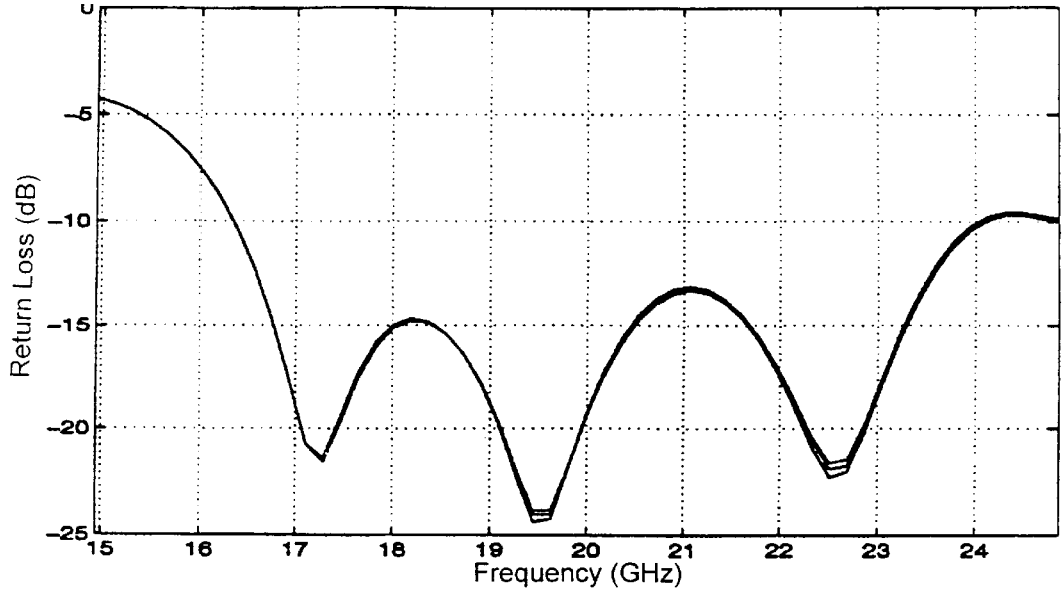
FIG. 31 shows the return loss performance of the tapered slot antenna structure of FIGS. 23 and 24 in a first frequency band.

FIG. 31 provides the return loss performance (simulated at three different sampling planes) of an antenna structure with the above parameters and indicates that the return loss is better than −10 dB for the band of interest (specifically 17.7–23.6 GHz).

Figure 32:
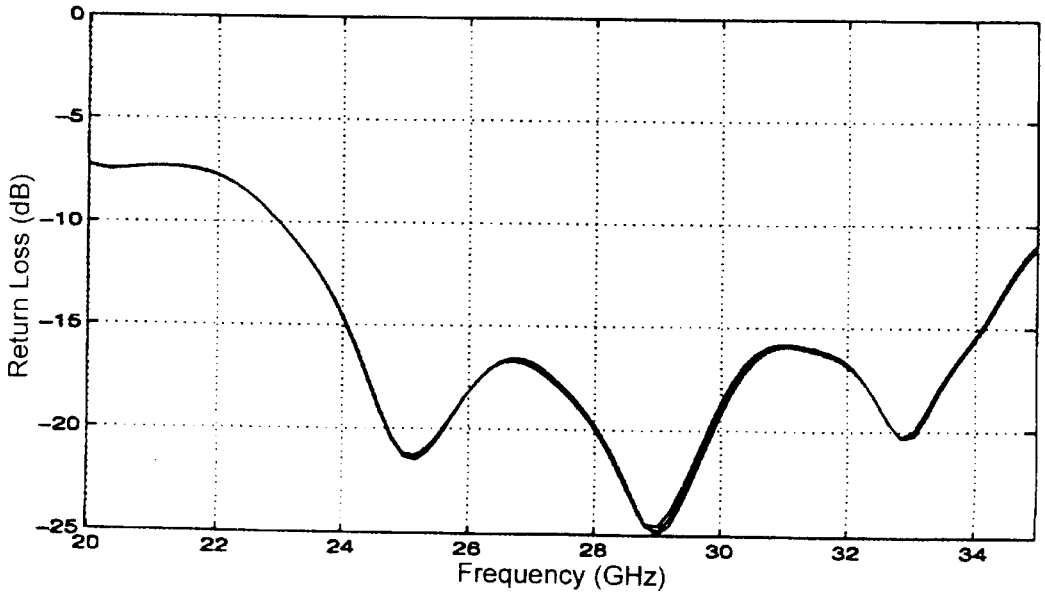
FIG. 32 shows the return loss performance of the tapered slot antenna structure of FIGS. 23 and 24 in a second frequency band.

A very significant advantage of the above described antenna structure is that, even if the parameters and dimensions of the tapered slot antenna elements and the SML (or other printed transmission line) are fixed, by changing the dimensions of the feed slot 320, the antenna structure can be designed to operate in a different frequency band, as long as $W \geqq \frac{1}{2}\lambda_{max}$ (at the minimum band frequency) and the element spacing is less than or equal to $\lambda_{min}$ (at the maximum band frequency). In practice, if an antenna structure is designed to operate within a given frequency band, attempting to operate it within either a lower or a higher frequency band will result in an unacceptable increase in transmission line loss and a high return loss. (This occurs in spite of the fact that the gain of an antenna theoretically increases with frequency.) However, in the present embodiment of the invention, an antenna design which operates within different frequency bands can be accommodated very easily. For instance, without altering the parameters given above for the tapered slot antenna elements and the SML, by changing the slot 320 dimensions as follows (s and $s_m$ are unchanged):

| | |
|---|---|
| $l_1$ = | 104 mil |
| l = | 32 mil |
| $l_2$ = | 48 mil |
| u = | 36 mil |
| v = | 60 mil |
| y = | 28 mil |

return loss can be optimized in the band from 24 GHz to 34 GHz. FIG. 32 shows the return loss (simulated at three different sampling planes) for the modified ground slot 320 dimensions. It should be noted that the BFN will need some slight modification when the operating band of the antenna array is changed. Specifically the power splitters (342 in FIG. 28) will need to be adjusted so that they maintain a proper phase relationship at the desired frequencies of operation. It may also be desirable, in some cases, to adjust the amount that the strip line feed 308 extends past the feed slot 320, so that this distance remains approximately equal to one quarter of the wavelength at the centre frequency of operation.

The ability to operate an antenna structure within a different frequency band without having to change the tapered slot antenna elements, the spacing between the tapered slot antenna elements, or the dimensions of the printed transmission line feed is highly desirable. For example, the ground plate 304 and the metal fins 315 can be manufactured as a single part which is made from pure copper or from an injection polymer thermoplastic (such as ABS) with copper plate finishing or some other suitable finishing material. Using this embodiment of the invention, one injection mould can be used for antennas designed to operate within various different frequency bands. The reduction in moulding requirements provides a very significant cost saving.

Further advantages also stem from having a feed slot in the ground of the printed transmission line and having the tapered slot antenna elements in a plane which intersects at an angle the ground plane of the printed transmission line, according to this aspect of the invention.

First, similar to the other embodiments of the present invention, the ground slots provide a feed transition with a sufficiently wide frequency bandwidth to allow the very wideband properties of the tapered slot antenna elements to be exploited in an antenna structure.

Second, the antenna structure 300 and particularly large arrays of the structure 300 are easy and inexpensive to fabricate. The array structures do not require any soldering which H-plane BFN to E-plane BFN transitions and H-plane array assembly usually require. The feed slots 320 are also easily etched or machined within the ground plate of the printed transmission line.

Third, the antenna elements can be very tightly packed in an array of antenna structures 300. In general, if the element spacing in an array is greater than the wavelength at a frequency, the grating lobe will severely degrade the antenna array beam patterns. Therefore, as mentioned above, the array element spacing should be less than or equal to $\lambda_{min}$ in the band. For example, for the band 17.7–23.6 GHz, the spacing should generally be smaller than about 500 mil. The aperture width W (and hence the element spacing) must also be larger than $\frac{1}{2}\lambda_{max}$, which in the above band is about 334 mil. It is generally preferable to maintain the element spacing at a minimum within the available range, so that large arrays can be built with smaller array footprints (for example, in the parameters given above, W=344 mil was chosen). Therefore, tight spacing is often required in higher frequency applications. This can be achieved by the array 300 because of the very compact nature of the ground slots, particularly for the preferred configuration of FIG. 26.

Fourth, an antenna array structure can have a very low profile or thickness, typically in the range of 1.5–2.0 inches, and still successfully meet all other performance requirements. This reduction in the thickness of the flat panel antenna array compared to the prior art and even in comparison to the arrays described in connection with other embodiments of the invention is advantageous. As mentioned previously, the thickness of the flat panel array structure can be further reduced by changing the angle $\alpha$ at which the tapered slot elements intersect the ground layer.

The cross-polarization, beamwidth, and gain provided by arrays of the structure 300 are now examined. While these results were obtained with $\alpha$ equal to 90°, similar results may be obtained with different intersection angles.

The array provides good polarization performance in the E-plane and, in particular, the H-plane. The ideal or desired polarization of the beam pattern of a radiating antenna is referred to as co-polarization, whereas the polarization which is orthogonal to the desired polarization is called cross-polarization. If the polarization in the E- and H-planes is pure enough, then the E- and H-plane radiation can travel together without interference. Cross Polarization Discrimination (XPD) is a measure of an antenna's ability to differentiate between vertical and horizontal polarizations, and hence increase radio capacity. It is essentially the ratio of the co-polarized main beam signal to the cross-polarized signal. In general, an antenna should provide at least −20 dB cross-polarization discrimination, particularly within the angular region of about twice the 3 dB beamwidth (where significant cross-polarization effects would be most problematic).

Figure 33:
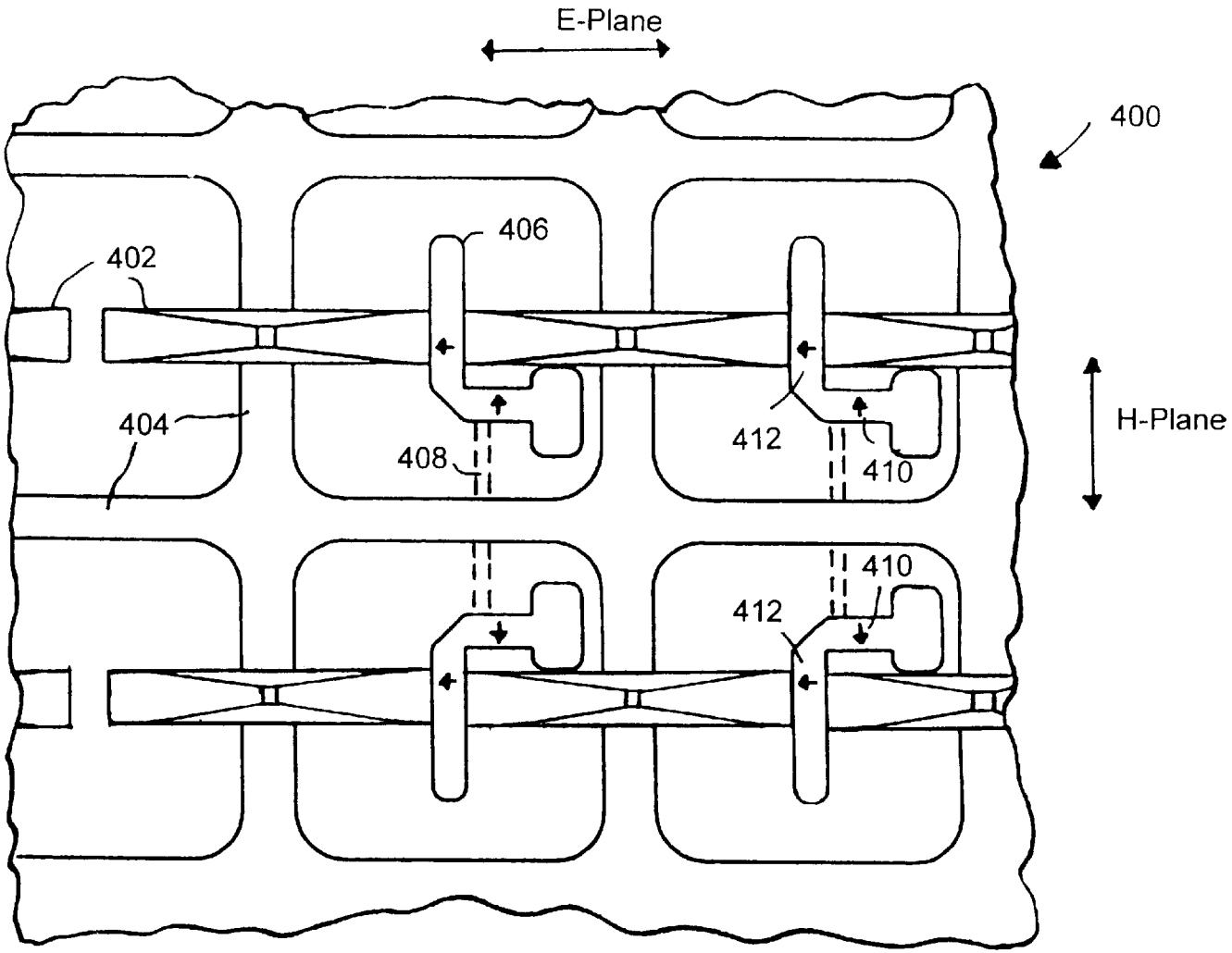
FIG. 33 illustrates how the configuration of the feed slots can help reduce H-plane cross-polarization.

The preferred right-angled configuration of the feed slots in an array of antenna elements serves to minimize H-plane cross-polarization in the 0° direction. This can be seen, for example, in FIG. 33 which shows a portion of a printed transmission line ground conductor plate 400 with metal fin components 402 and grid walls 404. The strip line feeds 408 on the PCB layer feed the ground slots 406 which in turn feed the tapered slot elements formed between the metal fins 402. As shown in FIG. 33, due to the right-angled configuration of the slots 406, the H-plane cross-polarization effects 410 of neighbouring slots cancel one another at the broadside of the antenna array (the broadside or endfire direction is out of the page in FIG. 33). On the other hand, the E-plane cross-polarization effects 412 do not cancel, but rather add to one another. However, the grid walls on the ground plate help to significantly reduce cross-polarization (in both planes). To further reduce crosstalk, a thin copper tape (not shown) can be placed between the metal fins of E-plane sub-arrays along the top of the grid surface of the ground plate. It should also be noted that the side walls around the perimeter of the ground plate serve to reduce the sidelobe levels in the antenna beam pattern.

FIGS. 34A–34F show the E-plane co-polarization 420 and cross-polarization 422 patterns for the small 4×4 array of FIG. 29 at the frequencies, 17.7, 18.7, 19.7, 21.2, 22.4, and 23.6 GHz respectively. The cross-polarization discrimination for these frequencies varies from about −15 to −20 dB in the E-plane within the angular region of twice the 3 dB beamwidth. Similarly, FIGS. 35A–35F show the H-plane co-polarization 424 and cross-polarization 426 patterns for the 4×4 array of FIG. 29 at the same respective frequencies. In the H-plane, the cross-polarization discrimination for the 4×4 array ranges from about −20 to −25 dB within the angular region of twice the 3 dB beamwidth. As noted, the 3 dB beamwidth is also seen in the co-polarization patterns of FIGS. 34A–34F and 35A–35F and is approximately 20°. For both the E-plane and the H-plane patterns, the cross-polarization discrimination well outside the 3 dB beamwidth region is relatively small.

Figure 36:
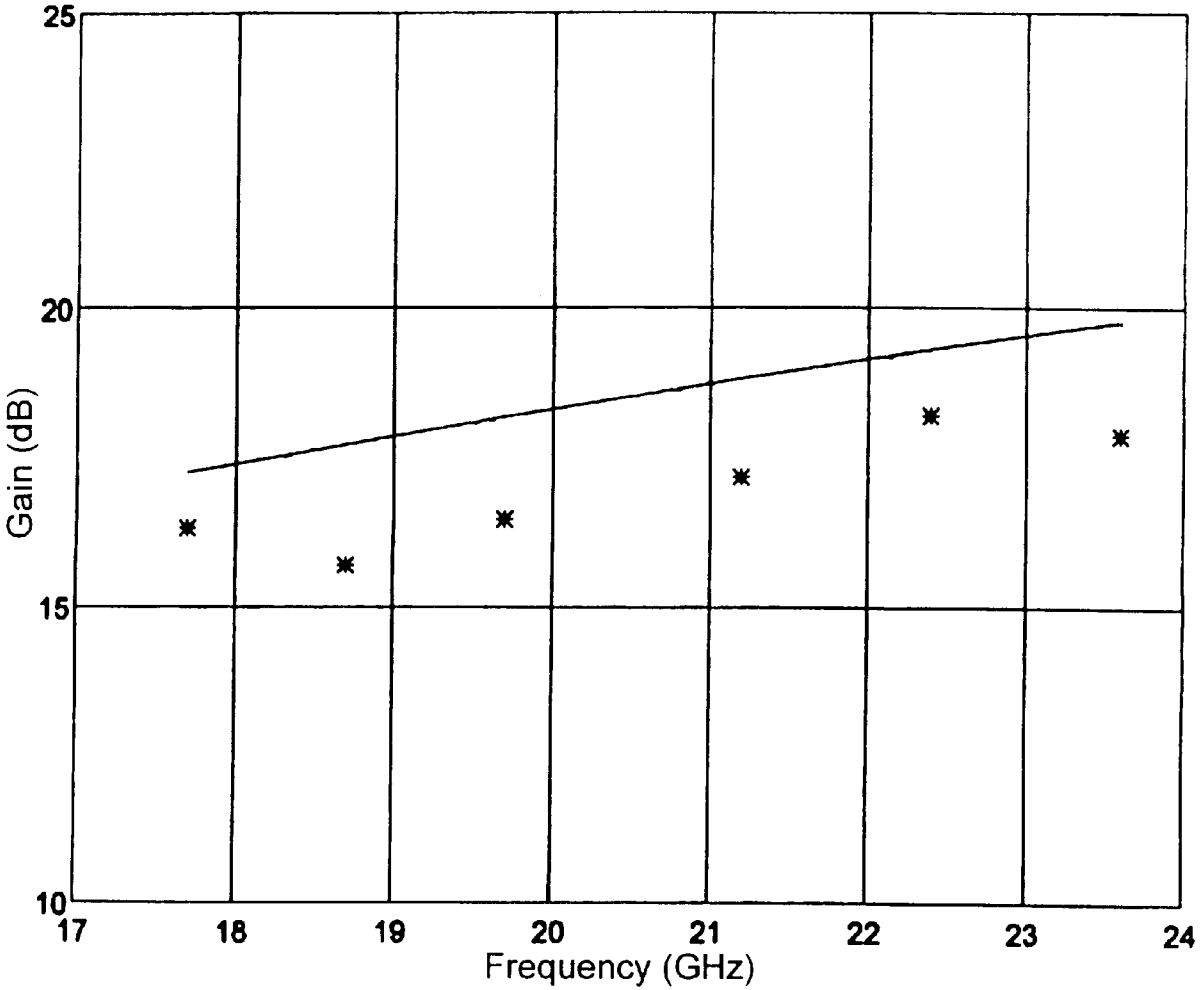
FIG. 36 shows the measured gain and directivity gain for the 4×4 array of FIGS. 27A–27C.

FIG. 36 shows the measured gain (at points 430) in comparison to the directivity gain at 432 of the 4×4 array. Recall that the directivity gain rating is proportional to the physical area of the antenna expressed in square wavelengths. The measured gain in FIG. 36 varies from about 16–18 dBi from 17–24 GHz and agrees quite well with the directivity. Also, as mentioned previously, beamwidth and gain vary inversely with one another (i.e. a high gain antenna has a narrow beamwidth).

Figure 37A:
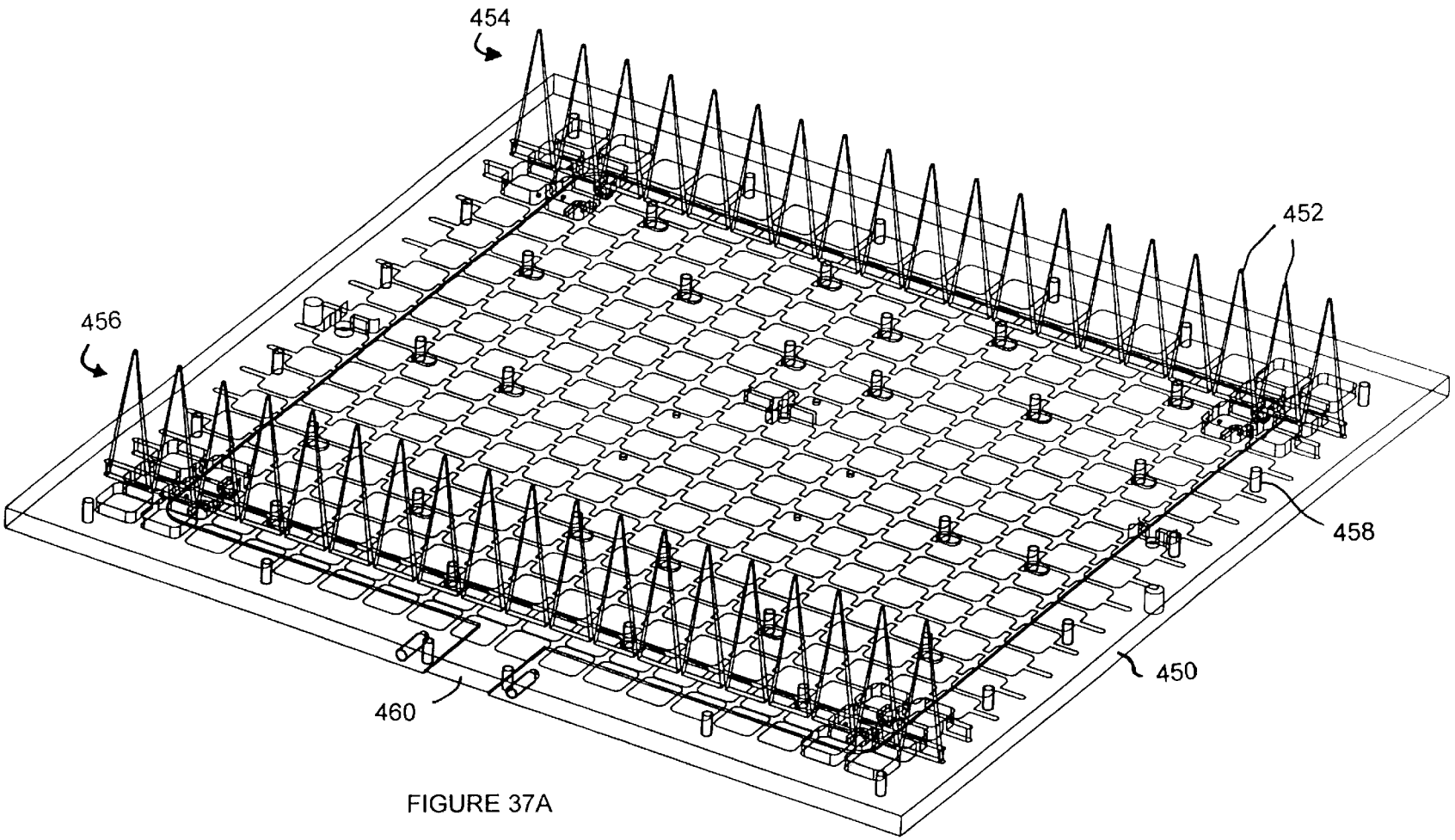
FIGS. 37A–37D show components for a 16×16 array assembly of the tapered slot antenna structures of FIGS. 23 and 24
Figure 37B:
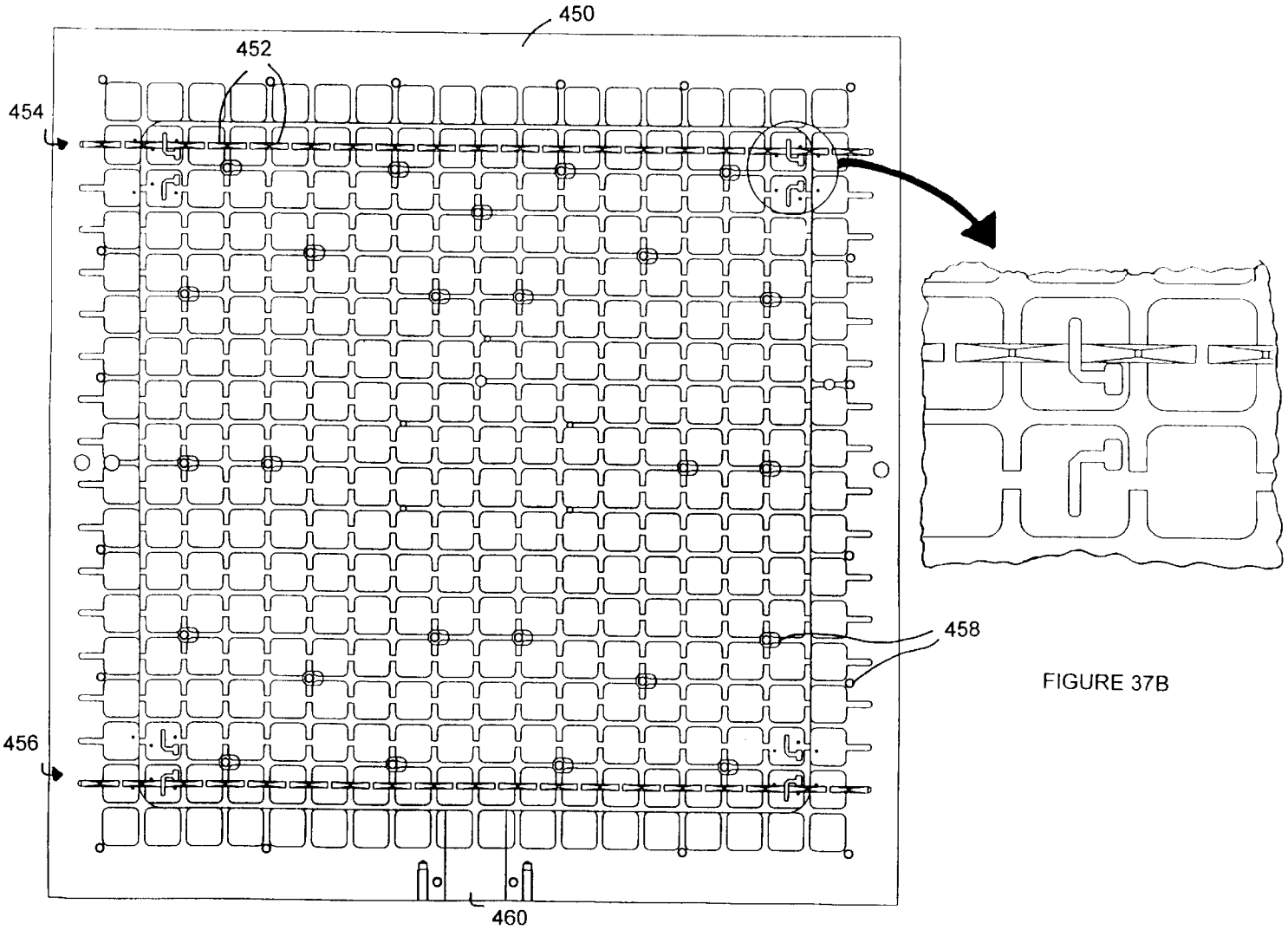
Figure 37C:
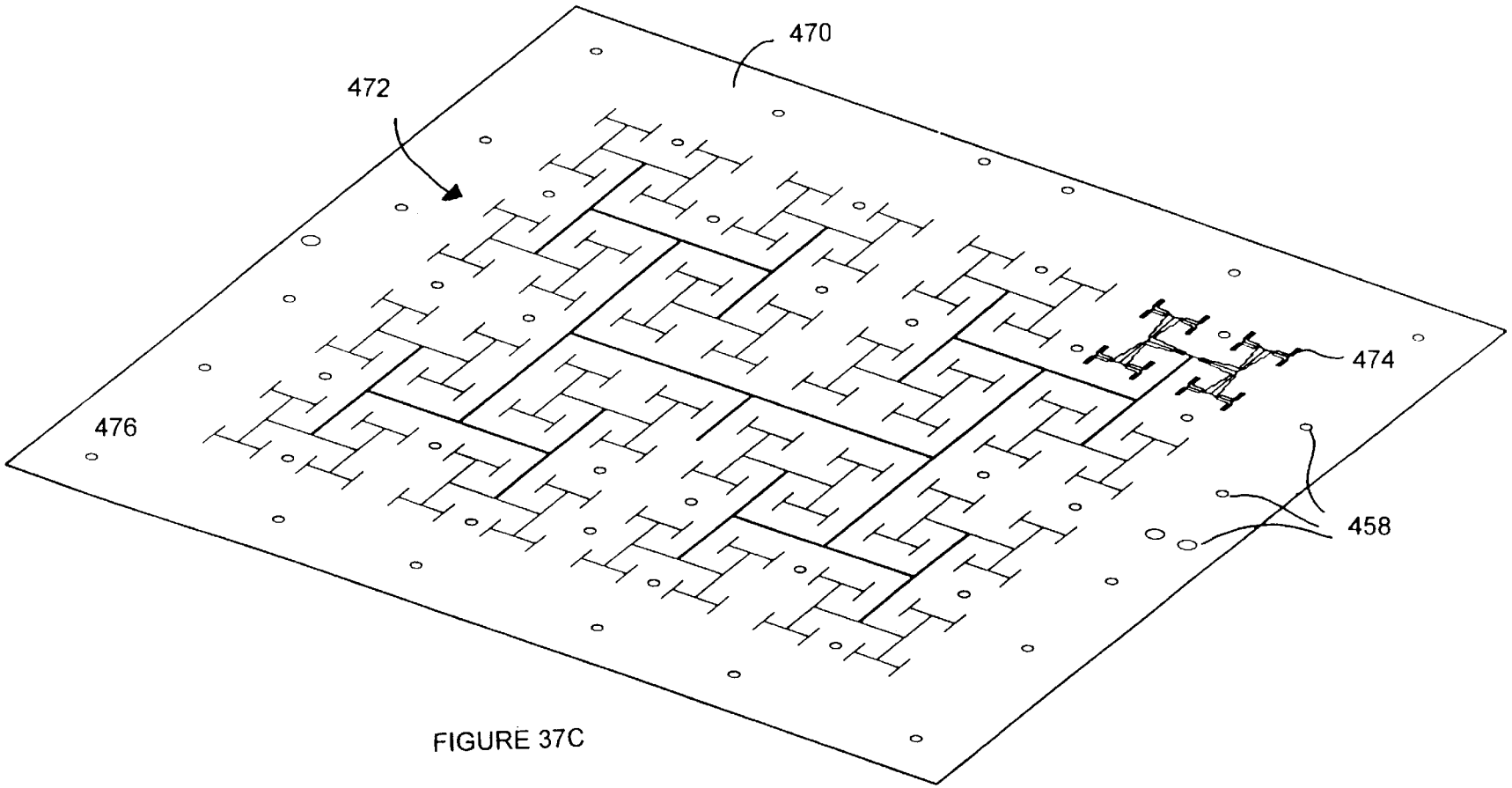

To improve upon the above-mentioned antenna characteristics, a 16×16 antenna array of structures 300 was built. FIGS. 37A–37D show the components of such an array assembly. FIG. 37A shows the ground plate 450 with the metal fins 452 for two E-plane sub-arrays 454 and 456 (the remaining E-plane sub-arrays are not shown for simplicity). The input port is shown at 460. Alignment holes are also shown in FIG. 37A, at least some of which may receive a securing and alignment means such as a screw. FIG. 37B shows a top view of the structure in FIG. 37A. FIG. 37C show the PCB layer 470 with a two dimensional BFN 472 on the surface 476. For simplicity, only a portion 474 of the BFN 472 is shown with impedance transformers and power splitters, although the entire BFN 472 will preferably include these (similar to the BFN for the 4×4 array in FIG. 28). A spacer layer (not shown) may be used to separate the ground plate 450 from the PCB layer 470. Alternatively, the ground plate 450 can itself form the desired air gap, for example by means of a perimeter wall and/or islands of appropriate height on the back surface of the ground plate (again not shown). In this case, the spacers are integrally built with plate 450, so that the bottom surface of the plate 450 is no longer flat. The islands or bumps act as spacers and can contain alignment holes sized to receive screws.

Figure 37D:
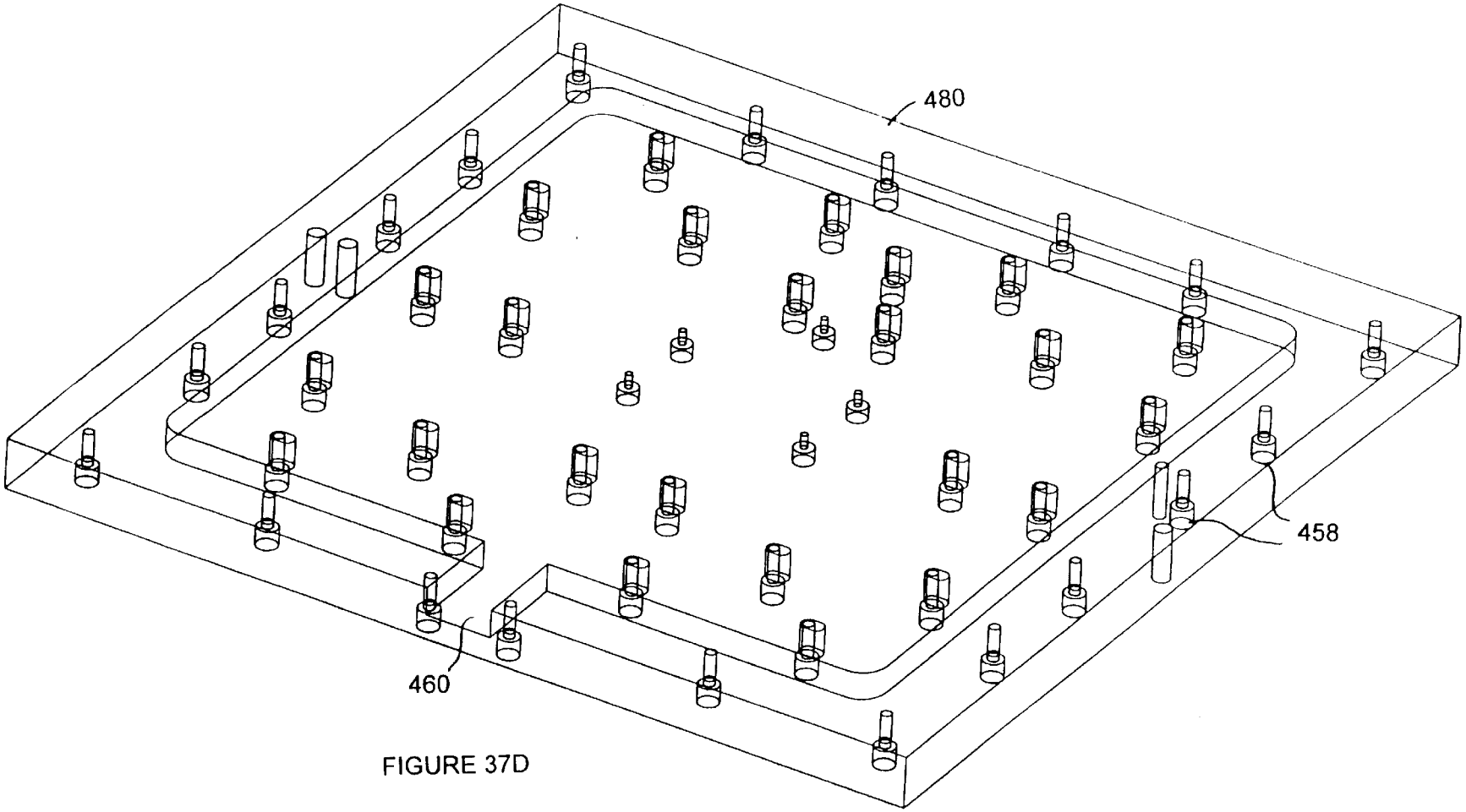

For a SML feed, the BFN 472 will be on the surface of the PCB layer 470 which faces away from the ground plate 450 (for an ISML feed, the BFN 472 will be on the surface of the PCB layer 470 which faces the ground plate 450). The back plate or cover 480 is shown in FIG. 37D and is similar to the back cover 360 in FIG. 29 for the 4×4 array. This 16×16 array assembly is approximately 6 inches wide by 6 inches long, and it can be made 1.5–2.0 inches thick. As before, the thickness of the array will depend on the length of the metal fin elements (or equivalently the length of the tapered slot elements).

As mentioned previously, the input port 460 of the 16×16 array may be connected to a printed transmission line, a waveguide, or a coaxial cable. Where a transition from the printed transmission line which feeds the array elements to a cable or waveguide is required, the structure of the transition can be optimized (in terms of insertion loss) using a FDTD simulator tool.

The return loss for this 16×16 array was measured at less than −10 dB from 17–24 GHz. FIGS. 38A–38L show the E-plane co-polarization 490 and cross-polarization 492 patterns for the 16×16 array shown in FIGS. 37A–D at 17.4, 18.0, 18.6, 19.2, 19.8, 20.4, 21.0, 21.6, 22.2, 22.8, 23.4, and 24.0 GHz respectively. With the help of a polarizor (not shown), cross polarization discrimination is better than −30 dB within the angular region of twice the 3 dB beamwidth, as shown in FIGS. 37A–D. In the ±30°–60° degree regions, the cross polarization discrimination is about −20 dB. FIGS. 38A–38L show the H-plane co-polarization 494 and cross-polarization 496 patterns for the 16×16 array at the same frequencies as above. FIGS. 39A–39L provide similar—in most instances slightly better—cross polarization discrimination to FIGS. 38A–38L (i.e. at or better than −30 dB near the 3 dB beamwidth region and at or better than −20 dB within the ±30°–60° degree regions). A polarizer may be formed by the inner surface of a radome (not shown), which is a protective dielectric housing for an antenna assembly. The radome may be made from, for example,5 mil thick FR4 and could be about 200 mil away from the antenna assembly. The radome additionally acts as a polarizer by placing conducting strips along its inner surface.

Figure 40:
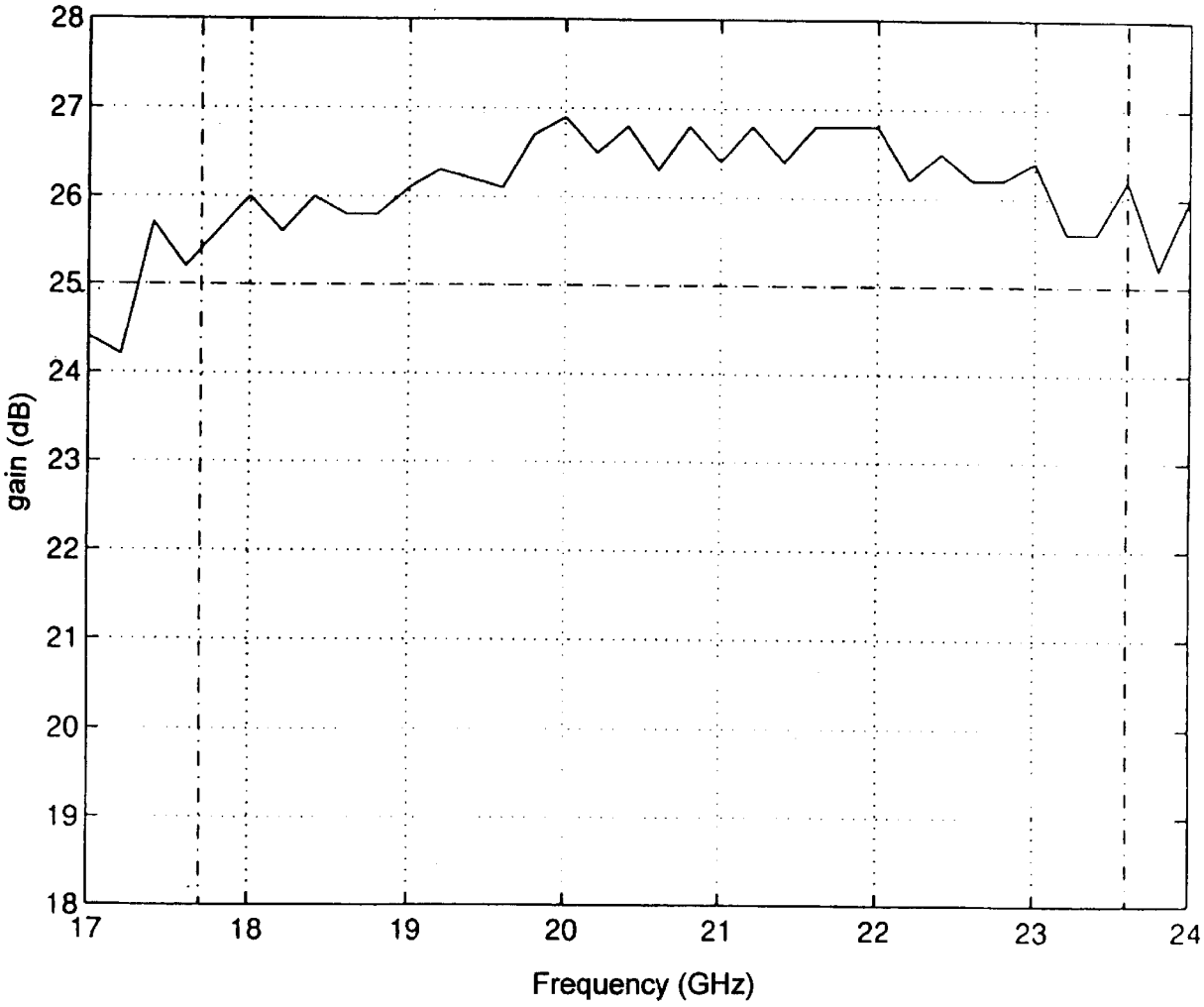
FIG. 40 shows the measured gain and directivity gain for the 16×16 array of FIGS. 37A–37D.

In FIGS. 38A–38L and 39A–39L, the 3 dB beamwidth in the E-and H-planes is approximately 5–6° and narrows slightly as the frequency increases. FIG. 40 shows the measured gain of the 16×16 array antenna of FIGS. 37A–37D from 17 GHz to 24 GHz. As shown, the gain is generally better than 25 dBi. (Note that the slight decrease in gain at the upper end of this frequency band is attributable to a small increase in the return loss at these frequencies.) The 16×16 array of FIGS. 37A–37D can be used as a sub-array in a larger array. In building, for example, a 32×32 array by assembling four of the 16×16 arrays, it is preferable to have a low loss cable such as a UT86 cable connected to the input port 460 of each 16×16 sub-array, so that the interconnections between the sub-arrays, which may be of the order of one foot long, do not result in a significant transmission loss. (Recall that printed transmission lines have higher loss over long distances.) The four cables which connect to the input ports of each 16×16 sub-array can then be fed via a single waveguide.

A 32×32 antenna array structure assembled in this manner. has a footprint of about 12 inches by 12 inches and can once again have a thickness of 2.0 inches or less. This array exhibited a gain of approximately 34 dBi or better, a beamwidth of less than 2.2°, and cross-polarization results similar to the 16×16 array.

It will be clear to those skilled in the art that the above-described embodiments of the present invention are not limited to the millimeter or sub-millimeter frequency bands, nor to any other frequency band of operation. Furthermore, the antenna structures of the present invention may be used, for example, in connection with LAN (local area network), GPS (global positioning system), or PCS (personal communication services) systems. Also, although many of the illustrated embodiments of the invention show linear tapered slot array elements, Vivaldi, constant width, and any other slot shaped elements can also be used in any of the disclosed embodiments. Finally, the present invention may be applied equally to both radiating and receiving antenna devices.

Therefore, while preferred embodiments of the invention have been described, these are illustrative and not restrictive, and the present invention is intended to be defined by the appended claims.

We claim:

1. A tapered slot antenna structure comprising:

(a) a transmission line having a dielectric substrate, a strip conductor feed, and a ground layer, the dielectric substrate having first and second opposing surfaces and the ground layer having front and back opposing surfaces, the strip conductor feed running along one of said first and said second surfaces of the dielectric substrate, the back surface of the ground layer facing and being disposed in parallel to the second surface of the dielectric layer, and the ground layer further having a feed slot formed within it;

(b) a metallization layer lying in a plane which intersects the ground layer at an intersection angle, said metallization layer having a base end connected to the front surface of the ground layer and an aperture end, and said metallization layer having a tapered slot formed within it, said tapered slot having an aperture width at the aperture end of said metallization layer and said tapered slot forming a slot line having a slot line width narrower than the aperture width at the base end of said metallization layer; and (c) said feed slot having a first portion, a second portion and a transition portion which couples the first and second portions, the first portion of said feed slot intersecting the slot line in the ground layer and the second portion of said feed slot crossing over the strip conductor feed in a parallel plane manner, whereby the slot line and the strip conductor feed are electromagnetically coupled and the first and second portions are not co-linear.

2. A tapered slot antenna structure according to claim 1 wherein the intersection angle is in the range of 45°–135°.

3. A tapered slot antenna structure according to claim 2 wherein the intersection angle is equal to 90°, so that the metallization layer lies in a plane which is perpendicular to the ground layer and the dielectric substrate.

4. A tapered slot antenna structure according to claim 1 wherein the strip conductor feed runs along the first surface of the dielectric substrate, and the ground layer faces said dielectric substrate, is disposed in parallel to the second surface of said dielectric substrate, and is spaced from the dielectric substrate such that an air gap is formed between the second surface and said ground layer.

5. A tapered slot antenna structure according to claim 1 wherein the strip conductor feed runs along the second surface of the dielectric substrate, and the ground layer faces said dielectric substrate, is disposed in parallel to the second surface of said dielectric substrate, and is spaced from the dielectric substrate such that an air gap is formed between the second surface and said ground layer.

6. A tapered slot antenna structure according to claim 1 wherein the strip conductor feed runs along the first surface of the dielectric substrate, and the ground layer faces and is disposed in parallel to and directly against the second surface of said dielectric substrate.

7. A tapered slot antenna structure according to claim 1 wherein said feed slot is rectilinear in shape.

8. A tapered slot antenna structure according to claim 7 wherein the width of the first portion of said feed slot equals the slot line width.

9. A tapered slot antenna structure according to claim 1 wherein the first portion of said feed slot has first and second ends and the second portion of said feed slot has first and second ends, and the first end of the first portion is connected to the first end of the second portion by the transition portion such that the first portion and the second portion are perpendicular to one another.

10. A tapered slot antenna structure according to claim 9 wherein said feed slot further includes a termination segment connected to the second end of the second portion of said feed slot.

11. A tapered slot antenna structure according to claim 10 wherein the termination segment is rectangular.

12. A tapered slot antenna structure according to claim 9 wherein the width of the first portion of said feed slot equals the slot line width.

13. A tapered slot antenna structure according to claim 1 wherein the transition portion is curvilinear.

14. A tapered slot antenna structure according to claim 13 wherein the first and second portions are rectilinear.

15. An M×N array of tapered slot antenna elements, where M and N are positive integers greater than or equal to one, comprising:

(a) a transmission line having a dielectric substrate, a beam forming network feed, and a ground layer, the dielectric substrate having first and second opposing surfaces and the ground layer having front and back opposing surfaces, the beam forming network running along one of said first and said second surfaces of the dielectric substrate, the back surface of the ground layer facing and being disposed in parallel to the second surface of the dielectric layer, the ground layer further having a feed slot for each of said tapered slot antenna elements formed within it, and the beam forming network having a strip conductor feed for each of said tapered slot antenna elements;

(b) M metallization layers each lying in a plane which intersects the ground layer at an intersection angle, each of said metallization layers having a base end connected to the front surface of the ground layer and an aperture end, and each of said metallization layers having N tapered slots formed within it, the tapered slots having an aperture width at the aperture end of the metallization layer and each of the tapered slots forming a slot line having a slot line width narrower than the aperture width at the base end of the metallization layer; and, (c) the feed slot for each of said tapered slot antenna elements having a first portion, a second portion and a transition portion which couples the first portion to the second portion, the first portion of each feed slot intersecting the slot line of said tapered slot antenna element in the ground layer and the second portion of said feed slot crossing over the strip conductor feed for said tapered slot antenna element in a parallel plane manner, whereby the slot line and the strip conductor for said tapered slot antenna element feed are electromagnetically coupled and the first and second portions are not co-linear.

16. An array of tapered slot antenna elements according to claim 15 wherein the intersection angle is in the range of 45°–135°.

17. An array of tapered slot antenna elements according to claim 16 wherein the intersection angle is equal to 90°, so that the M metallization layers each lie in a plane which is perpendicular to the ground layer and the dielectric substrate.

18. An array of tapered slot antenna elements according to claim 15 wherein said M metallization layers are parallel to one another and each of the N tapered slots formed thereon being arranged so that the intersections in the ground layer of the first portion of each feed slot and the slot line for said tapered slot antenna element are uniformly aligned and spaced apart.

19. An array of tapered slot antenna elements according to claim 18 wherein the beam forming network feeds each of said tapered slot antenna elements in parallel.

20. An array of tapered slot antenna elements according to claim 19 wherein the beam forming network runs along the first surface of the dielectric substrate, and the ground layer faces said dielectric substrate, is disposed in parallel to the second surface of said dielectric substrate, and is spaced from the dielectric substrate such that an air gap is formed between the second surface and said ground layer.

21. An array of tapered slot antenna elements according to claim 19 wherein the beam forming network runs along the second surface of the dielectric substrate, and the ground layer faces said dielectric substrate, is disposed in parallel to the second surface of said dielectric substrate, and is spaced from the dielectric substrate such that an air gap is formed between the second surface and said ground layer.

22. An array of tapered slot antenna elements according to claim 18 wherein the front surface of the ground layer includes a grid wall structure such that each of the feed slots in the ground layer is surrounded by a portion of the grid wall structure.

23. A tapered slot antenna structure according to claim 15 wherein said feed slot is rectilinear in shape.

24. A tapered slot antenna structure according to claim 15 wherein the first portion of said feed slot has first and second ends and the second portion of said feed slot has first and second ends, and the first end of the first portion is connected to the first end of the second portion by the transition portion such that the first portion and the second portion run perpendicularly to one another.

25. A tapered slot antenna feed structure comprising:

(a) a dielectric substrate having first and second opposing surfaces;

(b) a strip conductor feed running along one of the first and second surfaces;

(c) a ground layer having front and back opposing surfaces, said back surface facing and being disposed in parallel to the second surface of said dielectric substrate; and (d) first and second metallization layers running along one of said first and second surfaces, each of said metallization layers having a base end and an aperture end, said metallization layers forming a tapered slot therebetween, said tapered slot having an aperture width at the aperture ends of said metallization layers and said tapered slot forming a slot line having a slot line width narrower than the aperture width between the base ends of said metallization layers, the base end of said first metallization layer being connected to a metallization patch on said one of said first and second surfaces of said dielectric substrate, said patch being electrically connected to said ground layer, and the base end of said second metallization layer being electrically connected to the strip conductor feed.

26. An antenna structure according to claim 25 wherein the back surface of said ground layer is spaced from the dielectric substrate such that a gap is formed between the second surface of said dielectric substrate and said ground layer, said gap containing a low dielectric constant material.

27. An antenna structure according to claim 26 wherein said low dielectric constant material comprises air.

28. An antenna structure according to claim 27 wherein said strip conductor feed and said first and second metallization layers run along the first surface of said dielectric substrate, said patch being electrically connected through said dielectric substrate to said ground layer.

29. An antenna structure according to claim 27 wherein said strip conductor feed and said first and second metallization layers run along the second surface of said dielectric substrate.

30. An antenna structure according to claim 25 wherein the back surface of said ground layer is disposed directly against the second surface of said dielectric substrate, said strip conductor feed and said first and second metallization layers run along the first surface of said dielectric substrate, and said patch is electrically connected through said dielectric substrate to said ground layer.

* * * * *

UNITED STATES PATENT AND TRADEMARK OFFICE

CERTIFICATE OF CORRECTION

PATENT NO. : 6,317,094 B1
DATED : November 13, 2001
INVENTOR(S) : Wu et al.

It is certified that error appears in the above-identified patent and that said Letters Patent is hereby corrected as shown below:

Column 14,
Line 54, the term "Sml" has been capitalized, so that the heading reads -- Tapered Slot Antenna With Basic SML Feed --;

Column 17,
Line 13, the word "screws" has been changed to -- screw --, so that the line reads -- securing device such as a screw. --;
Line 40, the opening bracket "(" has been deleted, so that the line reads -- 196, which feeds a first 1x16 portion of the array, and a --;
Line 52, the word "beamwdith" has beed changed to -- beamwidth --, so that the line reads -- the beamwidth in the H-plane is not affected by the number --;

Column 18,
Line 34, the word "Antennd" has been changed to -- Antenna -- and the term "Isml" has been capitalized, so that the heading reads -- Tapered Slot Antenna With Double Strip ISML Feed --;
Line 36, the word "stucture" has been changed to -- structure --, so that the line reads -- SML feed structure for the tapered slot antenna element 164 --;
Line 42, the word "paremeters" has been changed to -- parameters --, so that the line reads -- (or other suitable set of parameters). --;

Column 21,
Line 53, the term -- SML -- has been added, so that the heading reads -- Tapered Slot Antenna With Double Strip SML Feed --;

Column 22,
Line 36, the word "Transmisson" has been changed to -- Transmission --, so that the line reads -- of the Printed Transmission Line --.

Column 23,
Line 18, the word "elelment" has been changed to -- element --, so that the line reads -- thickness of the antenna element (or an array of such --;
Line 22, the word "a" has been changed to the symbol -- $\alpha$ --, so that the line reads -- angle. In general, $\alpha$ may take on any value so long as the --;

UNITED STATES PATENT AND TRADEMARK OFFICE

CERTIFICATE OF CORRECTION

PATENT NO. : 6,317,094 B1
DATED : November 13, 2001
INVENTOR(S) : Wu et al.

It is certified that error appears in the above-identified patent and that said Letters Patent is hereby corrected as shown below:

Column 29,
Line 57, the word "show" has been changed to -- shows --, so that the line reads -- FIG. 37C shows the PCB layer 470 with a two dimensional --;

Column 30,
Line 67, the period "." has been deleted, so that the line reads -- ner has a footprint of about 12 inches by 12 inches and can --.

Signed and Sealed this

First Day of April, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,317,094 B1
DATED : November 13, 2001
INVENTOR(S) : Wu et al.

It is certified that error appears in the above-identified patent and that said Letters Patent is hereby corrected as shown below:

Column 5,
Line 1, the word "of" has been deleted, so that the line reads "FIG. 12D shows a bottom view of the surface of the";
Line 33, a semi-colon -- ; -- has been added at the end of the line, so that the line reads "antenna structures of FIGS. 23 and 24;";
Line 60, a semi-colon -- ; -- has been added at the end of the line, so that the line reads "and 24;";

Column 6,
Line 57, the word "however" has been changed to --However --, so that the line reads "parabolic reflector antennas. However, while parabolic";

Column 8,
Line 60, the word "Since" has been changed to -- since --, so that the line reads "sions and shapes, i.e. non-symmetrical, since the top con-";

Column 9,
Line 5, the number "8" has been changed to the letter -- S --, so that the line reads "microstrip line 70 by a distance ¼λs, where λs is the";
Line 9, the word "the" has been deleted, so that the line reads "antenna. The metallization layer 82 forms the ground of";

Column 10,
Line 39, the letter "k" has been changed to -- λ --, so that the line reads "wavelength λ along the transmission line. As a result, a large";

Column 13,
Line 42, a period -- . -- has been added at the end of the line, so that the line reads "element.".

Signed and Sealed this

Fifteenth Day of July, 2003

JAMES E. ROGAN
*Director of the United States Patent and Trademark Office*